US010524574B2

(12) United States Patent
LaPointe et al.

(10) Patent No.: US 10,524,574 B2
(45) Date of Patent: Jan. 7, 2020

(54) FURNITURE MEMBER WITH POWERED WALL-PROXIMITY MECHANISM

(71) Applicant: La-Z-Boy Incorporated, Monroe, MI (US)

(72) Inventors: Larry P. LaPointe, Temperance, MI (US); Chad E. Adams, Perrysburg, OH (US); Gerald G. Stotz, Ida, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 15/983,486

(22) Filed: May 18, 2018

(65) Prior Publication Data

US 2019/0350362 A1 Nov. 21, 2019

(51) Int. Cl.

| | |
|---|---|
| ***A47C 1/02*** | (2006.01) |
| ***A47C 1/024*** | (2006.01) |
| ***A47C 1/032*** | (2006.01) |
| ***A47C 1/034*** | (2006.01) |
| ***A47C 1/035*** | (2006.01) |
| ***A47C 1/0355*** | (2013.01) |

(Continued)

(52) U.S. Cl.

CPC ..... *A47C 1/034* (2013.01); *A47C 7/002* (2013.01); *A47C 7/506* (2013.01); *A47C 1/024* (2013.01)

(58) Field of Classification Search

CPC ..... A47C 1/034; A47C 7/002; A47C 7/506
USPC ..... 297/83–85 C
See application file for complete search history.

(56) References Cited

U.S. PATENT DOCUMENTS

| | | | |
|---|---|---|---|
| 203,602 | A | 5/1878 | Dietsch |
| 2,473,895 | A | 6/1949 | Mednick |
| 2,719,572 | A | 10/1955 | Goldberg |

(Continued)

FOREIGN PATENT DOCUMENTS

| | | | |
|---|---|---|---|
| CN | 200976974 | Y | 11/2007 |
| DE | 623960 | C | 1/1936 |

(Continued)

OTHER PUBLICATIONS

International Search Report and Written Opinion of the International Searching Authority for Application No. PCT/US2018/025467, dated Jul. 17, 2018.

(Continued)

*Primary Examiner* — Rodney B White
(74) *Attorney, Agent, or Firm* — Harness, Dickey & Pierce, P.L.C.

(57) ABSTRACT

A furniture member includes a base frame, a seat assembly, a motor assembly, a legrest mechanism and a wall-proximity mechanism. The seat assembly is supported by the base frame and includes a seat frame, a seat bottom, a seat back and a legrest. The legrest is movable between a retracted position and an extended position. The seat back is movable between an upright position and a reclined position. The motor assembly includes a draw bar that moves along a motor extrusion housing from an initial position to a first position and to a second position. The legrest mechanism is driven by the draw bar to move the legrest between the retracted and extended positions. The wall-proximity mechanism is driven by the draw bar to translate the seat frame forward relative to the base frame in response to movement of the draw bar from the first position to the second position.

20 Claims, 38 Drawing Sheets

(51) Int. Cl.
*A47C 7/50* (2006.01)
*A47C 7/00* (2006.01)

(56) References Cited

U.S. PATENT DOCUMENTS 2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,637,255 A * 1/1972 Re ..... A47C 1/0345 297/85 R X
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A * 12/1975 Evans ..... A47C 1/0345 297/88
3,941,417 A 3/1976 Re
4,099,776 A 7/1978 Crum
4,140,342 A 2/1979 Jones
4,179,157 A 12/1979 Shoemaker et al.
4,212,494 A 7/1980 Dabney
4,216,991 A * 8/1980 Holobaugh ..... A47C 1/0352 297/85 R X
4,216,992 A 8/1980 Crum
4,226,468 A 10/1980 Johnson
4,244,620 A * 1/1981 Harrison ..... A47C 1/0352 297/85 R X
4,352,523 A * 10/1982 Holobaugh, Jr. ..... A47C 1/035 297/83 X
4,364,603 A * 12/1982 Johnson ..... A47C 1/0352 297/84 X
4,367,895 A * 1/1983 Pacitti ..... A47C 1/0355 297/84 X
4,373,602 A 2/1983 Tomita et al.
4,451,084 A 5/1984 Seeley
4,492,407 A 1/1985 Broadhead
4,519,647 A * 5/1985 Rogers, Jr. ..... A47C 1/0355 297/85
4,570,996 A * 2/1986 Rogers, Jr. ..... A47C 7/506 297/85 R X
4,582,435 A 4/1986 Davis
4,601,513 A * 7/1986 Pine ..... A47C 1/0355 297/85
4,650,211 A 3/1987 Tanahashi
4,662,597 A 5/1987 Uecker et al.
4,740,031 A * 4/1988 Rogers, Jr. ..... A47C 1/0345 297/85
4,805,960 A 2/1989 Tacker
4,861,101 A 8/1989 Hartline
4,932,927 A 6/1990 Fillar
4,989,914 A * 2/1991 Pine ..... A47C 1/0352 297/85
5,011,220 A 4/1991 LaPointe
5,064,244 A 11/1991 Sproule
5,072,988 A 12/1991 Plunk
5,088,789 A 2/1992 LaPointe et al.
5,123,705 A 6/1992 Johnson
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,328,235 A 7/1994 Saul et al.
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A * 1/1996 May ..... A47C 1/0352 297/83
5,480,213 A 1/1996 Sproule
5,527,095 A 6/1996 Marshall et al.
5,567,009 A 10/1996 Fay et al.
5,570,927 A 11/1996 LaPointe et al.
5,570,930 A 11/1996 LaPointe et al.
5,597,209 A 1/1997 Bart et al.
5,765,913 A 6/1998 LaPointe et al.
5,772,278 A 6/1998 Kowalski
5,775,775 A * 7/1998 Hoffman ..... A47C 1/0355 297/85 R X
5,806,920 A * 9/1998 Blount ..... A61G 5/14 297/85
5,806,921 A 9/1998 LaPointe et al.
5,857,739 A 1/1999 Smith
5,865,457 A * 2/1999 Knabusch ..... A61G 5/006 297/85 R X
5,954,392 A 9/1999 Liss et al.
5,971,475 A 10/1999 Lawson
5,975,627 A 11/1999 LaPointe et al.
6,000,754 A 12/1999 Lawson
6,179,328 B1 1/2001 Kawagoe et al.
6,309,015 B1 * 10/2001 Pine ..... A47C 3/027 297/85 L
6,330,995 B1 12/2001 Mangeiga et al.
6,467,845 B1 10/2002 Chen
6,488,332 B1 12/2002 Markwald
6,491,342 B1 12/2002 Smith
6,827,401 B2 12/2004 Marshall et al.
6,939,076 B2 9/2005 LaPointe
7,261,367 B2 8/2007 Duncan et al.
7,275,789 B2 10/2007 LaPointe
7,357,450 B2 * 4/2008 Rogers ..... A47C 1/0355 297/83 X
7,475,944 B2 * 1/2009 Griepentrog ..... A47C 17/175 297/84 X
7,637,571 B2 12/2009 Okano et al.
7,673,933 B2 * 3/2010 Lawson ..... A47C 1/0345 297/85
7,731,276 B2 * 6/2010 Hoffman ..... A47C 1/0355 297/85 R X
7,828,380 B2 11/2010 Olarte
7,850,232 B2 12/2010 Casteel
8,132,855 B2 3/2012 Richard
8,308,228 B2 * 11/2012 Lawson ..... A47C 1/035 297/85 R X
8,573,687 B2 * 11/2013 Lawson ..... A47C 1/0355 297/84
8,590,964 B2 * 11/2013 Murphy ..... A47C 1/037 297/84
8,616,627 B2 * 12/2013 Murphy ..... A47C 1/0355 297/83 X
8,622,467 B2 * 1/2014 Murphy ..... A47C 1/037 297/83
9,314,101 B2 4/2016 Harwood et al.
9,357,847 B2 * 6/2016 Murphy ..... A47C 1/0242
9,433,295 B2 9/2016 Crum
9,635,943 B2 * 5/2017 Lawson ..... A47C 1/03294
9,655,450 B2 5/2017 Marshall et al.
9,655,451 B2 5/2017 Harwood et al.
9,808,090 B2 11/2017 Carrera
9,986,832 B2 * 6/2018 LaPointe ..... A47C 1/03205
9,986,835 B2 6/2018 LaPointe et al.
10,092,106 B2 10/2018 LaPointe et al.
2003/0057743 A1 3/2003 May
2004/0000803 A1 1/2004 Guillot et al.
2005/0067867 A1 3/2005 May
2006/0061147 A1 3/2006 Johnson
2006/0103202 A1 5/2006 Maki et al.
2006/0249992 A1 11/2006 LaPointe et al.
2006/0249993 A1 11/2006 Rogers
2007/0040419 A1 2/2007 LaPointe et al.
2007/0085395 A1 4/2007 LaPointe
2007/0241589 A1 10/2007 LaPointe
2008/0150329 A1 * 6/2008 Lawson ..... A47C 1/0355 297/84
2009/0284054 A1 11/2009 Humer et al.
2011/0175426 A1 * 7/2011 Lawson ..... A47C 1/0355 297/85 M

(56) References Cited

U.S. PATENT DOCUMENTS

| | | | | |
|---|---|---|---|---|
| 2011/0233972 | A1 | 9/2011 | Weicek | |
| 2011/0248544 | A1 | 10/2011 | Adams et al. | |
| 2011/0248547 | A1 | 10/2011 | LaPointe et al. | |
| 2011/0304193 | A1* | 12/2011 | Murphy | A47C 1/034 297/85 M |
| 2012/0193946 | A1 | 8/2012 | Robertson | |
| 2013/0062914 | A1 | 3/2013 | Marshall et al. | |
| 2013/0140855 | A1 | 6/2013 | Murphy et al. | |
| 2013/0175847 | A1* | 7/2013 | Lawson | A61G 5/14 297/85 M |
| 2014/0049079 | A1* | 2/2014 | Lawson | A47C 1/0355 297/84 |
| 2014/0049084 | A1 | 2/2014 | Lawson et al. | |
| 2014/0070585 | A1 | 3/2014 | LaPointe | |
| 2014/0103688 | A1 | 4/2014 | Wilson | |
| 2014/0312660 | A1 | 10/2014 | Natuzzi et al. | |
| 2014/0333099 | A1 | 11/2014 | Lu et al. | |
| 2015/0196123 | A1* | 7/2015 | Buehrer | A47C 1/0347 297/325 |
| 2015/0250320 | A1 | 9/2015 | Arced et al. | |
| 2015/0272329 | A1 | 10/2015 | Lawson | |
| 2015/0282619 | A1* | 10/2015 | Lawson | A47C 1/0355 297/83 |
| 2016/0058195 | A1 | 3/2016 | Huang et al. | |
| 2016/0100687 | A1 | 4/2016 | Murphy | |
| 2016/0302573 | A1 | 10/2016 | Garland et al. | |
| 2016/0376007 | A1 | 12/2016 | Meindlhumer | |
| 2017/0013961 | A1 | 1/2017 | LaPointe et al. | |
| 2017/0042330 | A1 | 2/2017 | Bruce et al. | |
| 2017/0101188 | A1 | 4/2017 | Auge et al. | |
| 2017/0150818 | A1 | 6/2017 | Contreras | |
| 2017/0367483 | A1 | 12/2017 | Fecker et al. | |
| 2018/0070725 | A1 | 3/2018 | LaPointe et al. | |
| 2018/0078039 | A1 | 3/2018 | LaPointe et al. | |
| 2018/0289156 | A1 | 10/2018 | Marshall et al. | |
| 2018/0289157 | A1 | 10/2018 | Marshall et al. | |
| 2018/0289158 | A1 | 10/2018 | Marshall et al. | |
| 2019/0116981 | A1 | 4/2019 | LaPointe et al. | |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| KR | 102006003613 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015066030 | A1 | 5/2015 |

OTHER PUBLICATIONS

International Search Report for EP Application No. 18159817.8 dated Sep. 26, 2018.
International Search Report for Application No. PCT/US2006/031852, dated Jun. 17, 2008.
Written Opinion of the International Searching Authority for Application No. PCT/US2006/031852, dated Jun. 17, 2008.
International Search Report for Application No. PCT/US2014/019455, dated May 26, 2014.
Written Opinion of the International Searching Authority for Application No. PCT/US2014/019455, dated May 26, 2014.
International Search Report for Application No. PCT/US2017/043899, dated Nov. 8, 2017.
Written Opinion of the International Searching Authority for Application No. PCT/US2017/043899, dated Nov. 8, 2017.
European Search Report for Application No. 16824840.9, dated Dec. 7, 2018.
International Search Report and Written Opinion of the International Searching Authority for Application No. PCT/US2016/021361, dated May 30, 2016.
International Search Report and Written Opinion of the International Searching Authority for Application No. PCT/US2016/032967, dated Aug. 19, 2016.
International Search Report and Written Opinion of the International Searching Authority for Application No. PCT/US2017/035976, dated Aug. 25, 2017.
First Examination Report for New Zealand Application No. 738919, dated Mar. 14, 2019.
European Search Report for Application No. 19158581.9, dated May 3, 2019.
International Search Report for Application No. PCT/US2019/021568, dated Jun. 20, 2019.
Written Written Opinion of the International Searching Authority for Application No. PCT/US2019/021568, dated Jun. 20, 2019.

* cited by examiner

FURNITURE MEMBER WITH POWERED WALL-PROXIMITY MECHANISM

FIELD

The present disclosure relates to a furniture member with a powered wall-proximity mechanism.

BACKGROUND

This section provides background information related to the present disclosure and is not necessarily prior art.

Conventional reclining chairs or sofas must be positioned far enough away from a wall or any other object in a room to provide enough space behind the chair or sofa so that the wall does not restrict the ability of a seat back of the chair or sofa to move into a fully reclined position. This can result in the user having to position the chair or sofa farther away from the wall than he or she would choose to position a non-reclining chair or sofa in order to leave space for the seat back to fully recline. The present disclosure provides a furniture member that translates a frame of the furniture member forward as the seat back reclines, such that a distance between the wall and the seat back is the same or nearly the same in both an upright position and in a fully reclined position. The furniture member utilizes a motor assembly with a single motor to cause the aforementioned movement of the furniture member.

SUMMARY

This section provides a general summary of the disclosure, and is not a comprehensive disclosure of its full scope or all of its features.

An aspect of the present disclosure provides a furniture member that may include a base frame for supporting the furniture member on a support surface and a seat assembly supported by the base frame. The furniture member may also include a wall-proximity mechanism connected to the base frame and the seat assembly. The wall-proximity mechanism may be configured to translate the seat assembly forward relative to the base frame. The furniture member may also include a stability linkage connected to the wall-proximity mechanism. The stability linkage may include a leg that moves forward of the base frame and toward the support surface when the wall-proximity mechanism translates the seat assembly forward to prevent the furniture member from tipping forward.

In some configurations, the leg of the stability linkage moves toward the support surface but remains spaced apart from the support surface when the wall-proximity mechanism translates the seat frame forward.

In some configurations, the furniture member may also include a motor assembly mounted to the base frame. The motor assembly may include a draw bar that moves along a motor extrusion housing to cause the wall-proximity mechanism to translate the seat assembly forward relative to the base frame and cause the leg to move forward relative to the base frame.

In some configurations, the seat assembly includes a legrest and a seat frame. The legrest may be coupled to the base frame by a legrest mechanism that is configured to move the legrest relative to the seat frame from a retracted position to an extended position. The legrest mechanism may be coupled to the draw bar such that movement of the draw bar along the motor extrusion housing causes the legrest mechanism to move the legrest from the retracted position to the extended position.

In some configurations, the motor assembly moves the draw bar along the motor extrusion housing from an initial position to a first position and to a second position wherein the movement of the draw bar from the initial position to the first position causes the legrest mechanism to move the legrest from the retracted position to the extended position, and the movement of the draw bar from the first position to the second position causes the wall-proximity mechanism to translate the seat assembly forward relative to the base frame and causing the leg to move forward relative to the base frame.

In some configurations, the motor assembly further includes a sequencing mechanism. The sequencing mechanism may include a front rod and a spring wherein the spring is connected between the front rod and the draw bar and the front rod is connected to the seat frame. The sequencing mechanism may be configured to apply a force to the draw bar toward the front rod to cause the movement of the draw bar to result in the legrest mechanism moving the legrest from the retracted position to the extended position before movement of the draw bar results in the wall-proximity mechanism translating the seat assembly forward relative to the base frame.

An aspect of the present disclosure provides a furniture member that may include a base frame for supporting the furniture member on a support surface and a seat assembly supported by the base frame. The seat assembly may include a legrest and a seat frame. The furniture member may also include a motor assembly mounted to the base frame. The motor assembly may include a draw bar that moves along a motor extrusion housing from an initial position to a first position and to a second position. The furniture member may also include a legrest mechanism connected to the legrest and the draw bar wherein the legrest mechanism is configured to move the legrest relative to the seat frame from a retracted position to an extended position when the draw bar moves from the initial position to the second position. The furniture member may also include a wall-proximity mechanism connected to the base frame, the seat assembly and the draw bar. The wall-proximity mechanism is configured to translate the seat assembly forward relative to the base frame when the draw bar moves from the first position to the second position. The furniture member may also include a sequencing mechanism with a front rod and a spring. The spring may be connected between the front rod and the draw bar and the front rod may be connected to the seat frame, wherein the sequencing mechanism is configured to apply a force to the draw bar toward the front rod to cause movement of the draw bar to result in the legrest mechanism moving the legrest from the retracted position to the extended position before movement of the draw bar results in the wall-proximity mechanism translating the seat assembly forward relative to the base frame.

In some configurations, the motor assembly includes a single motor that moves the draw bar along the motor extrusion housing. The motor extrusion housing may have a linear shape that is rotatably connected to the base frame.

In some configurations, the draw bar translates forward relative to the base frame when the draw bar moves from the initial position to the first position. In some configurations, the draw bar translates forward relative to the base frame when the draw bar moves from the first position to the second position.

In some configurations, the draw bar is connected to and axially offset from a shoulder bolt pin by a drive plate, the shoulder bolt pin connected to the legrest mechanism and to the wall-proximity mechanism.

In some configurations, the shoulder bolt pin is rigidly connected to the seat frame and extends from the seat frame to the legrest mechanism.

In some configurations, the seat frame includes a first side and a second side that define an overall width of the furniture member and neither the draw bar nor the shoulder bolt pin spans across the seat frame from the first side to the second side.

An aspect of the present disclosure provides a furniture member that may include a base frame, a seat assembly, a motor assembly, a legrest mechanism and a wall-proximity mechanism. The seat assembly may be supported by the base frame and include a seat frame, a seat bottom, a seat back and a legrest. The legrest is movable relative to the base frame and seat frame between a retracted position and an extended position. The seat back is movable relative to the base frame and seat frame between an upright position and a reclined position. The motor assembly may be mounted to the base frame. The motor assembly includes a draw bar that moves along a motor extrusion housing from an initial position to a first position and to a second position. The legrest mechanism may be attached to the legrest and the seat frame and driven by the draw bar configured to move the legrest between the retracted and extended positions in response to movement of the draw bar from the initial position to the first position. The wall-proximity mechanism may be connected to the base frame, the seat assembly. The draw bar is configured to translate the seat frame forward relative to the base frame in response to movement of the draw bar from the first position to the second position.

In some configurations, the motor assembly includes a single motor driving the draw bar along the motor extrusion housing relative to the base frame.

In some configurations, the draw bar is connected to a shoulder bolt pin by a drive plate. The drive plate is positioned adjacent the legrest mechanism and the shoulder bolt pin is connected to the wall-proximity mechanism. In such configurations, movement of the draw bar from the initial position to the first position causes the drive plate to rotate relative to the shoulder bolt pin and movement of the draw bar from the first position to the second position causes the shoulder bolt pin to translate forward relative to base frame.

In some configurations, the wall-proximity mechanism includes a first linkage connected to the draw bar. The first linkage includes a first motion link and a second motion link. The first motion link and the second motion link are rotatably connected to a first cross-member and to the base frame. The first motion link is rotatably connected to a first control link on an end opposite to the base frame and the second motion link is rotatably connected to a second control link on an end opposite to the base frame. The first control link and the second control link are rotatably connected to a second cross-member. The first cross-member and the second cross-member are configured to move substantially parallel to one another to translate the seat frame forward relative to the base frame in response to movement of the draw bar from the first position to the second position.

In some configurations, the wall-proximity mechanism includes a second linkage connected to the draw bar. The second linkage includes a first swing link, a second swing link, a drive clamp, a first pull link, a second pull link and a pivot bracket. The first swing link is rotatably connected to the base frame at one end and to the second swing link at the opposite end. The swing link is rotatably connected to the drive clamp. The drive clamp is connected to the draw bar and to the first pull link. The pivot bracket is connected to the seat bottom and to the first pull link and to the second pull link. The second pull link is connected to the seat frame. The second linkage is configured to translate the seat bottom forward relative to the seat frame in response to movement of the draw bar from the first position to the second position.

In some configurations, the wall-proximity mechanism includes a stability linkage. The stability linkage includes a tilt link and a leg. The leg is rotatably connected to the tilt link and to the first motion link such that the leg moves outward from the first motion link when the first linkage translates the seat frame forward.

In some configurations, the motor assembly includes a rear rod, a motor and a carriage. The motor is connected to the base frame by the rear rod. The carriage is movably connected to the motor extrusion housing and is operably connected to the motor, wherein the motor is operable to cause the carriage to translate along the motor extrusion housing from the initial position to the first position and to the second position.

In some configurations, the motor assembly includes a sequencing mechanism. The sequencing mechanism includes a front rod and a spring. The spring is connected between the front rod and the draw bar. The front rod is connected to the seat frame, wherein the sequencing mechanism is configured to apply a force to the draw bar toward the front rod to assist the motor assembly to cause the legrest mechanism to move the legrest from the retracted position to the extended position.

In some configurations, the base frame is positioned on a support surface and the leg of the stability linkage moves toward the support surface but remains spaced apart from the support surface when the first linkage translates the seat frame forward.

In some configurations, the draw bar translates forward relative to the base frame when the draw bar moves from the initial position to the first position. In some configurations, the draw bar translates forward relative to the base frame when the draw bar moves from the first position to the second position.

In some configurations, the draw bar is connected to and axially offset from a shoulder bolt pin by a drive plate. The shoulder bolt pin is connected to the legrest mechanism and to the wall-proximity mechanism.

In some configurations, the shoulder bolt pin is rigidly connected to the seat frame and extends from the seat frame to the legrest mechanism.

In some configurations, the seat frame includes a first side and a second side that define an overall width of the furniture member. Neither the draw bar nor the shoulder bolt pin spans across the seat frame from the first side to the second side.

In another aspect of the present disclosure, a furniture member includes a base frame, a seat assembly, a motor assembly, a pair of legrest mechanisms and a pair of wall-proximity mechanisms. The seat assembly is supported by the base frame and includes a seat frame, a seat bottom, a seat back and a legrest. The motor assembly is mounted to the base frame and includes a motor, a motor extrusion housing and a draw bar. The motor is operably connected to the draw bar to move the draw bar along the motor extrusion housing. The pair of legrest mechanisms is mounted laterally outboard of and connected to ends of the draw bar. The legrest mechanisms may each includes a pantograph linkage configured to move the legrest from a retracted position to an extended position in response to forward movement of the draw bar. The pair of wall-proximity mechanisms are mounted laterally outboard of the pair of legrest mechanisms. The pair of wall-proximity mechanisms are connected to the draw bar and each include a first linkage connected to the base frame and the seat frame and a second linkage connected to the first linkage and the seat bottom. The first linkage is configured to move the seat frame forward in response to forward movement of the draw bar and the second linkage is configured to move the seat bottom forward in response to forward movement of the draw bar.

In some configurations, the pair of wall-proximity mechanisms each include a stability mechanism. The stability mechanism is connected to the first linkage and includes a retractable leg that extends outward to a deployed position in front of the base frame when the first linkage moves the seat frame forward.

In some configurations, the first linkage includes a first motion link and a second motion link. The first motion link and the second motion link are rotatably connected to a first cross-member and to the base frame. The first motion link is rotatably connected to a first control link on an end opposite to the base frame and the second motion link is rotatably connected to a second control link on an end opposite to the base frame. The first control link and the second control link are rotatably connected to a second cross-member. The first cross-member and the second cross-member are configured to move substantially parallel to one another to move the seat frame forward relative to the base frame in response to movement of the draw bar.

In some configurations, the second linkage includes a first swing link, a second swing link, a drive clamp, a first pull link, a second pull link and a pivot bracket. The first swing link is rotatably connected to the base frame at one end and to the second swing link at the opposite end. The swing link is rotatably connected to the drive clamp. The drive clamp is connected to the draw bar and to the first pull link. The pivot bracket is connected to the seat bottom and to the first pull link and to the second pull link. The second pull link is connected to the seat frame. The second linkage is configured to move the seat bottom forward relative to the seat frame in response to movement of the draw bar.

An aspect of the present disclosure provides a furniture member that may include a base frame and a seat assembly supported by the base frame. The seat assembly may include a seat frame, a seat bottom, a seatback and a legrest. The legrest is movable relative to the base frame and seat frame between a retracted position and an extended position. The seatback is movable relative to the base frame and seat frame between an upright position and a reclined position. The furniture member may also include a first motor assembly mounted to the seat assembly. The first motor assembly may include a draw bar that moves from a first position to a second position. The furniture member may also include a second motor assembly mounted to the seat assembly. The second motor assembly may include a front bar that moves from a third position to a fourth position. The front bar may be connected to the seat bottom. The furniture member also includes a legrest mechanism attached to the legrest and the seat frame and driven by the draw bar. The legrest mechanism may be configured to move the legrest between the retracted and extended positions in response to movement of the draw bar from the first position to the second position. The furniture member also may include a wall-proximity mechanism connected to the base frame and the seat bottom. The wall-proximity mechanism may be configured to translate the seat frame forward relative to the base frame in response to movement of the front bar from the third position to the fourth position.

In some configurations, the first motor assembly can move from the first position to the second position when the second motor assembly is in either the third position or the fourth position. In some configurations, the second motor assembly can move from the third position to the fourth position when the first motor assembly is in either the first position or the second position.

In some configurations, the draw bar is connected to the wall-proximity mechanism by a draw axis that extends laterally between the legrest mechanism and the wall-proximity mechanism.

In some configurations, the draw bar is connected to a shoulder bolt pin by a drive plate. The drive plate can be positioned adjacent the legrest mechanism and the shoulder bolt pin can be connected to the wall-proximity mechanism wherein movement of the draw bar from the first position to the second position causes the drive plate to rotate relative to the shoulder bolt pin and movement of the front bar from the third position to the fourth position causes the shoulder bolt pin to translate forward relative to base frame.

In some configurations, the wall-proximity mechanism may include a first linkage connected to the draw bar. The first linkage may include a first motion link and a second motion link. The first motion link and the second motion link may be rotatably connected to a first cross-member and to the base frame. The first motion link may be rotatably connected to a first control link on an end opposite to the base frame and the second motion link may be rotatably connected to a second control link on an end opposite to the base frame. The first control link and the second control link may be rotatably connected to a second cross-member. The first cross-member and the second cross-member may be configured to move substantially parallel to one another to translate the seat frame forward relative to the base frame in response to movement of the front bar from the third position to the fourth position.

In some configurations, the wall-proximity mechanism may include a second linkage connected to the seat bottom. The second linkage may include a first swing link, a second swing link, a drive clamp, a first pull link, a second pull link and a pivot bracket. The first swing link may be rotatably connected to the base frame at one end and to the second swing link at the opposite end. The swing link may be rotatably connected to the drive clamp. The drive clamp may be connected to the draw bar and to the first pull link. The pivot bracket may be connected to the seat bottom and to the first pull link and to the second pull link. The second pull link may be connected to the seat frame wherein the second linkage may be configured to translate the seat bottom forward relative to the seat frame in response to movement of the front bar from the third position to the fourth position.

In some configurations, the first motor assembly and the second motor assembly may be connected to the seat base by a rear bar that spans between opposite side of the seat base under the seat bottom.

In some configurations, the first motor assembly and the second motor assembly may translate forward with the seat base when the second motor assembly moves from the third position to the fourth position.

In some configurations, the draw bar translates forward relative to the base frame when the draw bar moves between the first and second positions. In some configurations, the front bar translates forward relative to the base frame when the front bar moves between the third and fourth positions. In some configurations, the front bar does not rotate relative to the seat assembly.

In some configurations, the draw bar is connected to and axially offset from a shoulder bolt pin by a drive plate. The shoulder bolt pin may be connected to the legrest mechanism and to the wall-proximity mechanism.

In some configurations, the shoulder bolt pin is cylindrical and extends from the seat frame to the legrest mechanism.

Another aspect of the present disclosure provides a furniture member that may include a base frame and a seat assembly supported by the base frame. The seat assembly may include a seat frame, a seat bottom, a seatback and a legrest. The furniture member may also include a first motor assembly mounted to the seat assembly. The first motor assembly may include a linear actuator with a first motion rod. The first motion rod may be connected to a draw bar. The furniture member may also include a pair of legrest mechanisms mounted laterally outboard of and connected to ends of the draw bar. The pair of legrest mechanisms may each include a pantograph linkage configured to move the legrest from a retracted position to an extended position in response to forward movement of the draw bar. The furniture member may also include a second motor assembly mounted to the seat assembly. The second motor assembly may include a linear actuator with a second motion rod wherein the second motion rod is connected to the seat bottom by a front bar. The furniture member may also include a pair of wall-proximity mechanisms mounted laterally outboard of the pair of legrest mechanisms. The pair of wall-proximity mechanisms may include a first linkage and a second linkage. The first linkage may be connected to the base frame and the second linkage. The second linkage may be connected to the seat bottom. The pair of wall-proximity mechanisms configured to move the seat frame forward in response to forward movement of the front bar.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 28:
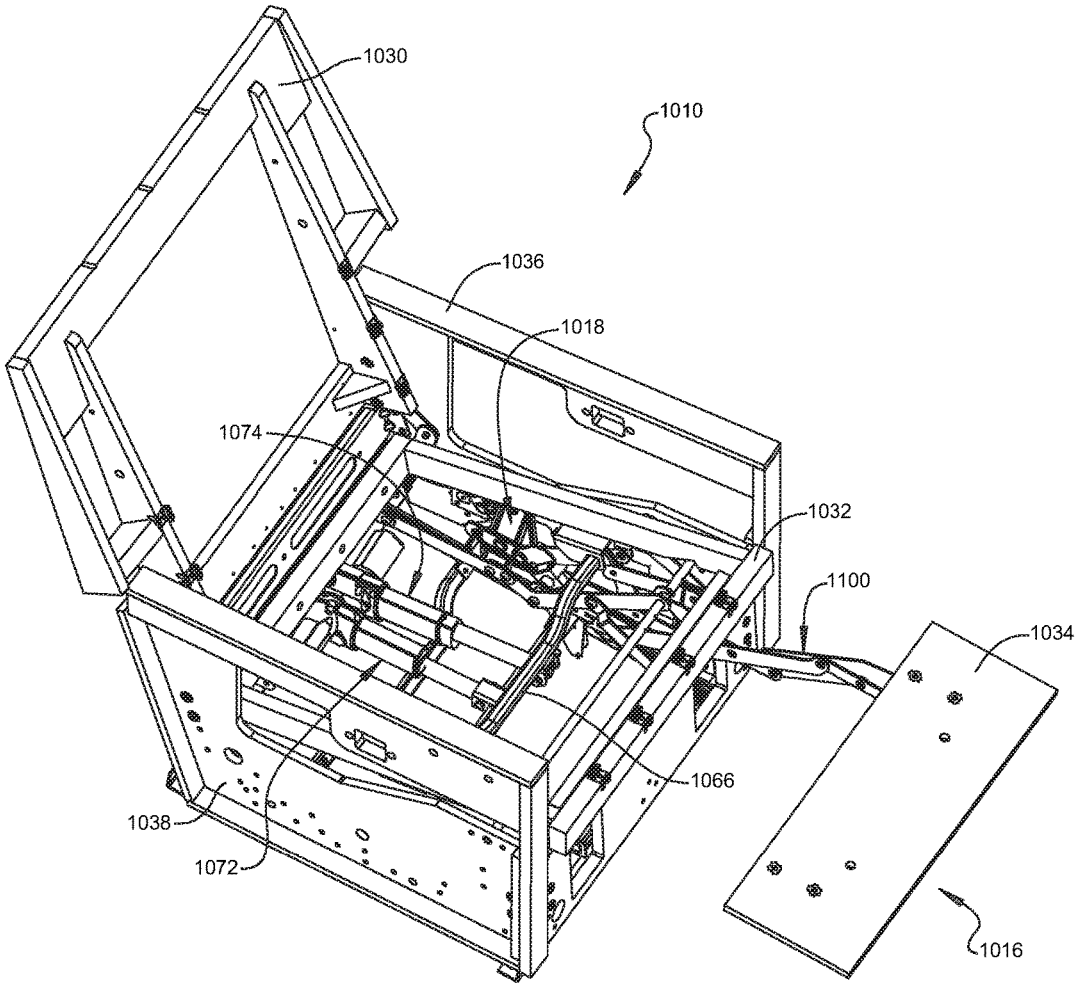
FIG. 28 is a top perspective view of the furniture member in the position of FIG. 26.
Figure 29:
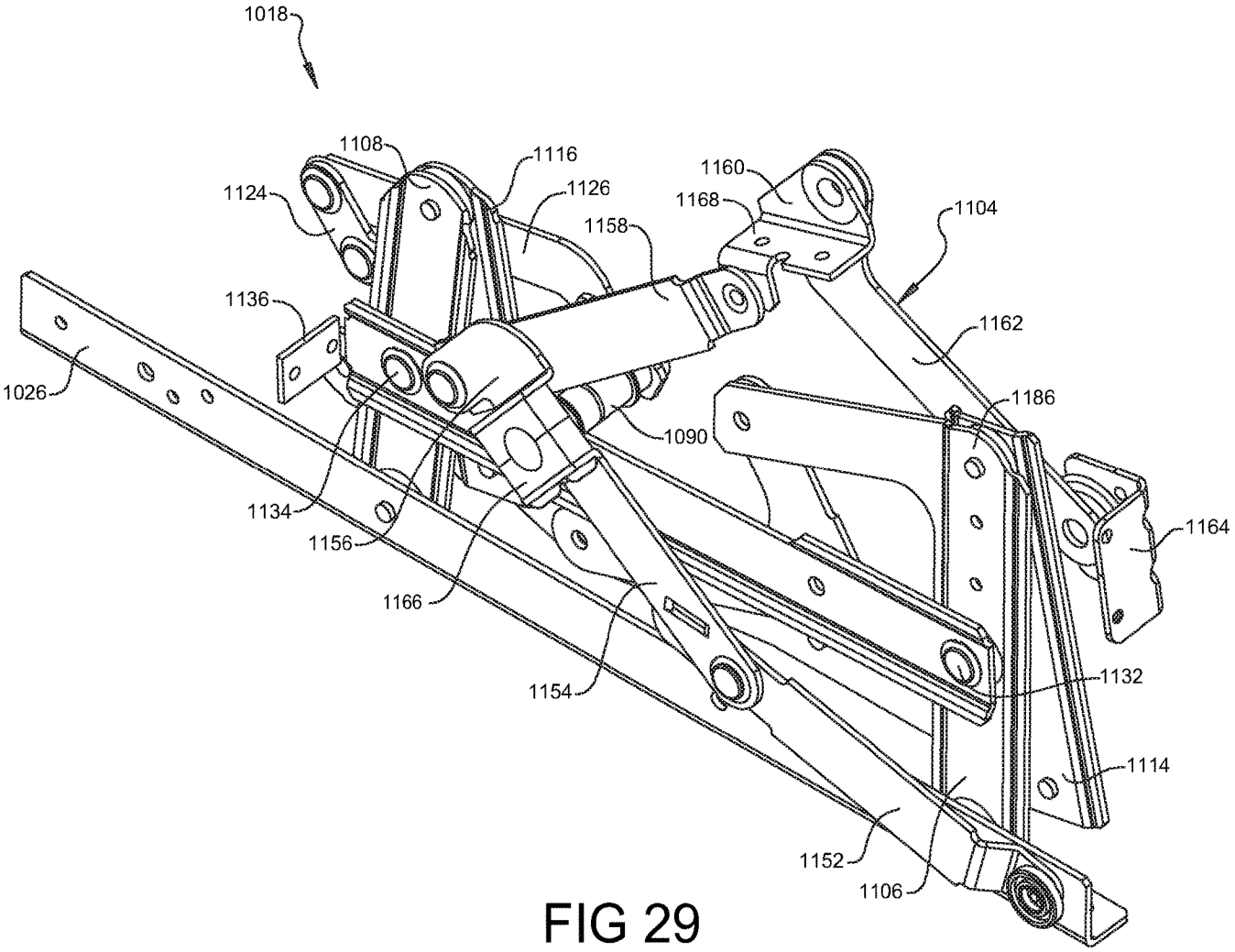
FIG. 29 is a perspective view of the wall-proximity mechanism of the furniture member when the furniture member is in the position of FIG. 26.
Figure 30:
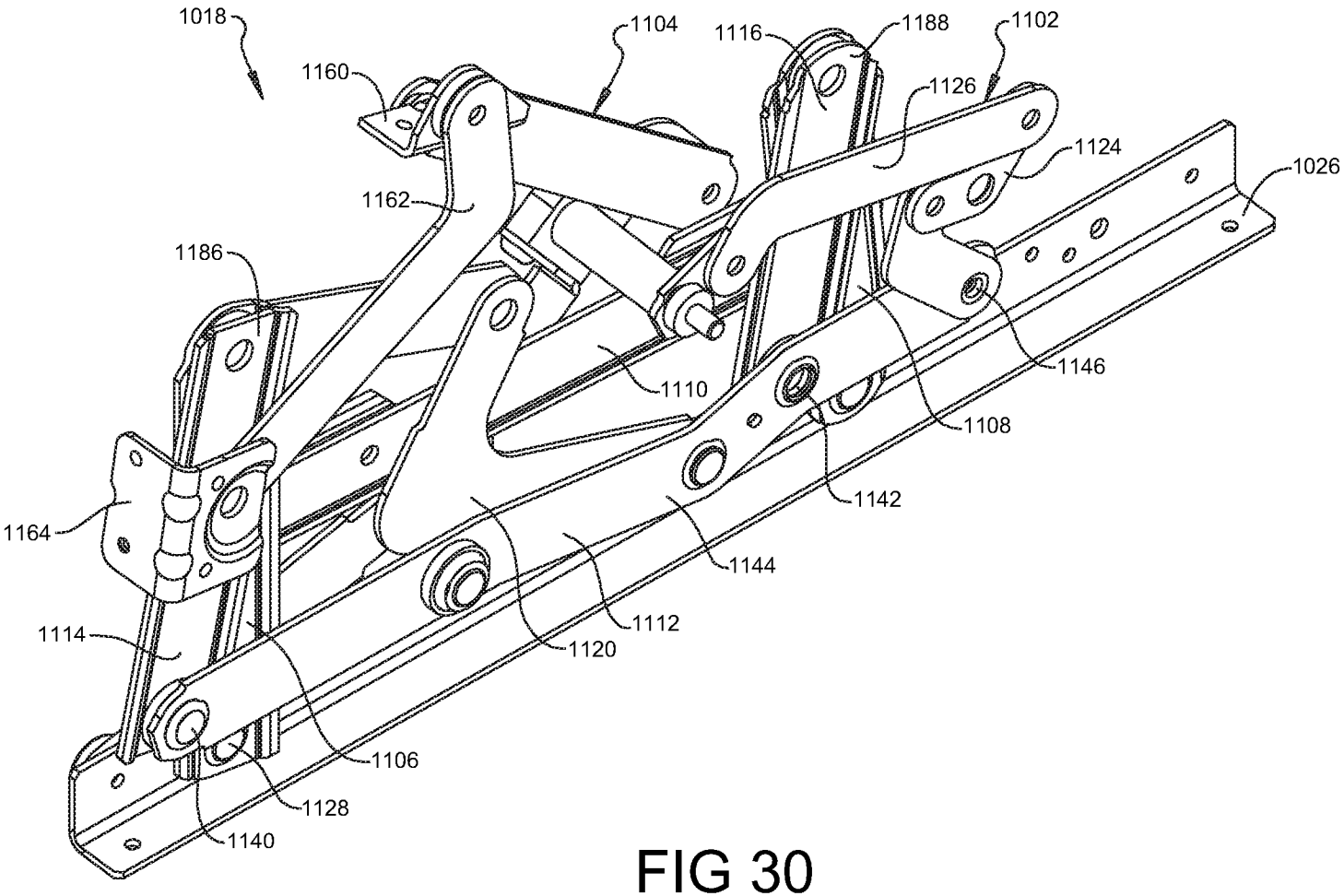
FIG. 30 is a perspective view of an opposite side of the wall-proximity mechanism of the furniture member when the furniture member is in the position of FIG. 26.
Figure 31:
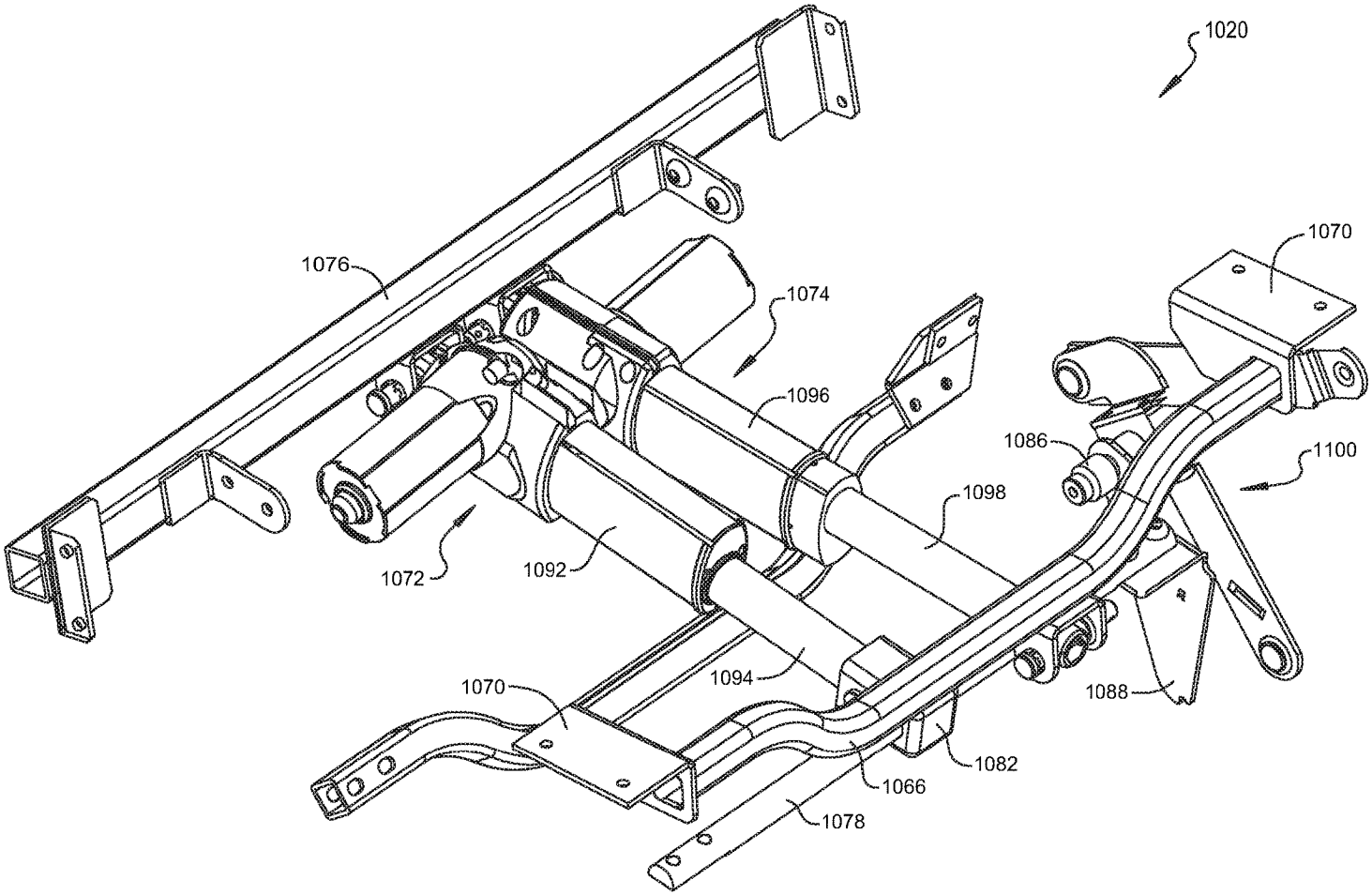
Figure 32:
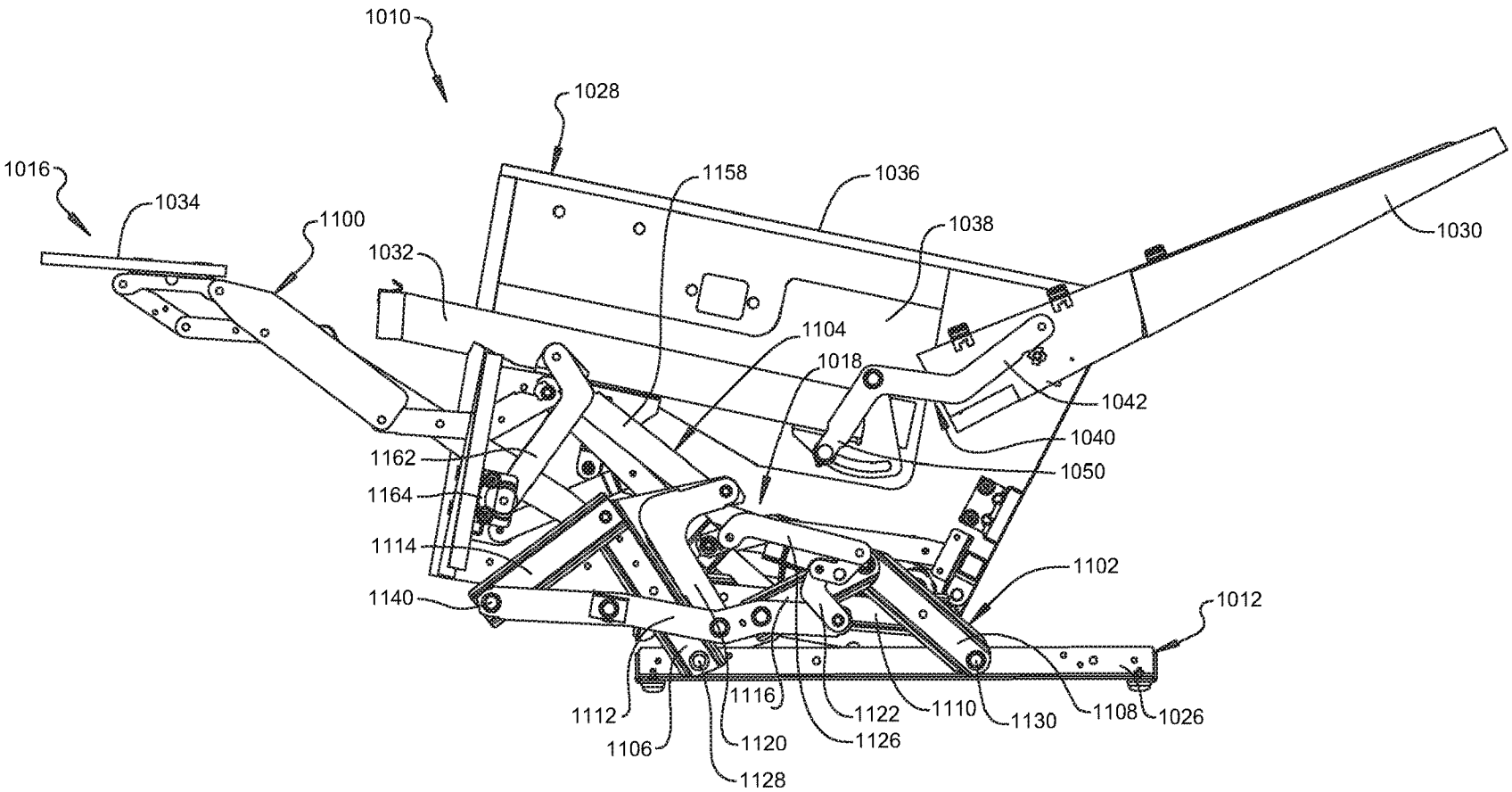
Figure 33:
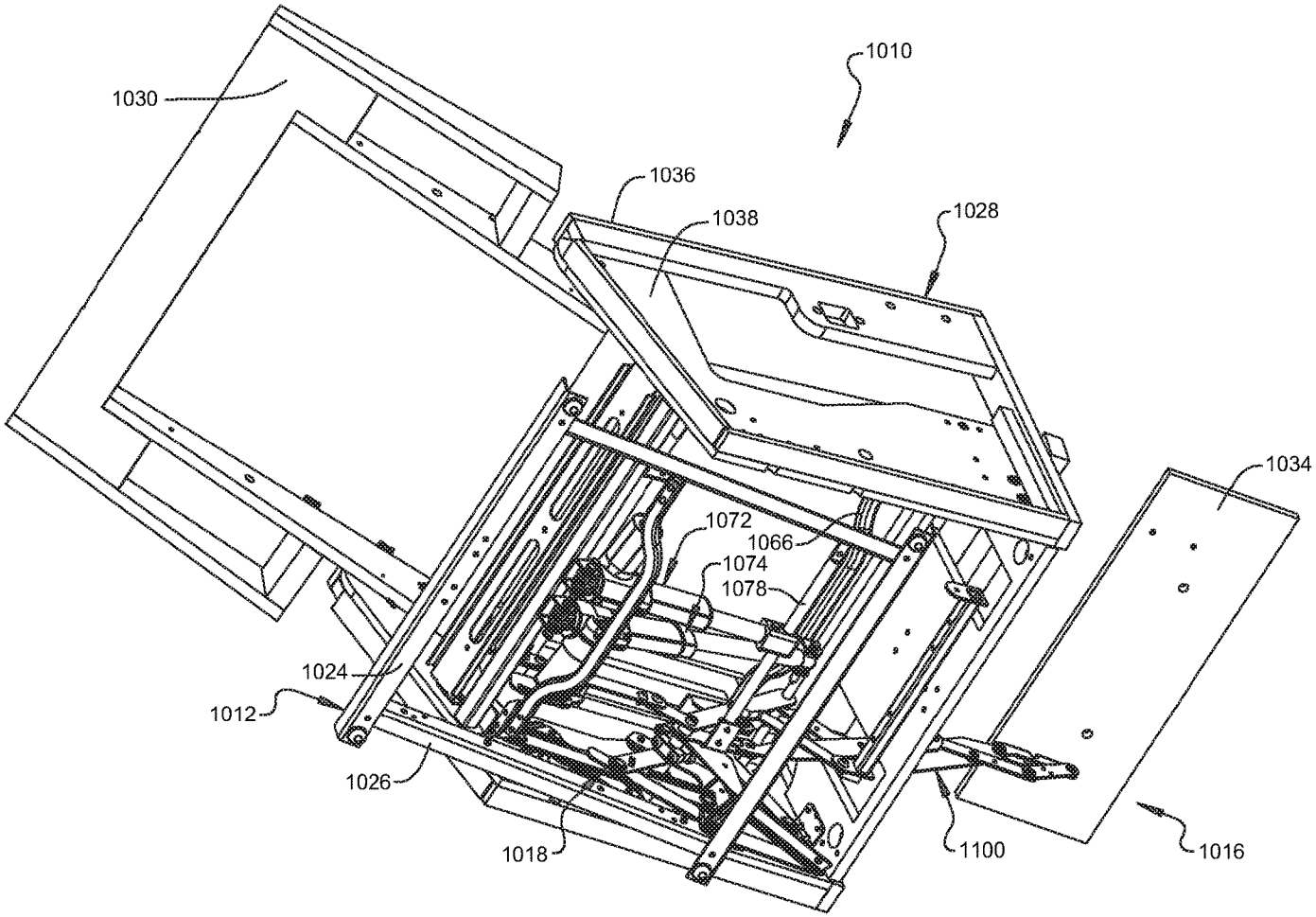
Figure 34:
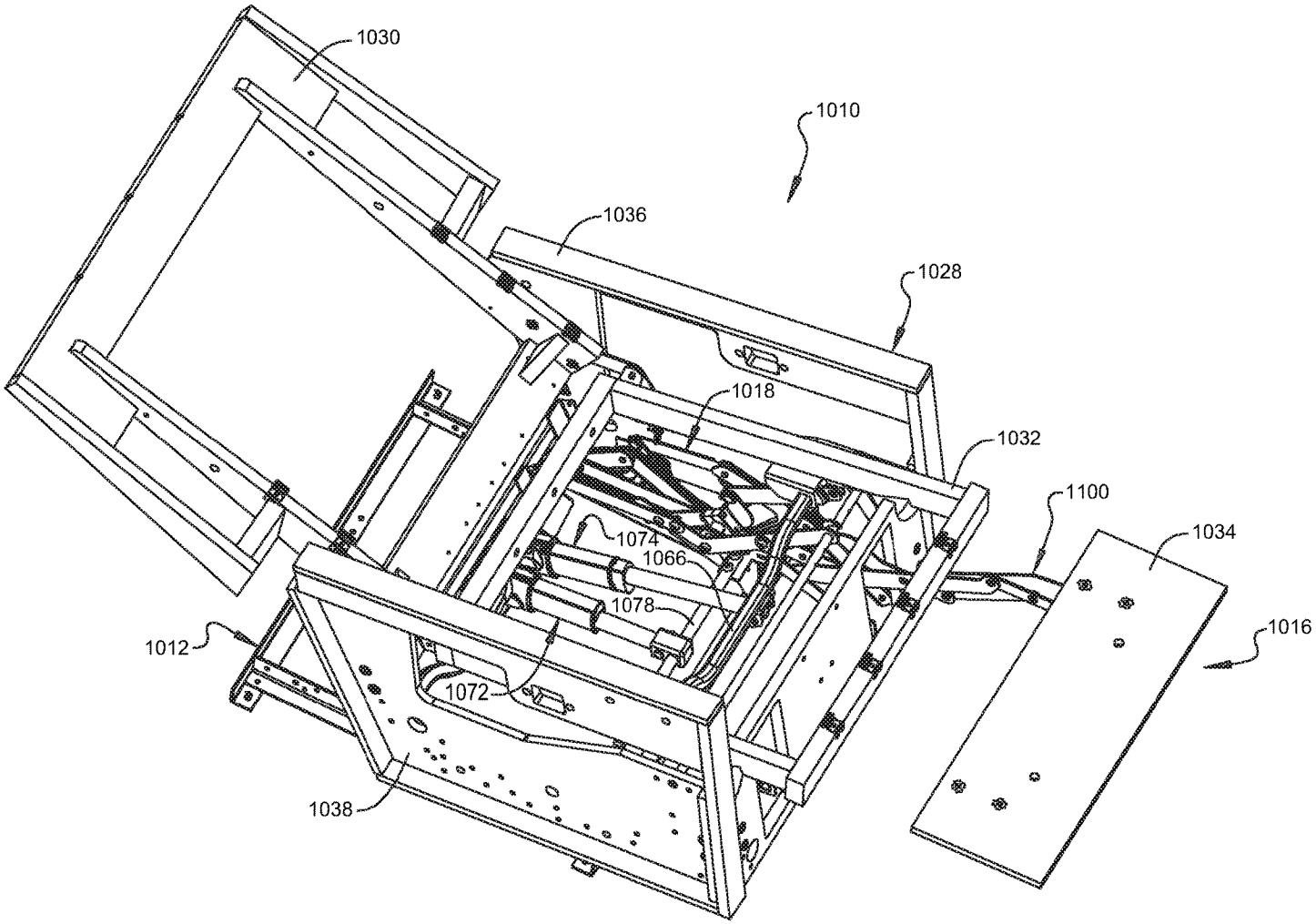
Figure 35:
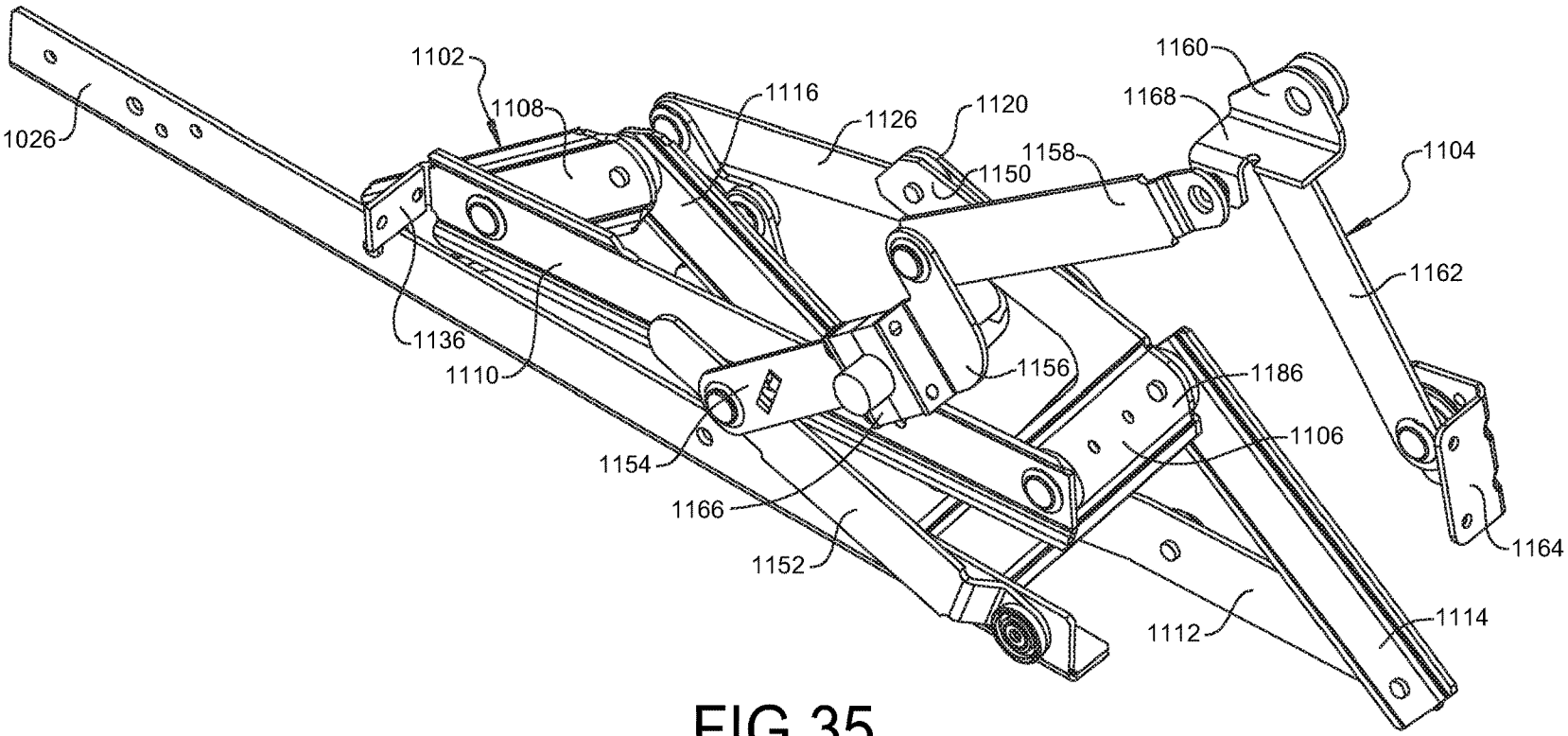
Figure 36:
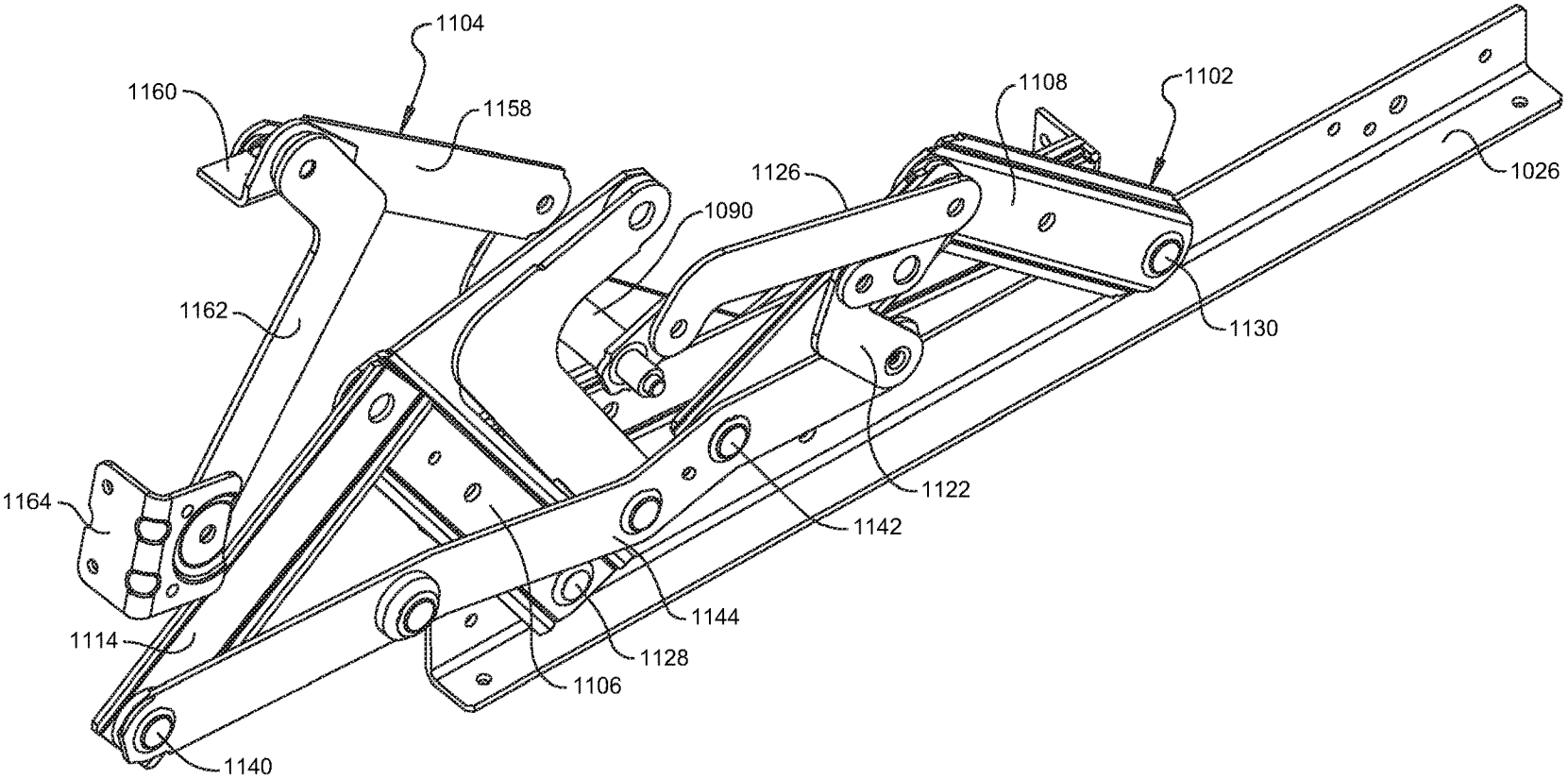
Figure 37:
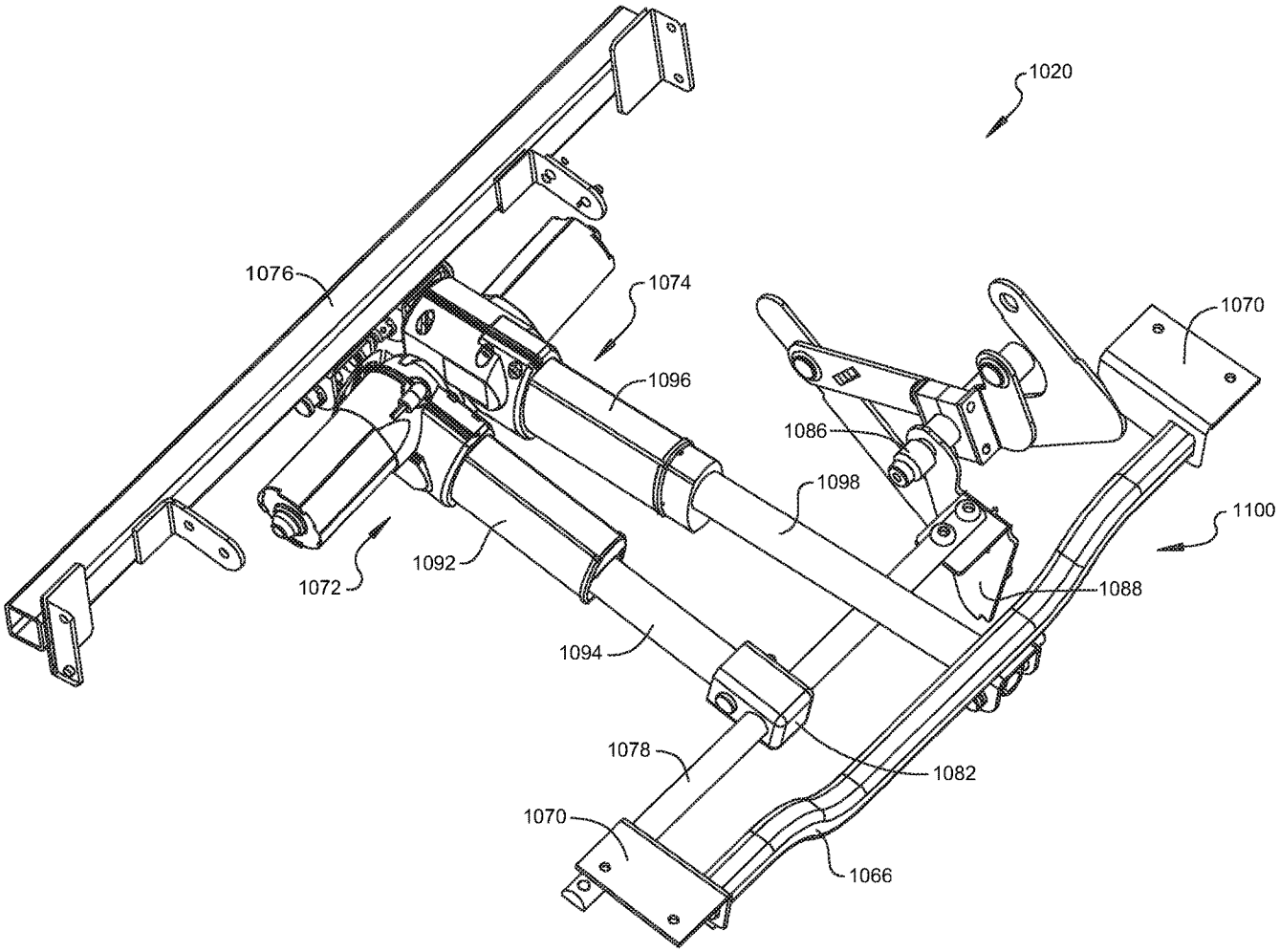
Figure 38:
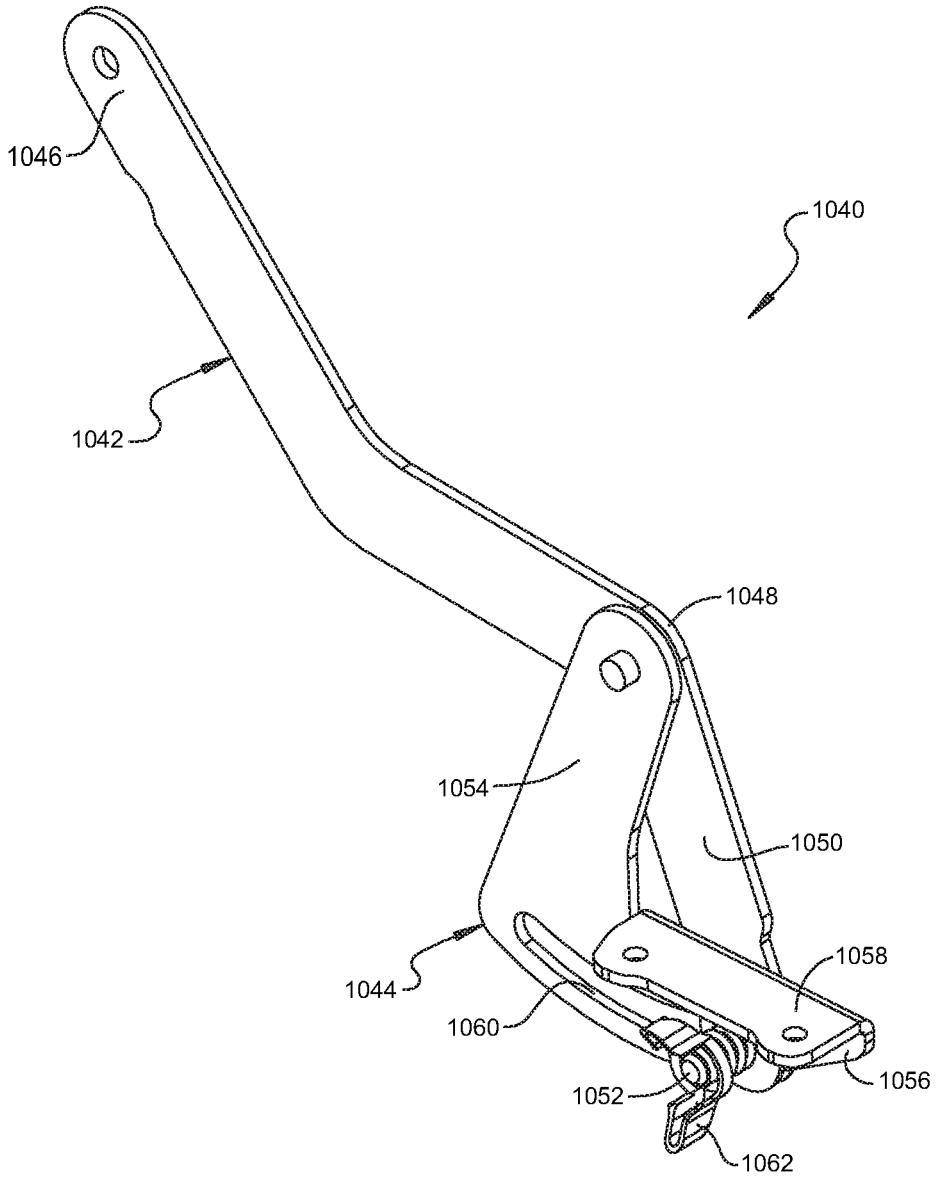

FIG. 31 a perspective view of the motor assemblies of the furniture member in the position of FIG. 28;

FIG. 32 is a side view of the furniture member with the seatback in a reclined position and the legrest in an extended position;

FIG. 33 is a bottom view of the furniture member in the position of FIG. 32;

FIG. 34 is a top perspective view of the furniture member in the position of FIG. 32;

FIG. 35 is a perspective view of the wall-proximity mechanism of the furniture member when the furniture member is in the position of FIG. 32;

FIG. 36 is a perspective view of an opposite side of the wall-proximity mechanism of the furniture member when the furniture member is in the position of FIG. 32;

FIG. 37 is a perspective view of the motor assemblies of the furniture member in the position of FIG. 32; and FIG. 38 is a perspective view of a friction-slide mechanism of the furniture member when the seatback is in the reclined position.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-18, a furniture member 10 is provided that may include a base frame 12, a seat assembly 14, a legrest mechanism 16, a wall-proximity mechanism 18, and a drive mechanism 20. As will be described in more detail below, the legrest mechanism 16 may move a legrest platform 34 between a between a fully retracted position (FIGS. 1-7) and a fully extended position (FIGS. 8-12) in response to movement of a motor assembly 72 of the drive mechanism 20. Further, the wall-proximity mechanism 18 may tilt the seat assembly 14 rearward relative to the base frame 12 and translate the seat assembly 14 forward relative to the base frame 12 as well as move a seat back 30 of the seat assembly 14 between a fully upright position and a fully reclined position (FIGS. 13-18) in response to further movement of the motor assembly 72 of the drive mechanism 20.

In connection with the translation of the seat assembly 14 by the wall-proximity mechanism 18 and as will be further described below, a stability linkage 170 can extend forward of the base frame 12. The stability linkage 170 can provide additional support to the furniture member 10 when the seat assembly moves forward relative to the base frame 12 to prevent the furniture member 10 from undesirable tipping or rocking. The furniture member 10 may be susceptible to undesirable tipping or rocking when the wall-proximity mechanism 18 has translated forward relative to the base frame 12 due to a shift in the center of gravity of the furniture member 10.

Figure 1:
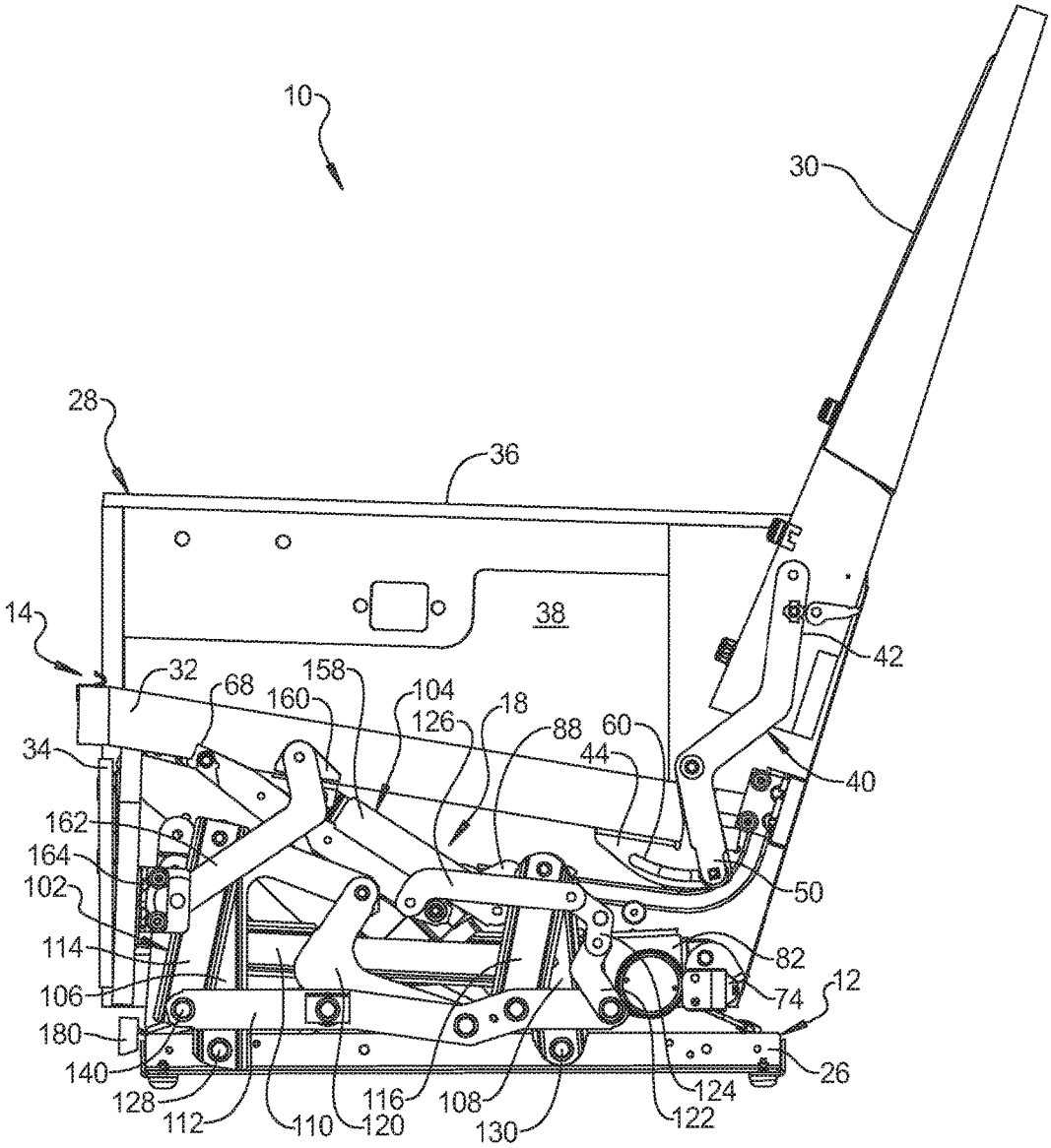
FIG. 1 is a side view of a furniture member with a seat back in an upright position and a legrest in a retracted position.
Figure 2:
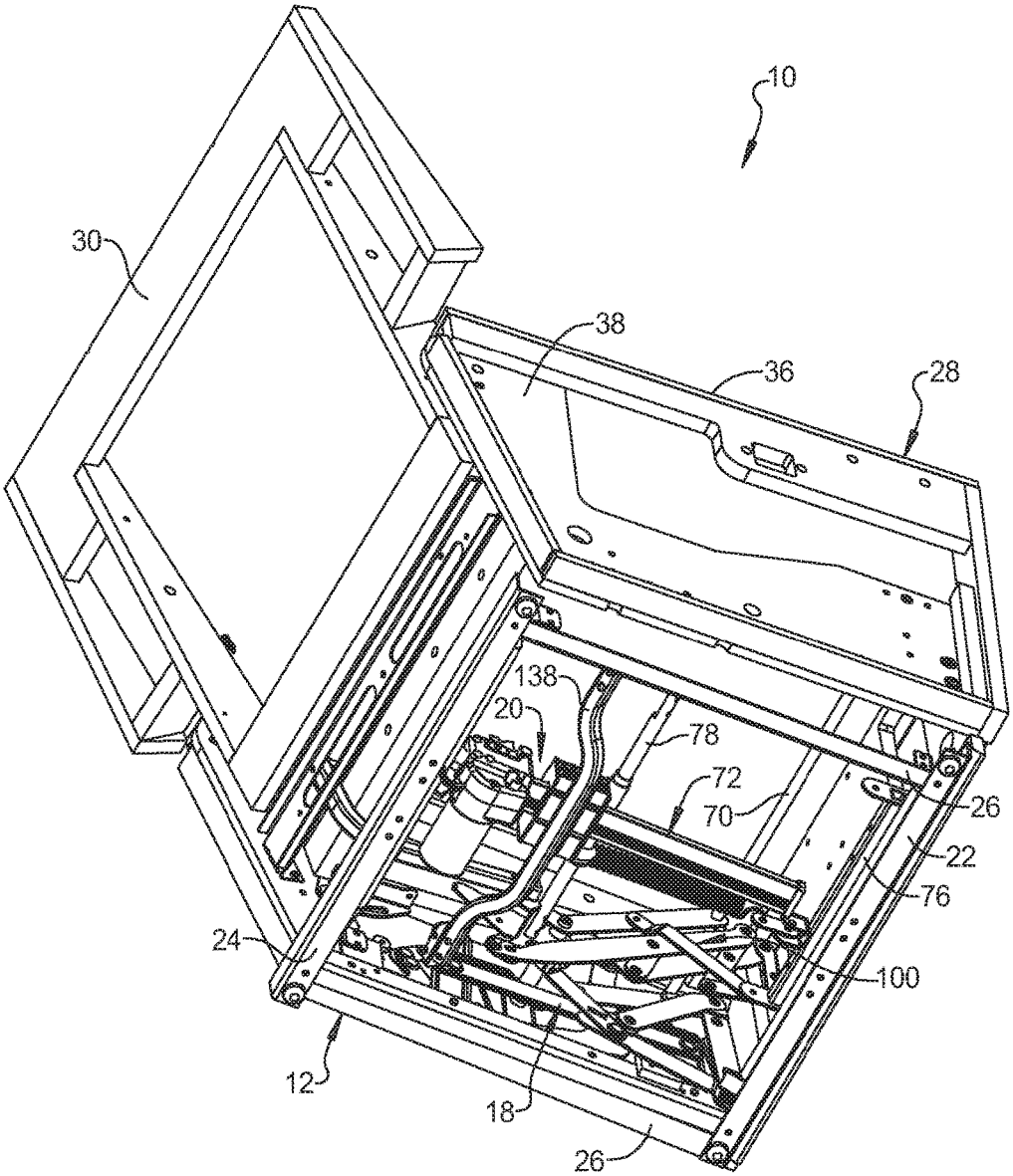
FIG. 2 is a bottom perspective view of the furniture member in the position of FIG. 1.

As shown in FIGS. 1 and 2, the base frame 12 may include a plurality of stationary beams including, for example, a front support member 22, a rear support member 24, and a pair of side support members 26. The side support members 26 are spaced apart from each other and are attached to and extend between the front and rear support members 22, 24.

As shown in FIGS. 1, 3, 8 and 13, the seat assembly 14 may include a seat frame 28, the seat back 30, a seat bottom 32, and a legrest platform 34. The seat frame 28 may include a plurality of armrests 36 and a seat base 38 that supports the seat back 30, the seat bottom 32 and the legrest mechanism 16. The seat back 30 is rotatably coupled to the seat base 38 to allow the seat back 30 to rotate between the fully upright and fully reclined positions.

Figure 7:
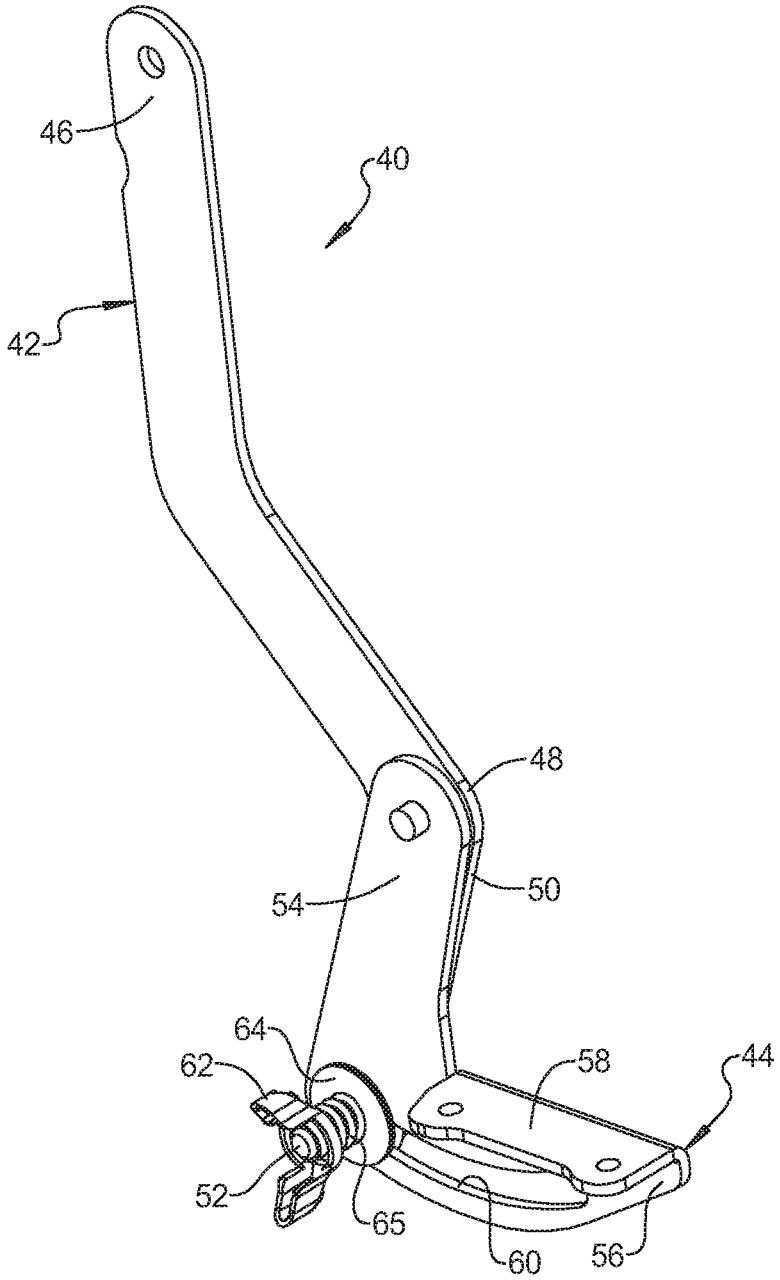
FIG. 7 is a perspective view of a friction-slide mechanism of the furniture member when the seat back is in the upright position.
Figure 18:
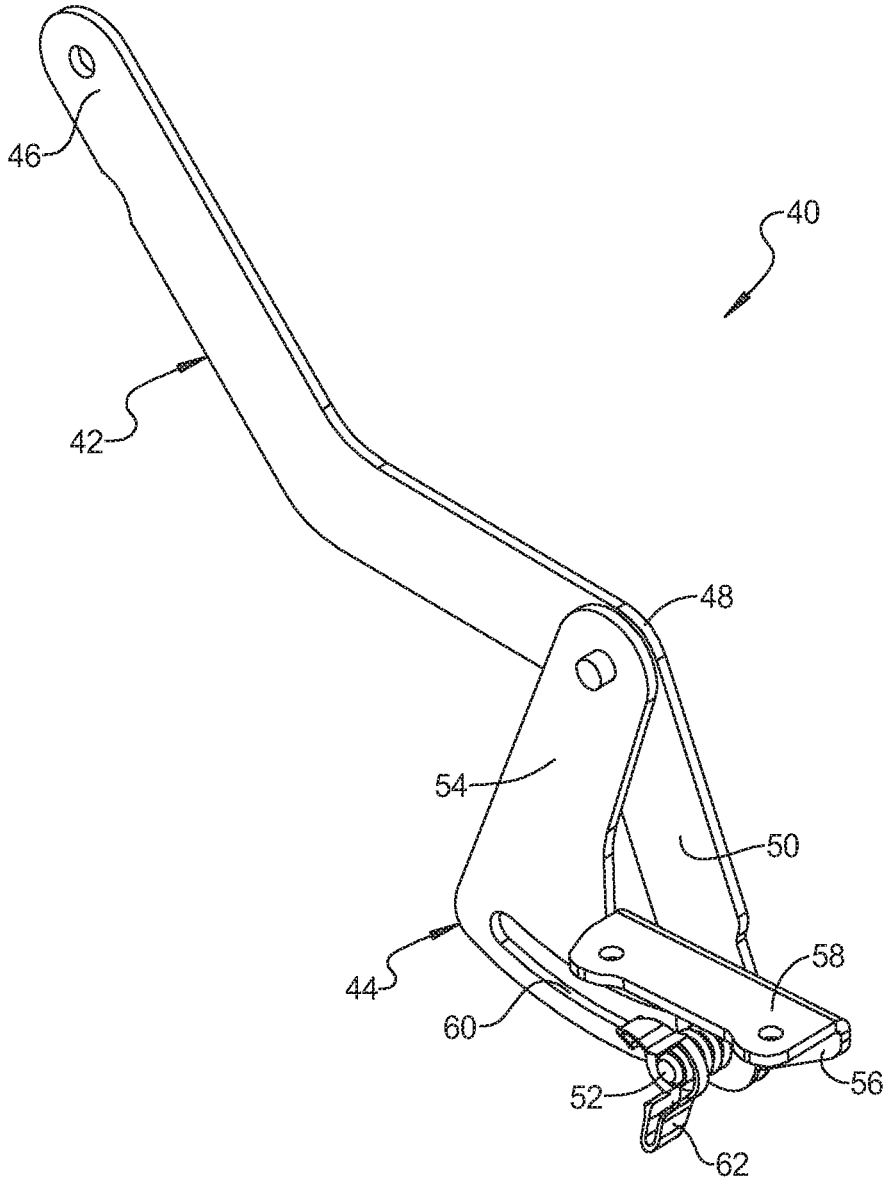
FIG. 18 is a perspective view of a friction-slide mechanism of the furniture member when the seat back is in the reclined position.

The seat back 30 is rotatably coupled to the seat bottom 32 by a pair of friction-slide mechanisms 40 (only one of which is shown in the FIGS.). As shown in FIGS. 1, 7 and 18, each friction-slide mechanism 40 may include a lever 42 and a slide member 44. A first end 46 of the lever 42 may be fixedly attached to the seat back 30. An intermediate portion 48 of the lever 42 may be rotatably engaged with the slide member 44. A second end 50 of the lever 42 may include a protrusion 52 (e.g., pin, threaded fastener or rivet) that is slidably engaged with the slide member 44.

As shown in FIG. 7, the slide member 44 may have first and second arms 54, 56 that cooperate to form a generally L-shaped member. The first arm 54 may be rotatably coupled with the intermediate portion 48 of the lever 42. The second arm 56 may include a flange 58 that may be fixedly attached to the seat bottom 32. The second arm 56 may include a curved slot 60 that slidably receives the protrusion 52 of the lever 42. As shown in FIG. 7, a nut 62 and washer 64 may engage the protrusion 52. Threadably tightening the nut 62 against the washer 64 may clamp the slide member 44 between the lever 42 and the nut 62. The tightness of nut 62 can be adjusted to adjust a frictional force between the lever 42 and the slide member 44. While the nut 62 shown in FIG. 7 is a wing nut, it can be appreciated that any type of nut could be used to adjust the frictional force between the lever 42 and the slide member 44. In some embodiments, a compression spring 65 may be disposed on the protrusion 52 between the nut 62 and the slide member 44 (or between the nut 62 and the washer 64). In such configurations, the tightness of the nut 62 could be adjusted to adjust the force of the spring urging the slide member 44 against the lever 42, thereby adjusting the frictional force between the lever 42 and the slide member 44. The frictional force can be adjusted according to the occupant's weight and size.

Figure 3:
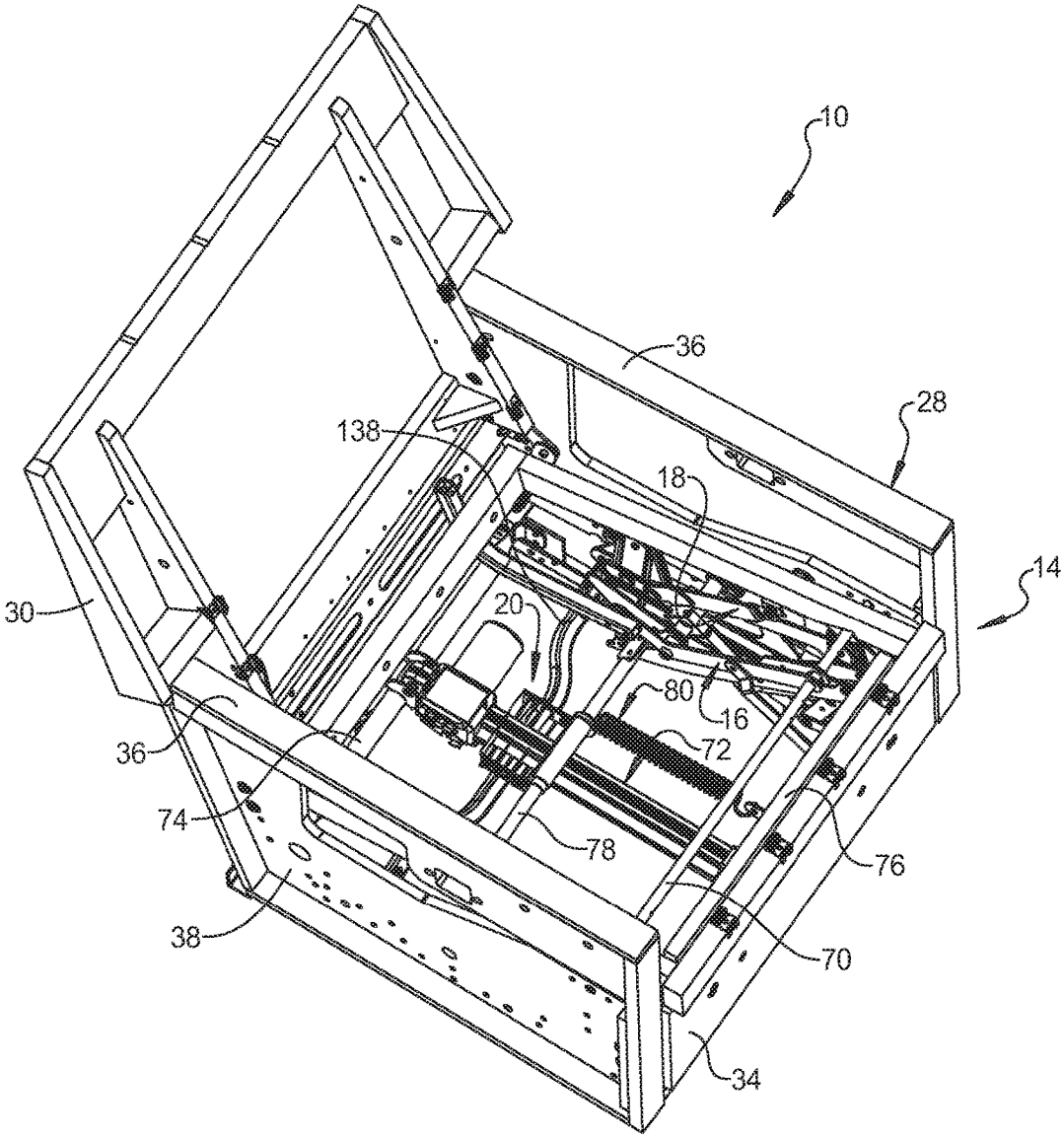
FIG. 3 is a top perspective view of the furniture member in the position of FIG. 1.

As shown in FIGS. 1-3, the seat bottom 32, in this example, may include a notch 68 positioned forward of a pivot bracket 160. The notch 68 is a cut-out in the seat bottom 32 that provides clearance for a rod 70 that spans beneath the seat bottom 32.

Figure 4:
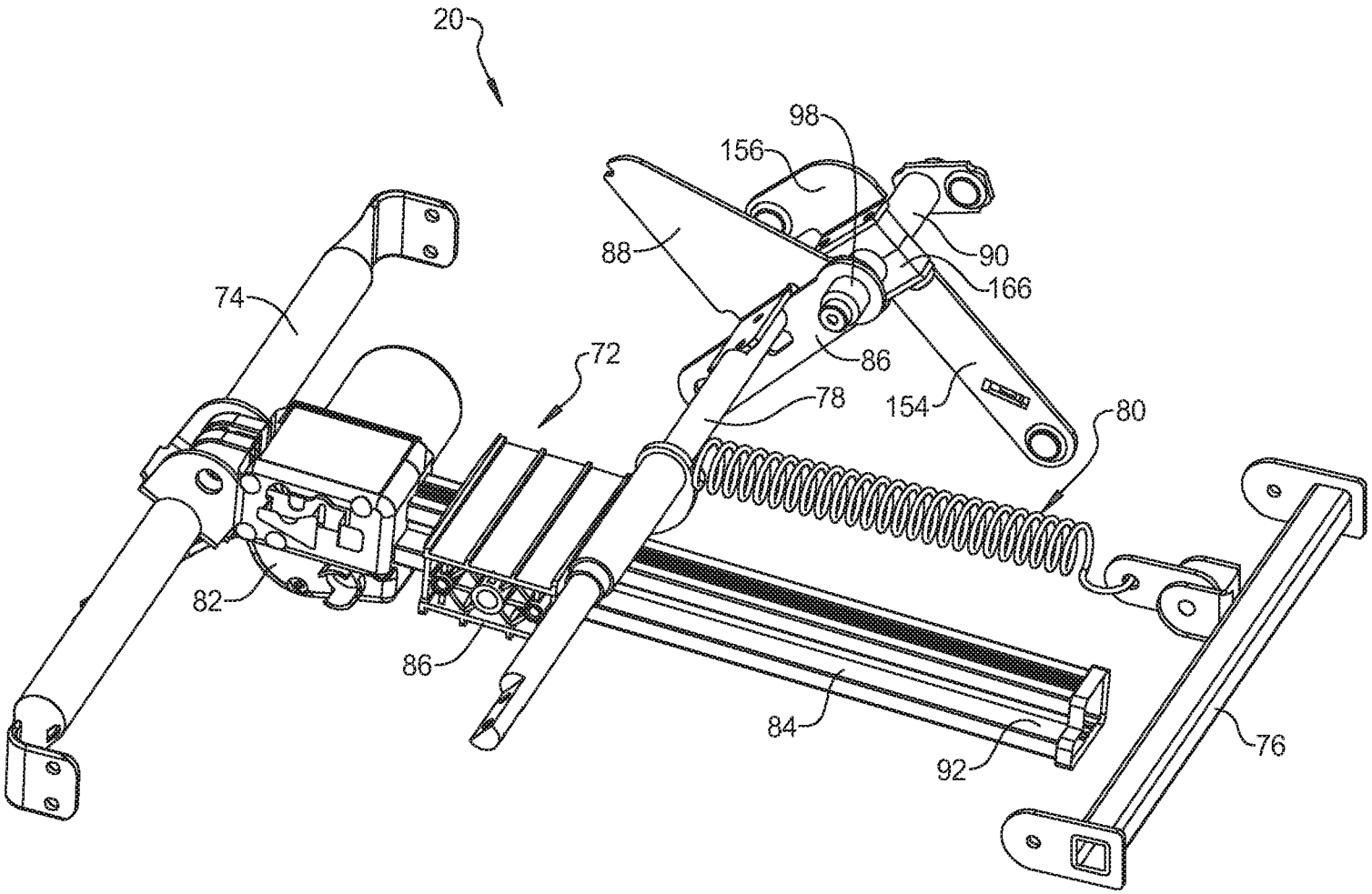
FIG. 4 is a perspective view of the drive mechanism of the furniture member in the position of FIG. 1.

Referring now to FIGS. 2-4, the drive mechanism 20, in this example, includes a motor assembly 72, a rear rod 74, a front rod 76, a draw bar 78 and a sequencing mechanism 80. The motor assembly 72 is supported by the rear rod 74 and by the draw bar 78. The rear rod 74 spans across the base frame 12 and is connected to the opposing side support members 26. The motor assembly 72 is rotatably connected to the draw bar 78 and the rear rod 74. The motor assembly 72, as shown, may include a motor 82, a motor extrusion housing 84 and a carriage 86. The motor 82 is coupled to the carriage 86 and can cause the carriage 86 to move along the motor extrusion housing 84 to induce the relative movement of the mechanisms of the furniture member 10 as will be described. In this example, the motor assembly 72 can include a lead screw and a lead screw nut that are positioned inside the motor extrusion housing 84. The carriage 86 can be coupled to the lead screw so that the carriage 86 slides along the motor extrusion housing 84 in response to the lead screw rotating inside the motor extrusion housing 84.

While the carriage 86 can be moved into any position along the motor extrusion housing 84, the motor 82 is controlled or otherwise configured to position the carriage 86 in, at least, three positions along the motor extrusion housing 84. In an initial position as shown in FIGS. 2-4, the carriage 86 is positioned on the motor extrusion housing 84 at or near the motor 82. When the carriage 86 of the motor assembly 72 is in the initial position, the legrest platform 34 is in the retracted position and the seat frame 28 is in the upright position.

Figure 9:
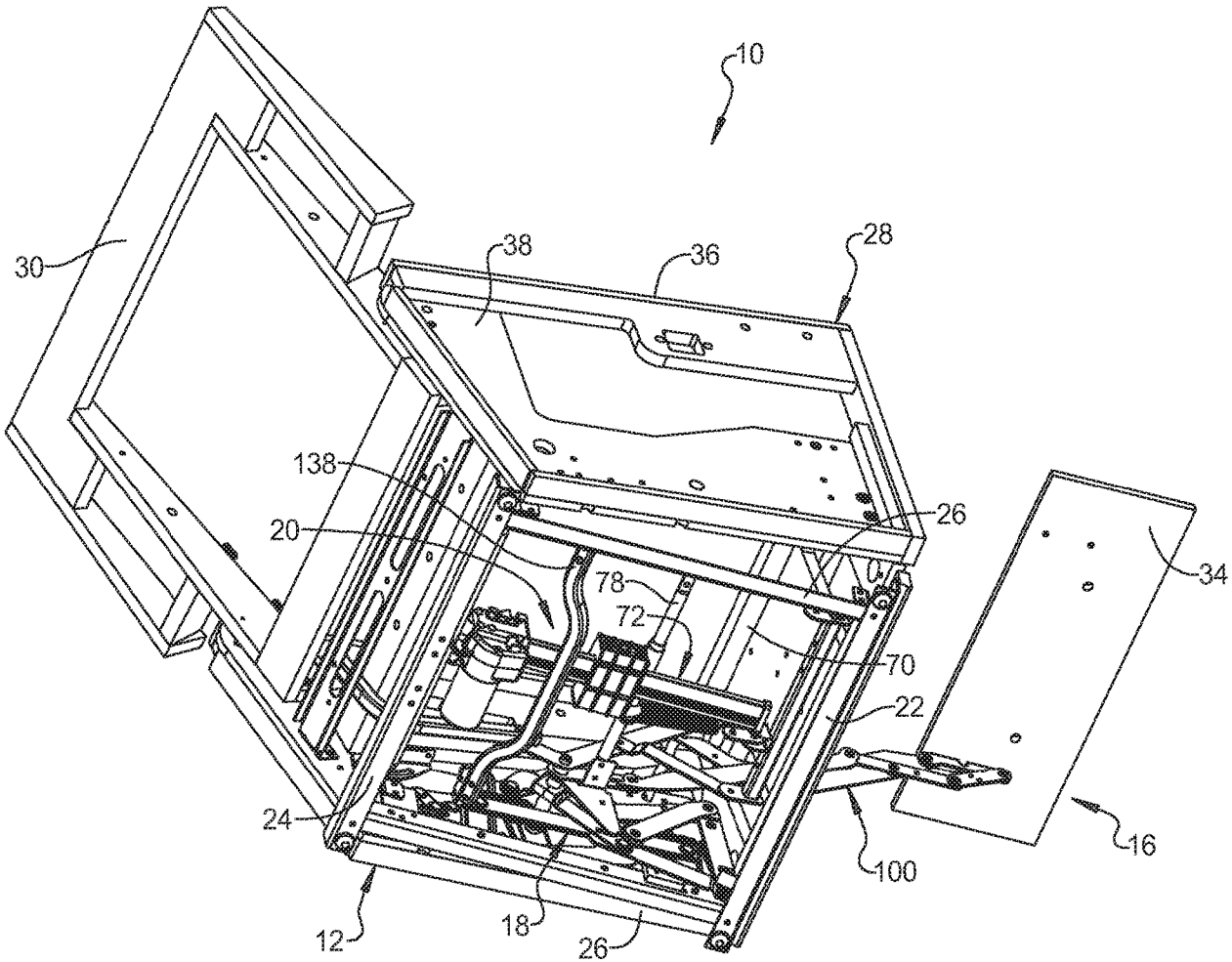
FIG. 9 is a bottom perspective view of the furniture member in the position of FIG. 8.
Figure 10:
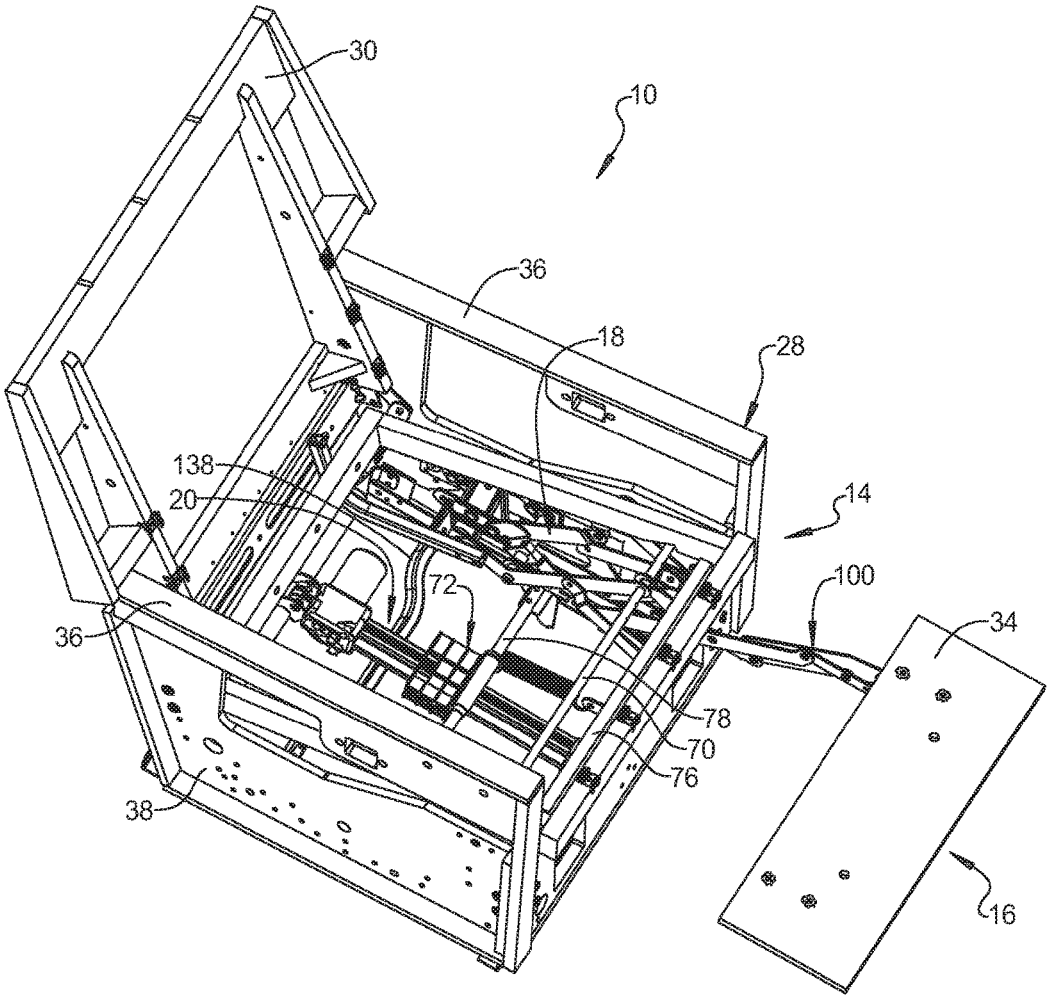
FIG. 10 is a top perspective view of the furniture member in the position of FIG. 8.

In a first position as shown in FIGS. 9 and 10, the carriage 86 is positioned on the motor extrusion housing 84 at an intermediate position between the motor 82 and a distal end 92 of the motor extrusion housing 84. In this example, the first position of the carriage 86 corresponds to approximately 3 inches of linear movement along the motor extrusion housing 84. In the first position, the legrest platform 34 is in the extended position and the seat frame 28 is in the upright position.

Figure 14:
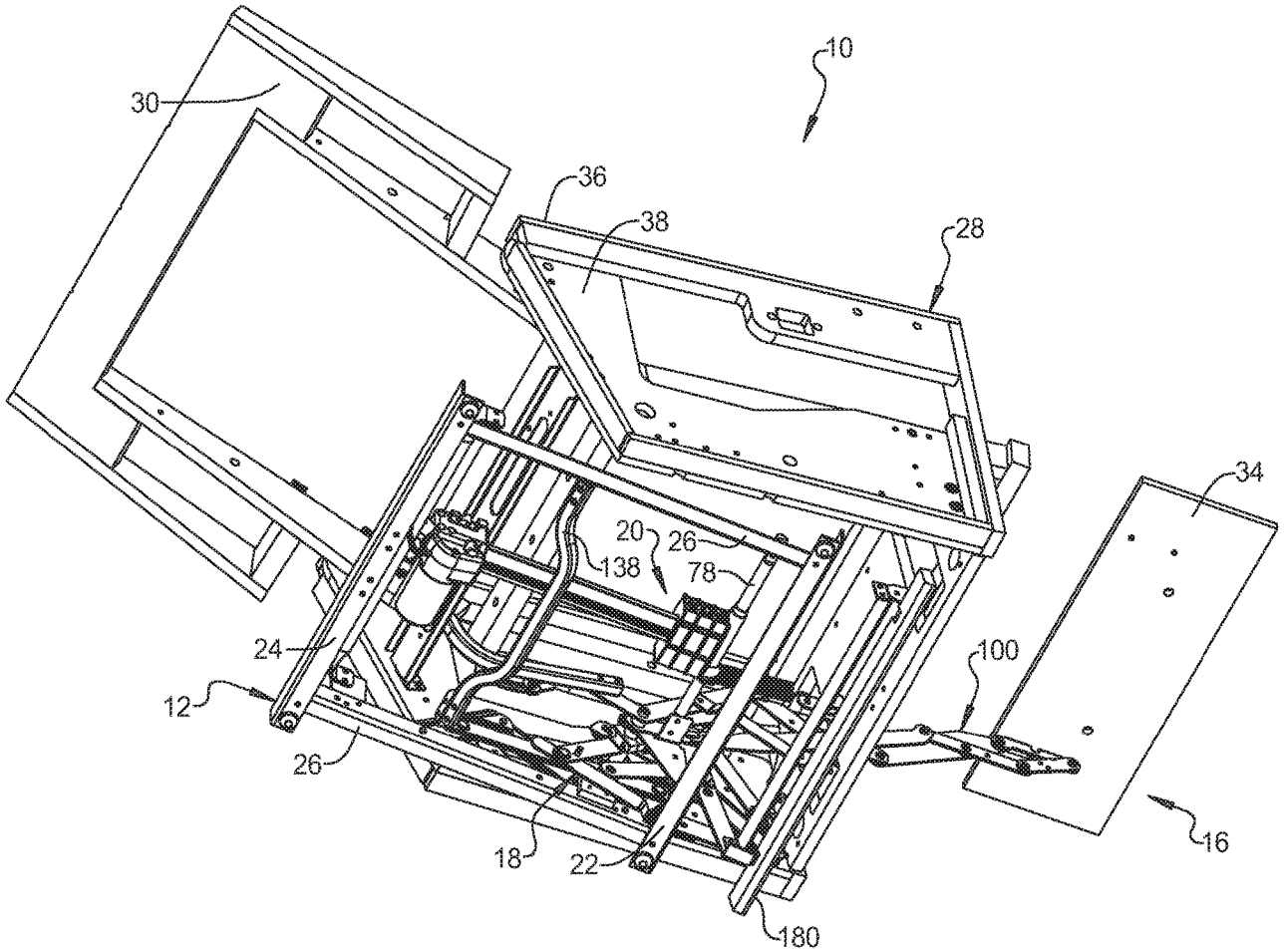
FIG. 14 is a bottom perspective view of the furniture member in the position of FIG. 13.
Figure 15:
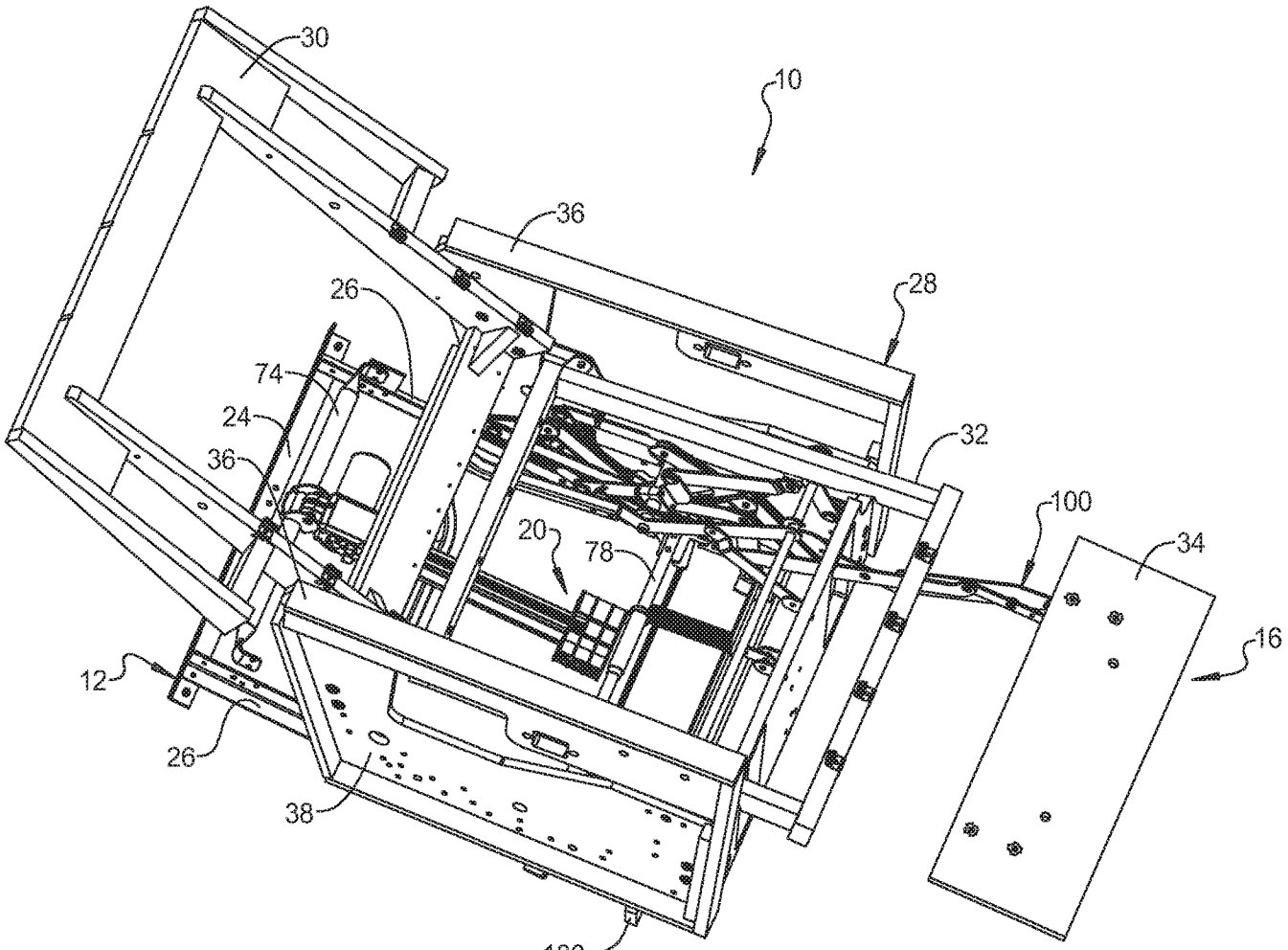
FIG. 15 is a top perspective view of the furniture member in the position of FIG. 13.

In a second position as shown in FIGS. 14 and 15, the carriage 86 is positioned on the motor extrusion housing 84 at or near the distal end 92 of the motor extrusion housing 84. In this example, the second position of the carriage 86 corresponds to approximately 10 inches of linear movement along the motor extrusion housing 84. In the second position, the legrest platform 34 is in the extended position, the seat frame 28 has translated forward relative to the base frame 12 and the seat frame 28 is in the reclined position.

The motor assembly 72 can be any suitable linear actuator. In this example, the motor assembly 72 is an electrically-powered linear actuator with a stroke of at least 10.25 inches. In other examples, other types of motor assemblies 72 can be used and other sizes or motor assemblies with different strokes can also be used. As can be appreciated, the motor assembly 72 is electrically coupled to a power source (not shown) and to a control system (not shown). The control system can include one or more switches to cause the movement of the carriage 86 along the motor extrusion housing 84. Such a control system and/or switches can be mounted to the furniture member 10 in the armrest 36, the seat base 38 or in an alternate location. In this manner, a user can extend (or retract) the legrest mechanism 16 and/or recline the seat back 30 by using the control system.

As further shown in FIG. 4, the ends of the draw bar 78 are connected to a drive plate 88 (only one is shown in the FIGS.). The drive plate 88 is rotatably connected to a shoulder bolt pin 90 (only one is shown in the FIGS.) by a torque tube 98 and/or a drive clamp 166. The shoulder bolt pin 90 can be rigidly connected to the seat base 38. As such, the shoulder bolt pin 90 can provide a rigid pivot about which the drive plate 88, the drive clamp 166 and/or the torque tube 98 can rotate. As will be further explained, the drive plate 88 interfaces with the legrest mechanism 16 and the wall-proximity mechanism 18 to the cause the movement of the legrest platform 34 from the retracted position to the extended position and the seat back 30 from the upright position to the reclined position. The draw bar 78 is also rotatably connected to the carriage 86. When the carriage 86 moves from the initial position to the first position, the movement of the draw bar 78 causes the drive plate 88 to rotate around the shoulder bolt pin 90. This rotation causes an extender link 96 of the pantograph linkage 100 to rotate. This movement, in turn, causes the legrest platform 34 to move from the retracted position to the extended position. When the carriage 86 moves from the first position to the second position, the drive plate 88 is translated in a forward direction relative to the base frame 12. This causes the seat frame 28 to tilt rearward relative to the base frame 12, to translate forward relative to the base frame 12 and to move the seat back 30 from the upright to the reclined position.

The sequencing of the aforementioned movements of the furniture member 10 is assisted, in this example, by the sequencing mechanism 80. The sequencing mechanism 80 applies a force to the draw bar 78 to ensure that the legrest platform 34 moves from the retracted position to the extended position before the seat frame 28 and the seat back 30 move from the upright to the reclined position. As shown in FIG. 4, the sequencing mechanism 80, in one example, can include a pair of springs (only one is shown in the FIGS.) that is connected between the carriage 86 and the front rod 76. The front rod 76 is fixed to a front portion of the seat frame 28. As can be appreciated, the springs, in this example, extend when the carriage 86 (and the attached draw bar 78) moves away from the front rod 76. When the carriage 86 is in the initial position, the sequencing mechanism 80 exerts a forward-directed (i.e., toward the front rod 76) force on the draw bar 78. This force assists in rotating the drive plate 88 as previously described to extend the legrest platform 34.

Figure 8:
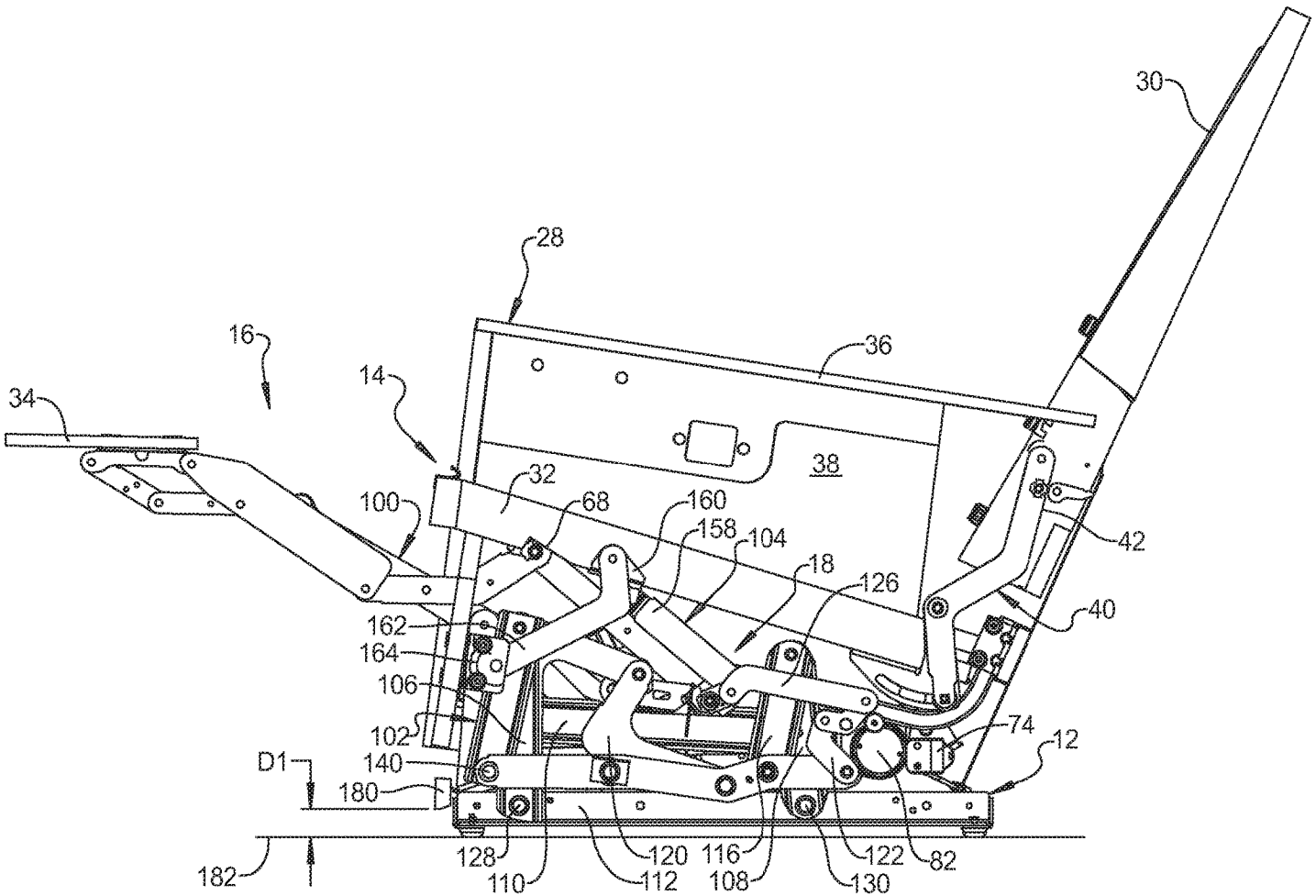
FIG. 8 is a side view of the furniture member with the seat back in the upright position and the legrest in an extended position.

As shown in FIGS. 2, 8 and 10, the legrest mechanism 16 may include a pair of pantograph linkages 100 (only one of which is shown in the FIGS.). The pantograph linkages 100 may be coupled to the rod 70, the legrest platform 34, and the draw bar 78. When the draw bar 78 moves forward, the drive plate 88, the torque tube 98 and/or the drive clamp 166 rotate about the shoulder bolt pin 90 and drive the pantograph linkages 100 and the legrest platform 34 to move between the retracted position (FIGS. 1-3) and the extended position (FIGS. 8-10).

Figure 5:
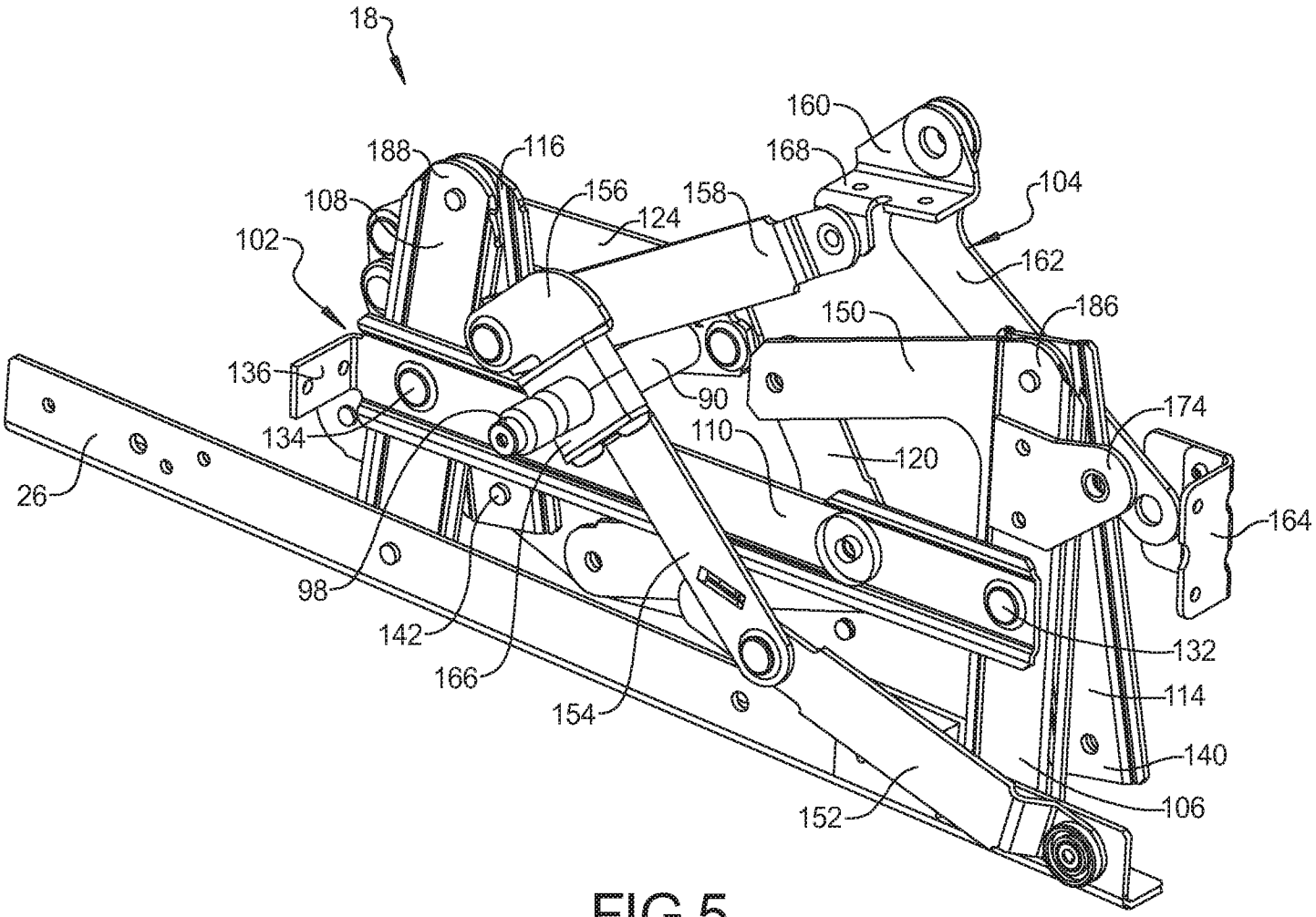
FIG. 5 is a perspective view of a wall-proximity mechanism of the furniture member when the furniture member is in the position of FIG. 1.
Figure 6:
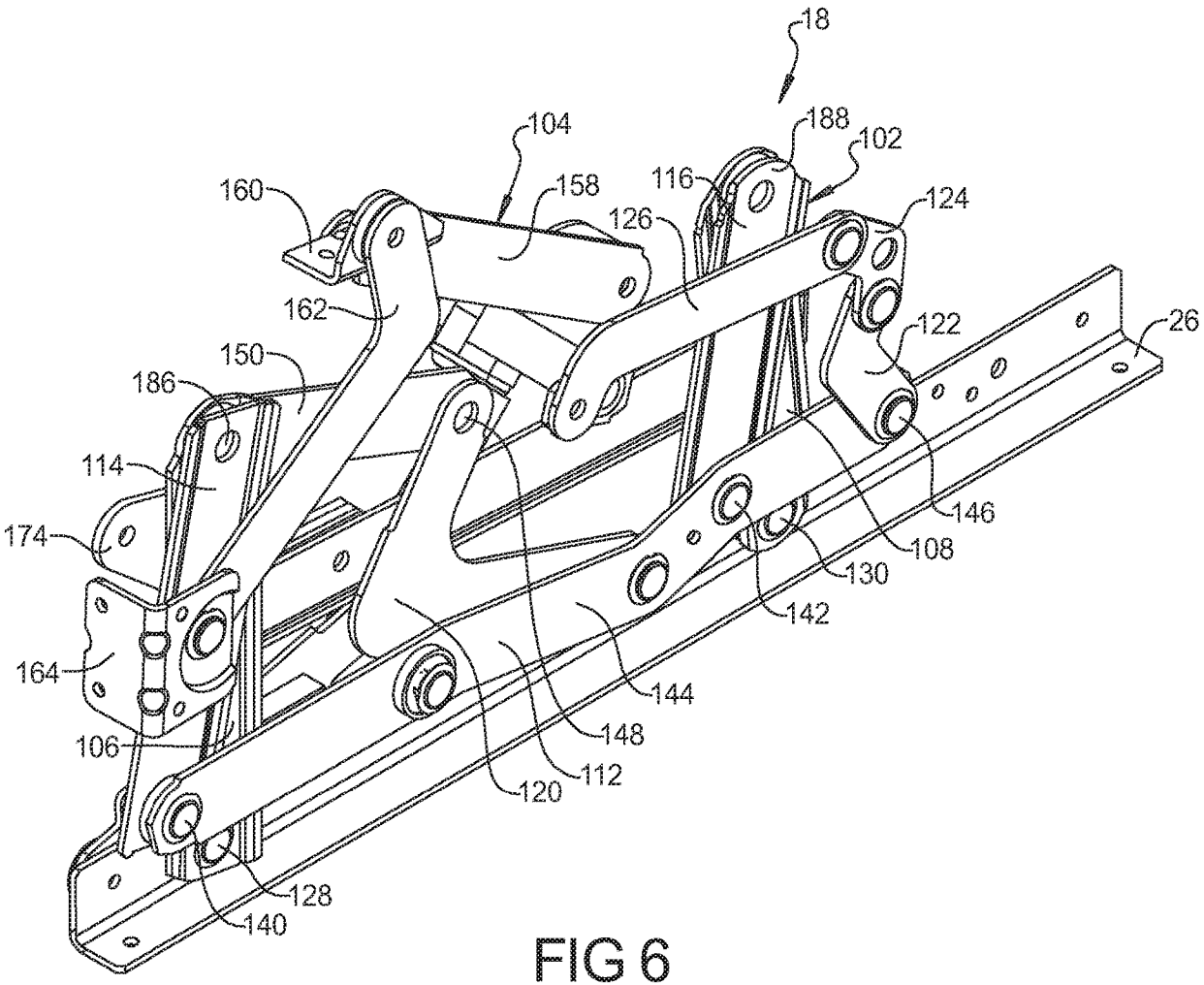
FIG. 6 is a perspective view of an opposite side of the wall-proximity mechanism of the furniture member when the furniture member is in the position of FIG. 1.

The wall-proximity mechanism 18 may include a pair of first linkages 102 (only one of which is shown in the FIGS.) and a pair of second linkages 104 (only one of which is shown in the FIGS.). As shown in FIGS. 5 and 6, each of the first linkages 102 may include a first motion link 106, a second motion link 108, a first cross-member 110, a second cross-member 112, a first control link 114, a second control link 116, a first connecting link 118, a second connecting link 120, a third connecting link 122, a fourth connecting link 124, and a drive link 126.

In the example shown, first ends 128, 130 of the first motion link 106 and the second motion link 108, respectively, are pivotably mounted to the side support member 26. As such, the first motion link 106 and the second motion link 108 can rotate relative to the base frame 12. The first cross-member 110 is pivotably connected to an intermediate portion 132 of the first motion link 106 and to an intermediate portion 134 of the second motion link 108. An aft end 136 of the first cross-member 110 is connected to a transverse support bar 138. As shown in FIG. 2, the transverse support bar 138 spans across the furniture member 10 and connects the aft end 136 of the first cross-member 110 to an aft end of the first cross-member (not shown in the FIGS.) located on the opposite side of the furniture member 10.

The first control link 114 is rotatably connected to the first motion link 106 at a top end 186. The second control link 116 is rotatably connected to the second motion link 108 at a top end 188. The first control link 114 projects forward and downward from the top end 186 toward a second end 140. The second control link 116 projects forward and downward from the top end 188 toward a second end 142. The second end 140 of the first control link 114 and the second end 142 of the second control link 116 are connected to the second cross-member 112.

The second cross-member 112, in this example, is positioned laterally outboard of the first motion link 106, the second motion link 108, the first control link 114 and the second control link 116. The second connecting link 120 can also be connected to the second cross-member 112. In this example, the second connecting link 120 is rotatably connected to an intermediate portion 144 of the second cross-member 112 that is located between the second ends 140, 142 of the first control link 114 and the second control link 116. The second connecting link 120, in this example, has an L-shape. The second connecting link 120 projects away from the intermediate portion 144 of the second cross-member. The opposite end 148 of the second connecting link is connected to an extension arm 150 of the first motion link 106.

The third connecting link 122 can also be connected to the second cross-member 112. As shown in FIG. 6, the third connecting link 122 is rotatably connected to the aft end 146 of the second cross-member 112. The fourth connecting link 124 is rotatably connected to the third connecting link 122. The drive link 126 is connected to the fourth connecting link 124 and at or near the shoulder bolt pin 90.

While not shown, one or more mounting brackets can be connected to the pair of first linkages 102 to secure one or more elements of the seat assembly 14. In one example, one or more mounting brackets are secured to the second cross-member 112, the third connecting link 122 and/or the shoulder bolt pin 90. The one or more mounting brackets can connect the first linkages 102 to the side panels of the seat assembly 14.

The pair of second linkages 104 (only one of which is shown in the FIGS.) can include, in one example, a first swing link 152, a second swing link 154, a drive bracket 156, a first pull link 158, a second pull link 162, a pull brace 164, a drive clamp 166 and a pivot bracket 160. As shown in the example of FIGS. 5 and 6, the first swing link 152 can be rotatably connected to the side support member 26. The second swing link 154 can be rotatably connected to an opposite end of the first swing link 152. The second swing link 154 can extend between the first swing link 152 and the drive clamp 166. In this example, the second swing link 154 is fixedly connected to the drive clamp 166.

The drive clamp 166 rotatably connects the second linkages 104 to the torque tube 98 and/or the shoulder bolt pin 90. As will be explained further, the shoulder bolt pin 90 translates forward after the legrest mechanism 16 moves the legrest platform 34 from the retracted to the extended position. The drive clamp 166, in this example, is a two-piece clamp that is rotatably secured around the torque tube 98 and/or the shoulder bolt pin 90. The second swing link 154 and the drive bracket 156 are fixedly secured to the drive clamp 166. The drive clamp 166, however, is secured around the shoulder bolt pin 90 to permit the rotation of the drive clamp 166 relative to the center axis of the shoulder bolt pin 90.

The first pull link 158 can extend between the drive bracket 156 and the pivot bracket 160. The first pull link 158, in this example, is rotatably connected to the drive bracket 156 and the pivot bracket 160. The second pull link 162 can extend between the pivot bracket 160 and the pull brace 164. In this example, the second pull link 162 is rotatably connected to the pivot bracket 160 and the pull brace 164.

The pivot bracket 160 can include a seat flange 168. The seat flange 168, in this example, is a planar surface on the pivot bracket 160 that can include one or more attachment points to which the seat bottom 32 can be attached. The pull brace 164, in the example shown, is an L-shaped bracket that can include one or more attachment surfaces that can be fixed to the seat frame 28. In the example shown, the pull brace 164 is connected to a front panel of the seat frame 28.

The wall-proximity mechanism 18 may also include a pair of stability linkages 170 (only one of which is shown in the FIGS.). The stability linkages 170, in this example, each include a retractable leg 172 that moves outward from the wall-proximity mechanism 18 when the wall-proximity mechanism 18 translates the seat frame 28 forward. As can be appreciated, when the legrest platform 34 is in an extended position and the wall-proximity mechanism 18 has translated the seat frame 28 forward, the center of gravity of the furniture member 10 moves forward relative to the base frame 12. In such a circumstance, the leg 172 can limit tipping of the furniture member 10.

Figure 16:
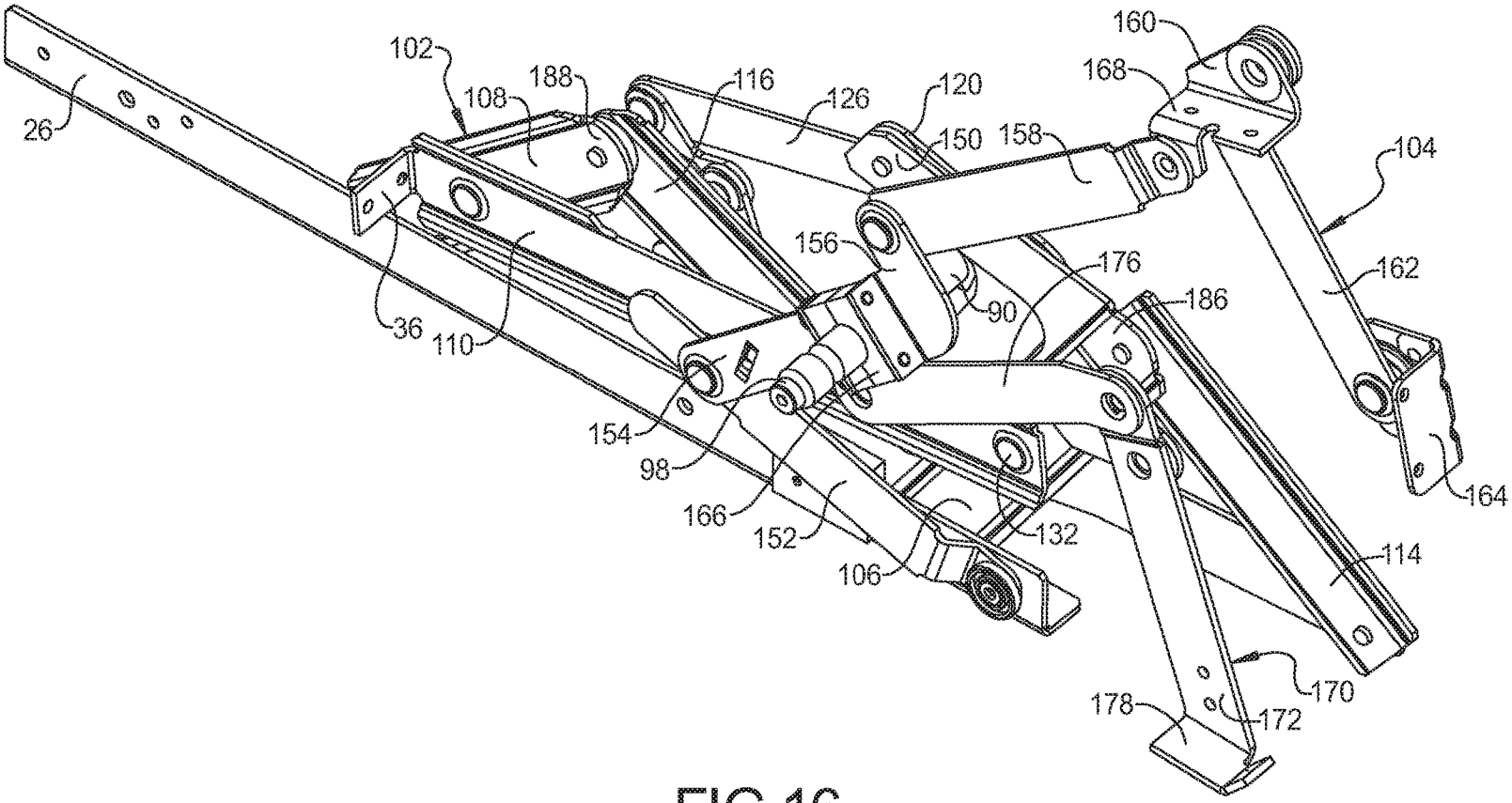
FIG. 16 is a perspective view of the wall-proximity mechanism of the furniture member when the furniture member is in the position of FIG. 13.

As shown in FIGS. 11, 12, 16 and 17, the stability linkage 170 can include a connector tab 174, a tilt link 176 and the leg 172. The connector tab 174 can be fixedly connected to the first motion link 106. The tilt link 176 can extend between the first cross-member 110 and the leg 172. The tilt link 176 can be rotatably connected to the first cross-member 110 and to the leg 172. The leg 172, in this example, is rotatably connected to the tilt link 176 and to the connector tab 174. On an end of the leg 172 that is positioned away from the connector tab 174, the leg 172 can include a foot 178. The foot 178 is a feature of the leg 172 that can contact the floor or other surface that is supporting the furniture member 10 to limit the furniture member 10 from excessive tipping. As shown in FIG. 16, for example, the foot 178 can be a formation in the leg 172 to provide a larger contact arear in the event of the tipping of the furniture member 10.

Figure 11:
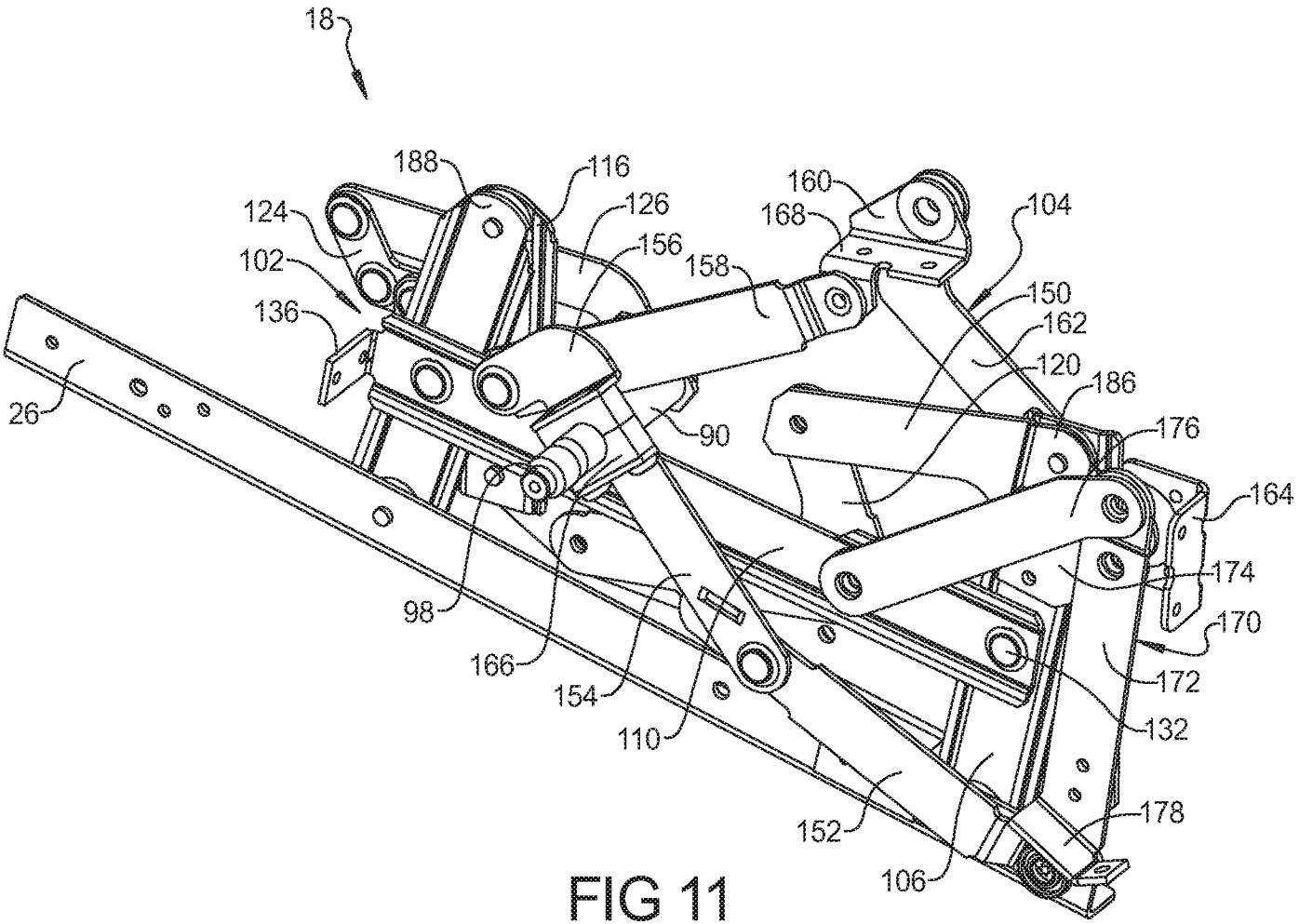
FIG. 11 is a perspective view of the wall-proximity mechanism of the furniture member when the furniture member is in the position of FIG. 8.
Figure 12:
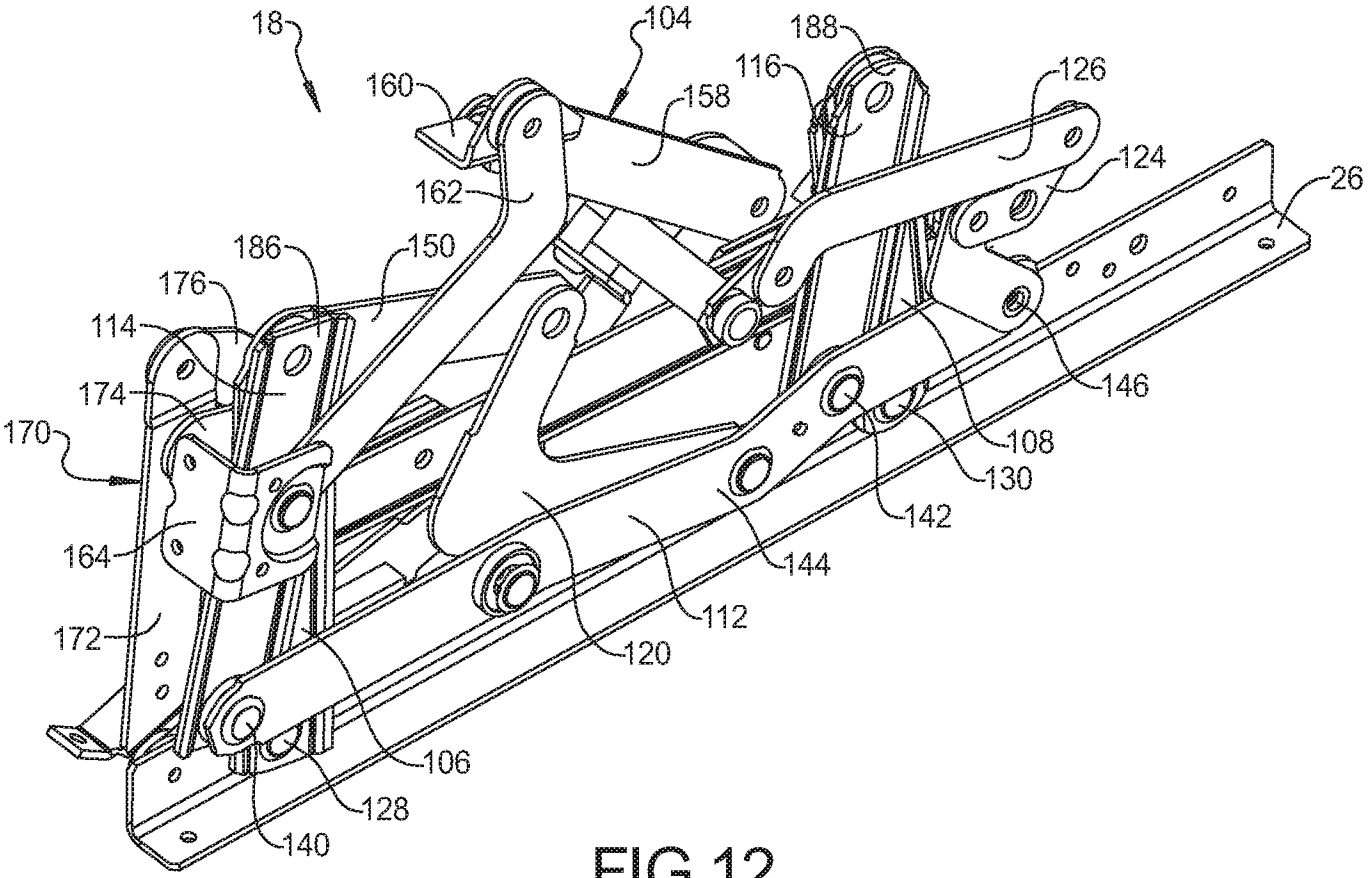
FIG. 12 is a perspective view of an opposite side of the wall-proximity mechanism of the furniture member when the furniture member is in the position of FIG. 8.
Figure 17:
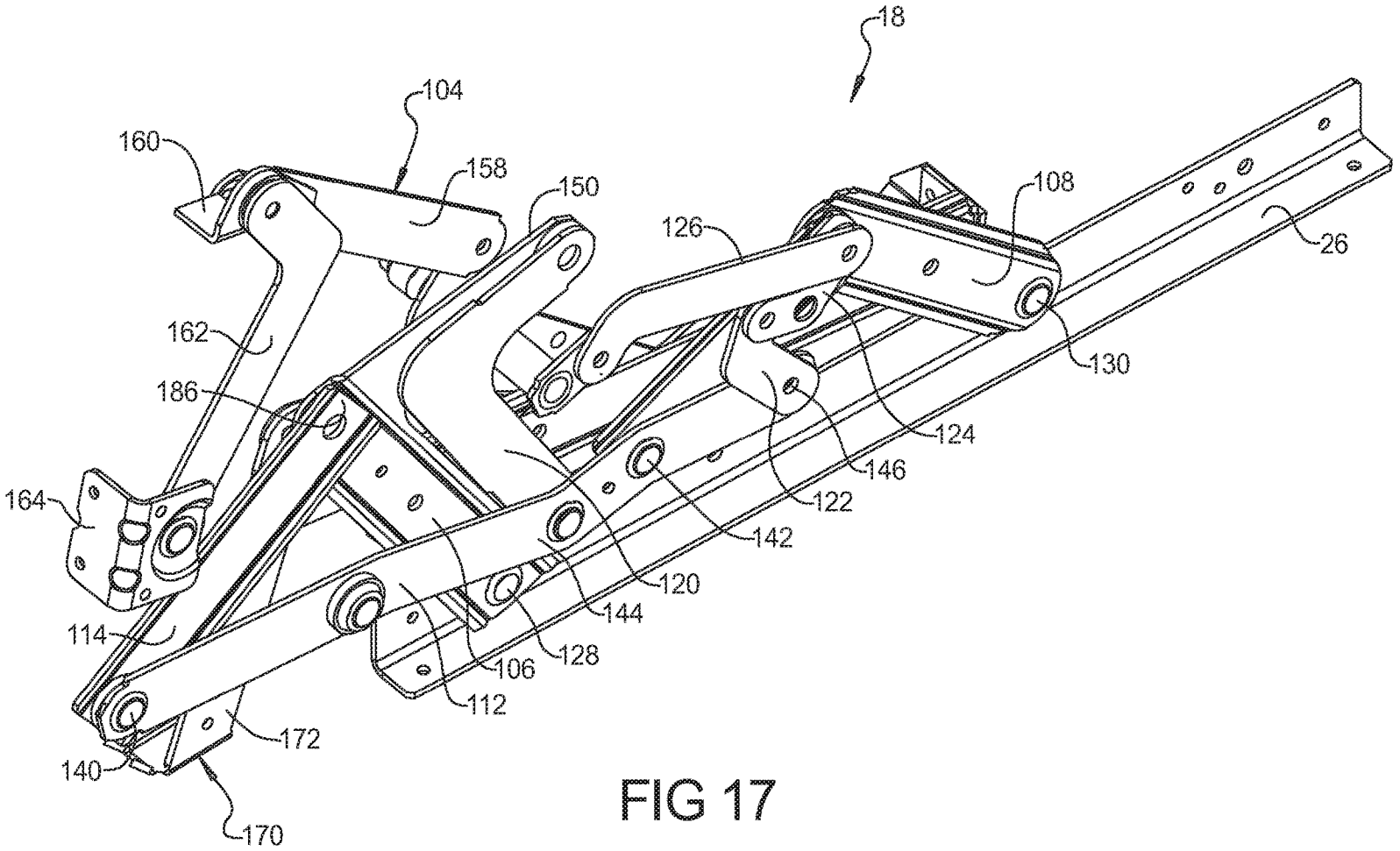
FIG. 17 is a perspective view of an opposite side of the wall-proximity mechanism of the furniture member when the furniture member is in the position of FIG. 13.

As shown in FIGS. 11 and 12 versus FIGS. 16 and 17, the legs 172 move from a retracted position (FIGS. 11 and 12) to a deployed position (FIGS. 16 and 17) when the wall-proximity mechanism 18 translates the seat frame 28 forward. As shown in FIGS. 8, 9, 13 and 14, the furniture member 10 may include a stability bar 180 that extends across the furniture member 10 and is connected to the feet 178 of the two legs 172 on the stability linkages 170. As can be seen in FIG. 8, when the legs 172 are in the retracted position, the stability bar 180 is positioned above a support plane 182 by a distance D1. The support plane 182 corresponds to a floor or other surface that may be supporting the furniture member 10.

Figure 13:
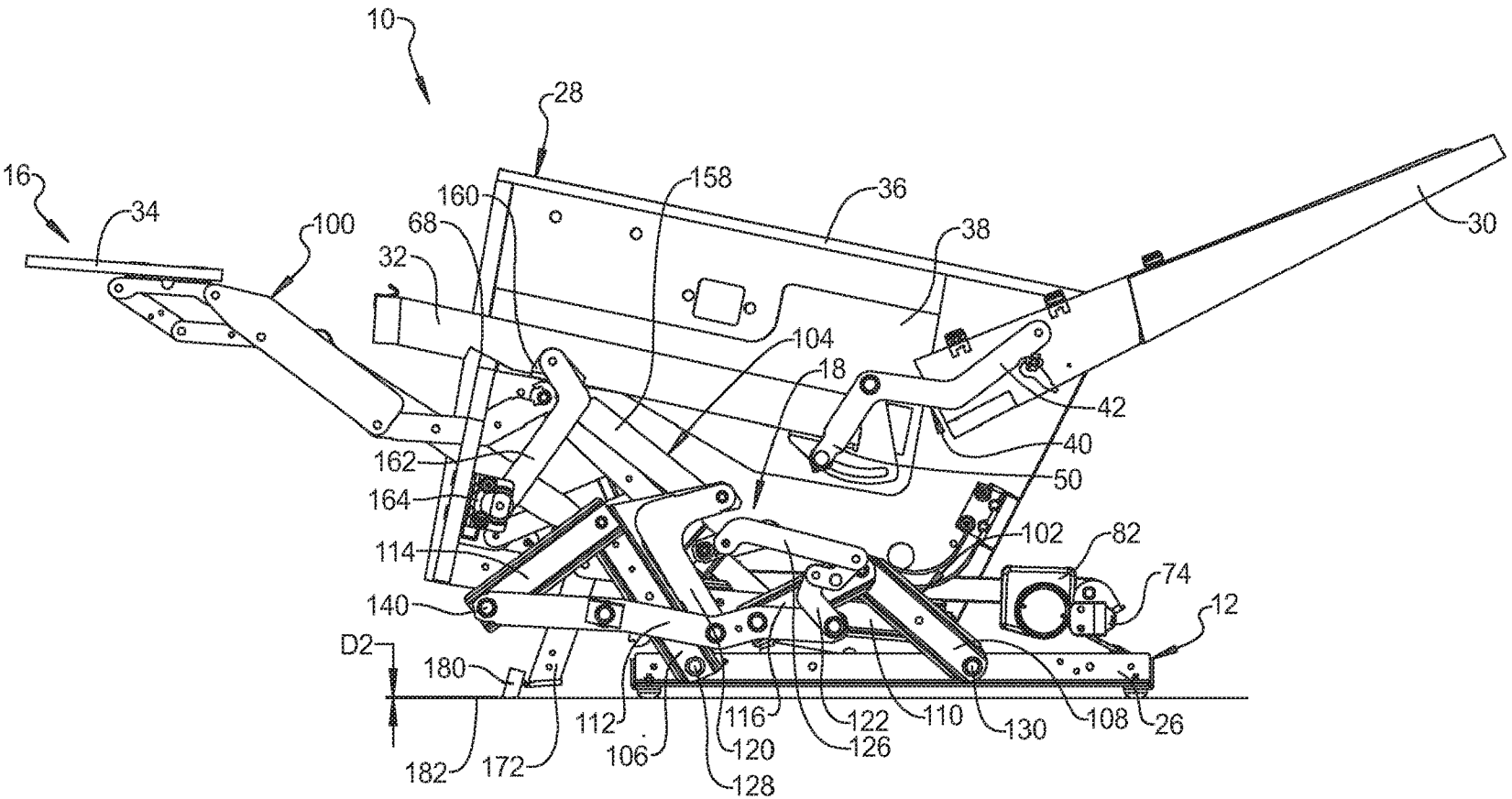
FIG. 13 is a side view of the furniture member with the seat back in a reclined position and the legrest in an extended position.

When the legs 172 move to a deployed position, as shown in FIG. 13, the stability bar 180 moves outward with the legs 172. In the deployed position, the stability bar 180 is positioned closer to the support plane 182. In the deployed position, the stability bar 180 is positioned at the distance D2 above the support plane. In one example, the distance D2 is a minimal distance such that the stability bar touches the floor or other support surface. In other examples, the distance D2 is greater than zero (but less than D1). In such examples, the stability bar 180 is spaced above the support plane 182 when the legs 172 move to the deployed position. It may be desirable that the stability bar 180 (and/or the legs 172) is spaced above the support plane 182 when the legs 172 are in the deployed position in order to prevent the stability bar 180 from pressing on the support surface at a location in front of the furniture member 10. For example, in a circumstance in which the furniture member 10 is supported on a carpeted surface, if the stability bar 180 is spaced above the support plane 182 (i.e., a carpeted surface), the stability bar 180 does not create an indention in the carpet when the legs 172 are deployed.

The links, brackets and/or braces of the first linkages 102, the second linkages 104 and the stability linkages 170 can have any suitable cross-sectional profile. In some examples, the links, brackets and/or braces have continuous cross-sectional profiles. In other examples, the links, bracket and/or braces can have cross-sectional profiles that vary along their lengths. Some of the links, such as the first motion link 106, the second motion link 108, the first control link 114 and/or the second control link 116, can have profiles with support ribs or support flanges that run down the edges of the links. Such ribs or support flanges can increase the bending strength of the link over that of a link having a flat or straight cross-sectional profile. In addition, a cross-sectional profile with a support rib and/or a support flange along one or both edges of the link can create a cup-shaped profile to provide clearance for a bushing or other friction-reducing element to be positioned in the profile between the link and an adjacent link that is rotatably connected thereto.

The links, brackets and/or braces of the first linkages 102, the second linkages 104 and the stability linkages 170 can be connected to one another using any suitable connection method. In some examples, the links, brackets and/or braces that are described as fixedly connected to one another are joined using fasteners such as rivets, screws, bolts. The links, brackets and/or braces that are fixedly connected to one another can also be joined using other connection methods such as welding, staking or the like. In instances in which the links, brackets and/or braces are described as being rotatably connected to one another, the links, brackets and/or braces can be joined using any suitable connecting structure that permits the joined components to rotate relative to one another about the point of connection.

In one example, the rotatably connected links, brackets and/or braces can be joined using a rotatable joint assembly. Such a joint assembly can include a bushing, a grommet and a rivet or other fastener. The grommet is inserted into an opening on the link, bracket and/or brace and the bushing is placed between the adjacent links, brackets and/or braces. The rivet (or other fastener) is then inserted through the adjacent links, brackets and/or braces and through the grommet and the bushing to create a low-friction rotatable joint. In other examples, other rotatably joint assemblies can be used.

With reference to FIGS. 1-18, the operation of the furniture member 10 will be described. As explained above, the pantograph linkages 100 move the legrest platform 34 from the retracted position (FIGS. 1-3) to the extended position (FIGS. 8-10). The motor assembly 72 causes the draw bar 78 to move from an initial position to a first position. In doing so, the drive plate 88 rotates and translates forward driving the pantograph linkages 100 to extend the legrest platform 34. As this action occurs, the wall-proximity mechanism 18 stays largely unchanged.

The furniture member 10, after the legrest platform 34 has moved from the retracted position to the extended position, can move further such that the seat back 30 moves from the upright position to the reclined position and the seat frame 28 can tilt rearward and translate forward. This positioning of the furniture member 10 is depicted in FIGS. 13-15. To cause the further movement of the furniture member 10, the motor assembly 72 causes the draw bar 78 to translate forward when the carriage 86 moves from the first position to the second position. The movement of the draw bar 78 causes the drive plate 88 to pull the shoulder bolt pin 90 forward as well. This movement causes the wall-proximity mechanism 18 to drive both the seat bottom 32 and the seat frame 28 forward.

As previously described, the shoulder bolt pin 90 is connected to the second linkage 104 via the drive bracket 156 by the drive claim 166. As the shoulder bolt pin 90 translates forward, the drive bracket 156 translates forward and moves the first pull link 158 forward. Since the first pull link 158 is connected to the pivot bracket 160, the seat bottom 32 is moved forward. As this occurs, the second pull link 162 drives the seat bottom 32 upward as well. In this manner, the seat bottom 32 translates forward and tilts rearward.

The shoulder bolt pin 90, in the example shown, is also connected to the first linkage 102 via the drive link 126. As the shoulder bolt pin 90 translates forward, the drive link 126 pulls the fourth connecting link 124 and the third connecting link 122. This movement pulls the second cross-member 112 forward. As the second cross-member 112 moves forward, the first control link 114 and the second control link 116 (and the first motion link 106 and the second motion link 108) rotate to cause the seat frame 28 to translate forward and tilt rearward as shown in FIG. 13.

As the first linkage 102 and the second linkage 104 move the seat frame 28 and the seat bottom 32 forward, the stability linkage 170 can move from a retracted position (FIGS. 11 and 12) to a deployed position (FIGS. 15 and 16). As previously described, the tilt link 176 is connected to the first cross-member 110 and the leg 172 is connected to the first motion link 106 via connector tab 174. As the first linkage 102 translates forward, the first motion link 106 moves forward and rotates relative to the first cross-member 110. This relative movement causes the leg 172 to rotate relative to the tilt link 176 such that the leg 172 extends forward to the deployed position as shown in FIGS. 15 and 16.

As the wall-proximity mechanism 18 causes the seat frame 28 to translate forward and tilt rearward, the seat back 30 can move from the upright position to the reclined position. As shown in FIGS. 13 and 18, the lever 42 can rotate relative to the slide member 44 to permit the seat back 30 to tilt rearward and move to the reclined position.

The forward translation of the seat assembly 14 relative to the base frame 12 eliminates or reduces the amount of clearance that is needed between the furniture member 10 and a wall (or other object) to allow the seat back 30 to be moved into the fully reclined position. In some configurations, only about 6.5 inches or less of clearance is needed between a wall and a rearward-most edge of the seat back 30 (when the seat back 30 is in the fully upright position with the legrest fully retracted) so that the wall will not impede the motion of the seat back 30 to the fully reclined position with the legrest mechanism 16 fully extended.

The wall-proximity mechanism 18 may be or include a linkage that converts rotation of the links of the mechanism 18 into approximately straight-line translation of the seat frame 28. The approximate straight-line translation of the wall-proximity mechanism 18 allows for the forward/rearward movement of the mechanism 18 without unwanted raising or lowering of the seat frame 28 and a person seated on the seat frame 28. Specifically, cooperation between the first motion link 106, the first control link 114, the second connecting link 120 and the second cross-member 112 causes the approximate straight-line translation of the seat frame 28 relative to the base frame 12. The second control link 116 and the second motion link 108 may function as follower links and support the rear portion of the mechanism 18 during traverse and are connected to the front of the mechanism 18 by the first cross-member 110 and the first motion link 106.

Reducing or eliminating unwanted raising and lowering is important because if unwanted raising or lowering were to occur during traverse, it would cause unbalance. In some configurations, the wall-proximity mechanism 18 translates the seat frame 28 forward approximately 8-9 inches, while deviating from straight-line travel by less than 0.5 inches. Because the seat frame 28 is lifted vertically upward only a very small amount over the range of translation, less force is required to cause the previously described movement of the furniture member 10.

Furthermore, the first and second linkages 102, 106 of the wall-proximity mechanism 18 include only links that are rotatably coupled to each other, and do not include tracks along which links must roll or slide. Eliminating tracks and rollers/wheels may improve the longevity and reliability of the mechanism 18 and improve the smoothness of the motion of the mechanism 18. This is because tracks (especially curved tracks) can accumulate dirt and debris (especially at low points of a curved track) that can cause binding and/or bumpy motion as the rollers roll over the dirt and debris as they travel along the track. The mechanism 18 eliminates wheels/rollers and tracks found in prior-art mechanism, while still providing adequate wall-away functionality.

As previously described, the aforementioned movement of the furniture member can be accomplished by the use of a single motor 82. This simplifies the motorized actuation of the furniture member 10. The movement of the draw bar 78 along the motor extrusion housing 84 causes both the movement of the legrest mechanism 16 and the wall-proximity mechanism 18. The sequencing mechanism 80 provides a force during the initial movements of the draw bar 78 to ensure that the legrest mechanism 16 moves the legrest platform 34 from the retracted position to the extended position before the draw bar 78 causes the wall-proximity mechanism 18 to translate the seat frame 28 forward relative to the base frame 12.

When the wall-proximity mechanism 18 has translated the seat frame 28 forward relative to the base frame 12, the center of gravity of the furniture member 10 has moved forward as well. This shift in the center of gravity can cause the furniture member 10 to tip forward or to otherwise be susceptible to tipping if an occupant of the furniture member 10 moves in the furniture member 10, especially in a forward direction. The stability linkage 170 can prevent or reduce the likelihood that that the furniture member 10 can tip forward. In addition, the stability linkage 170 is hidden from view since the legs 172 and the stability bar 180 remain under the seat frame 28 when in the deployed position. Still further, since the legs 172 and/or the stability bar 180 can be spaced above a support surface (e.g., a carpeted floor), the stability linkage 170 does not leave an impression or other indication of its deployment on the support surface when the seat frame 28 translated rearward when the seat frame 28 returns to its original position.

As can be appreciated, the furniture member 10 can operate in the in a reverse manner to that previously described to return the furniture member 10 to its original positioning. The motor assembly 72 can move the draw bar 78 rearward from the second position to the first position. This movement, in turn, causes the seat bottom 32 and the seat frame 28 to translate rearward. During this return motion, the stability linkage 170 returns the leg 172 from the deployed position back to the retracted position. The motor assembly 72 can then move the draw bar 78 from the first position to the initial position. This movement causes the legrest platform 34 to return from the extended position to the retracted position.

With reference to FIGS. 19-38, a furniture member 1010 is provided that may include a base frame 1012, a seat assembly 1014, a legrest mechanism 1016, a wall-proximity mechanism 1018, and a drive mechanism 1020. As will be described in more detail below, the furniture member may include a first motor assembly 1072 and a second motor assembly 1074. The first motor assembly 1072 can be coupled to the legrest mechanism 1016 and cause the legrest mechanism 1016 to move between a retracted position (FIGS. 19-25) and an extended position (FIGS. 26-31). Independently of the first motor assembly 1072, the second motor assembly 1074 may be coupled to the wall-proximity mechanism 1018 and cause the wall-proximity mechanism 1018 to tilt the seat assembly 1014 rearward relative to the base frame 1012 and translate the seat assembly 1014 forward relative to the base frame 1012.

Figure 19:
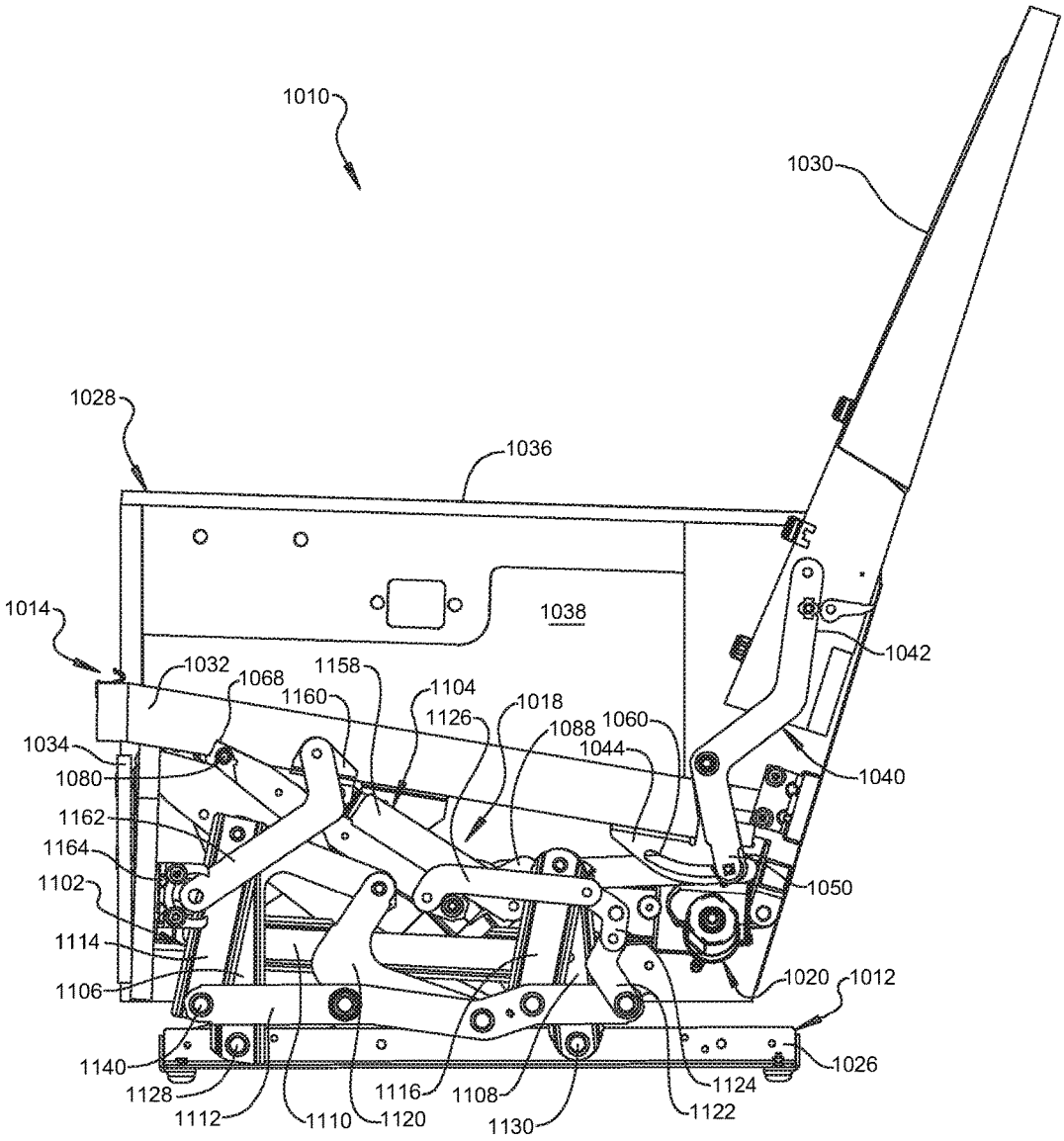
FIG. 19 is a side view of another furniture member with a seatback in an upright position and a legrest in a retracted position.
Figure 20:
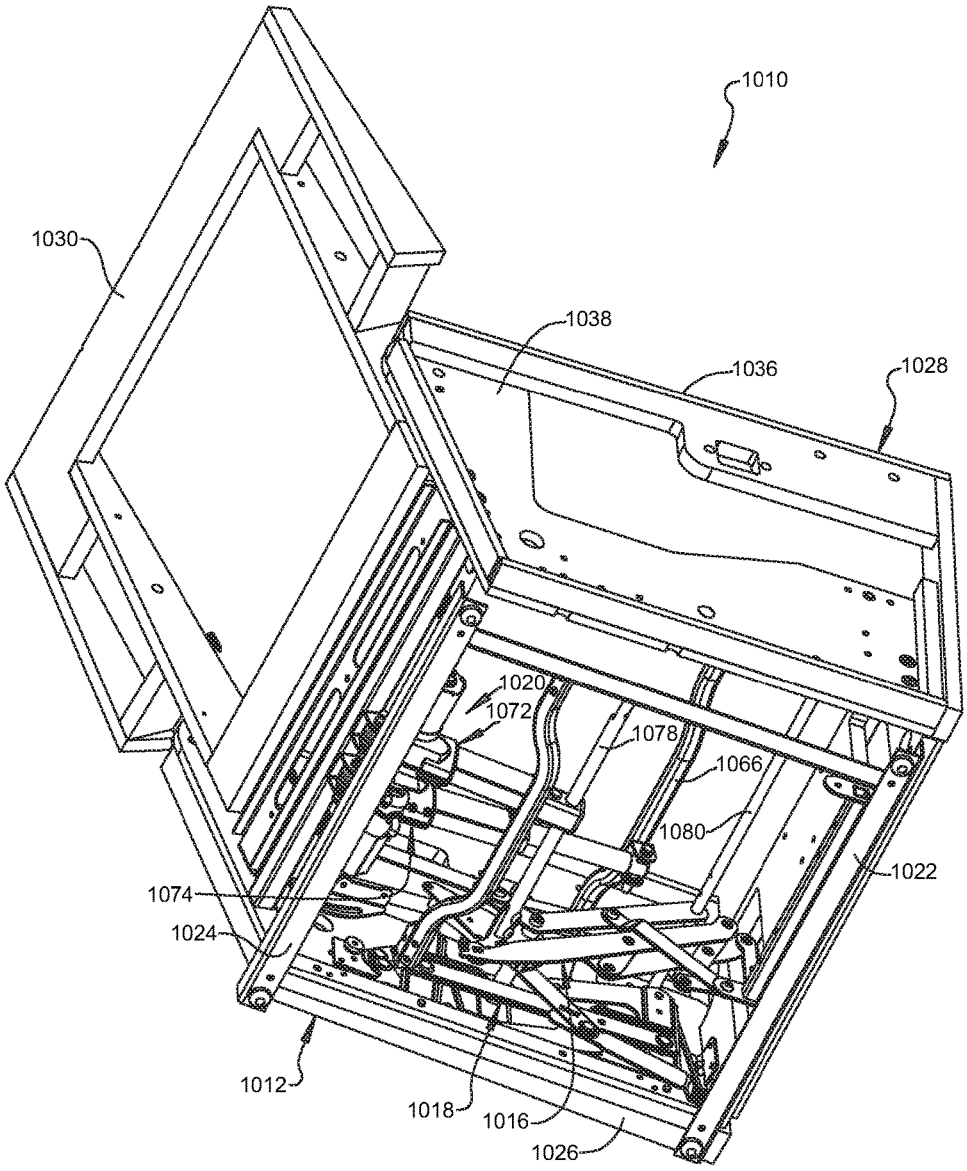
FIG. 20 is a bottom perspective view of the furniture member in the position of FIG. 19.

As shown in FIGS. 19 and 20, the base frame 1012 may include a plurality of stationary beams including, for example, a front support member 1022, a rear support member 1024, and a pair of side support members 1026. The side support members 1026 are spaced apart from each other and are attached to and extend between the front and rear support members 1022, 1024.

As shown in FIGS. 19, 21, 26 and 32, the seat assembly 1014 may include a seat frame 1028, the seatback 1030, a seat bottom 1032, and a legrest platform 1034. The seat frame 1028 may include a plurality of armrests 1036 and a seat base 1038 that supports the seatback 1030, the seat bottom 1032 and the legrest mechanism 1016. The seatback 1030 is rotatably coupled to the seat base 1038 to allow the seatback 1030 to rotate between the fully upright and fully reclined positions.

Figure 25:
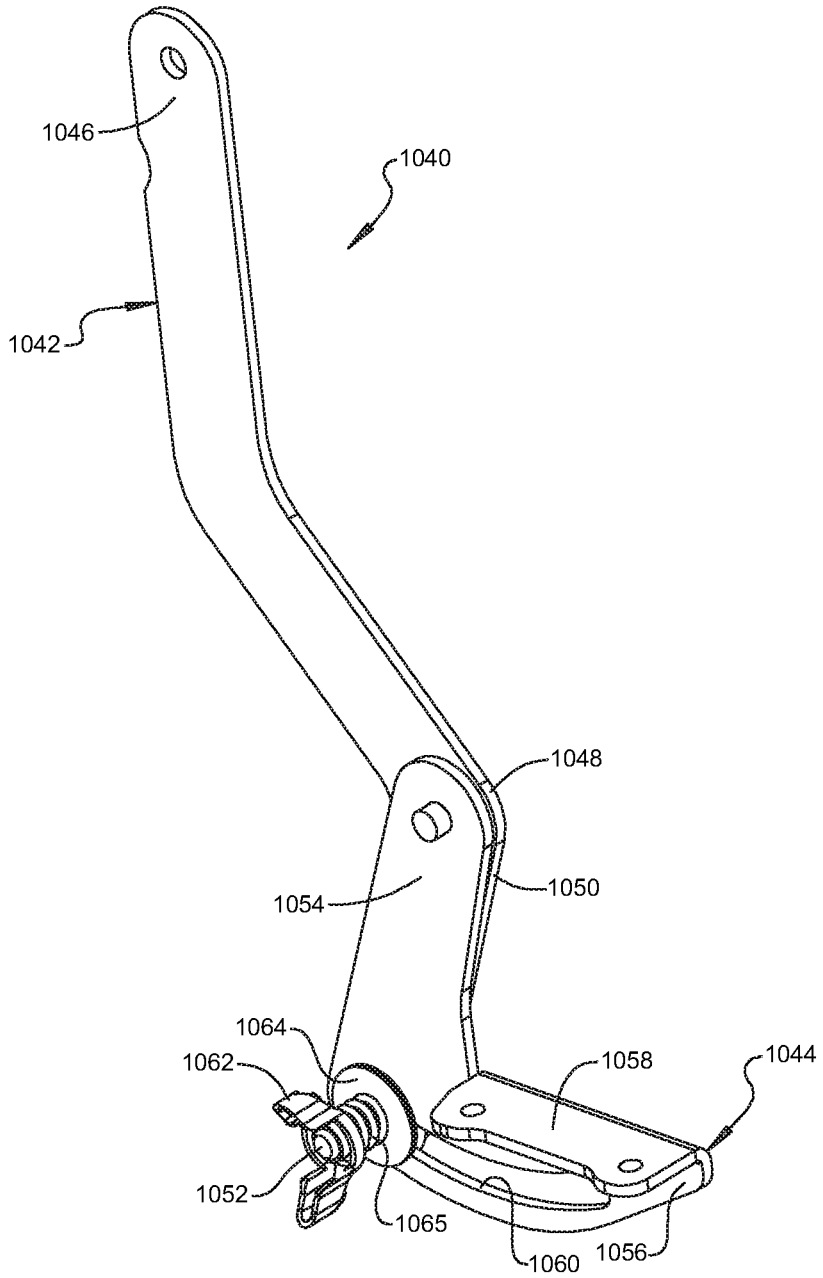
FIG. 25 is a perspective view of a friction-slide mechanism of the furniture member when the seatback is in the upright position.

The seatback 1030 is rotatably coupled to the seat bottom 1032 by a pair of friction-slide mechanisms 1040 (only one of which is shown in the FIGS.). As shown in FIGS. 19, 25 and 38, each friction-slide mechanism 1040 may include a lever 1042 and a slide member 1044. A first end 1046 of the lever 1042 may be fixedly attached to the seatback 1030. An intermediate portion 1048 of the lever 1042 may be rotatably engaged with the slide member 1044. A second end 1050 of the lever 1042 may include a protrusion 1052 (e.g., pin, threaded fastener or rivet) that is slidably engaged with the slide member 1044.

As shown in FIG. 25, the slide member 1044 may have first and second arms 1054, 1056 that cooperate to form a generally L-shaped member. The first arm 1054 may be rotatably coupled with the intermediate portion 1048 of the lever 1042. The second arm 1056 may include a flange 1058 that may be fixedly attached to the seat bottom 1032. The second arm 1056 may include a curved slot 1060 that slidably receives the protrusion 1052 of the lever 1042. As shown in FIG. 25, a nut 1062 and washer 1064 may engage the protrusion 1052. Threadably tightening the nut 1062 against the washer 1064 may clamp the slide member 1044 between the lever 1042 and the nut 1062. The tightness of nut 1062 can be adjusted to adjust a frictional force between the lever 1042 and the slide member 1044. While the nut 1062 shown in FIG. 25 is a wing nut, it can be appreciated that any type of nut could be used to adjust the frictional force between the lever 1042 and the slide member 1044. In some embodiments, a compression spring 1065 may be disposed on the protrusion 1052 between the nut 1062 and the slide member 1044 (or between the nut 1062 and the washer 1064). In such configurations, the tightness of the nut 1062 could be adjusted to adjust the force of the spring urging the slide member 1044 against the lever 1042, thereby adjusting the frictional force between the lever 1042 and the slide member 1044. The frictional force can be adjusted according to the occupant's weight and size.

As shown in FIG. 19, the seat bottom 1032, in this example, may include a notch 1068 positioned forward of a pivot bracket 1160. The notch 1068 is a cut-out in the seat bottom 1032 that provides clearance for a front rod 1080 that spans beneath the seat bottom 1032.

Figure 21:
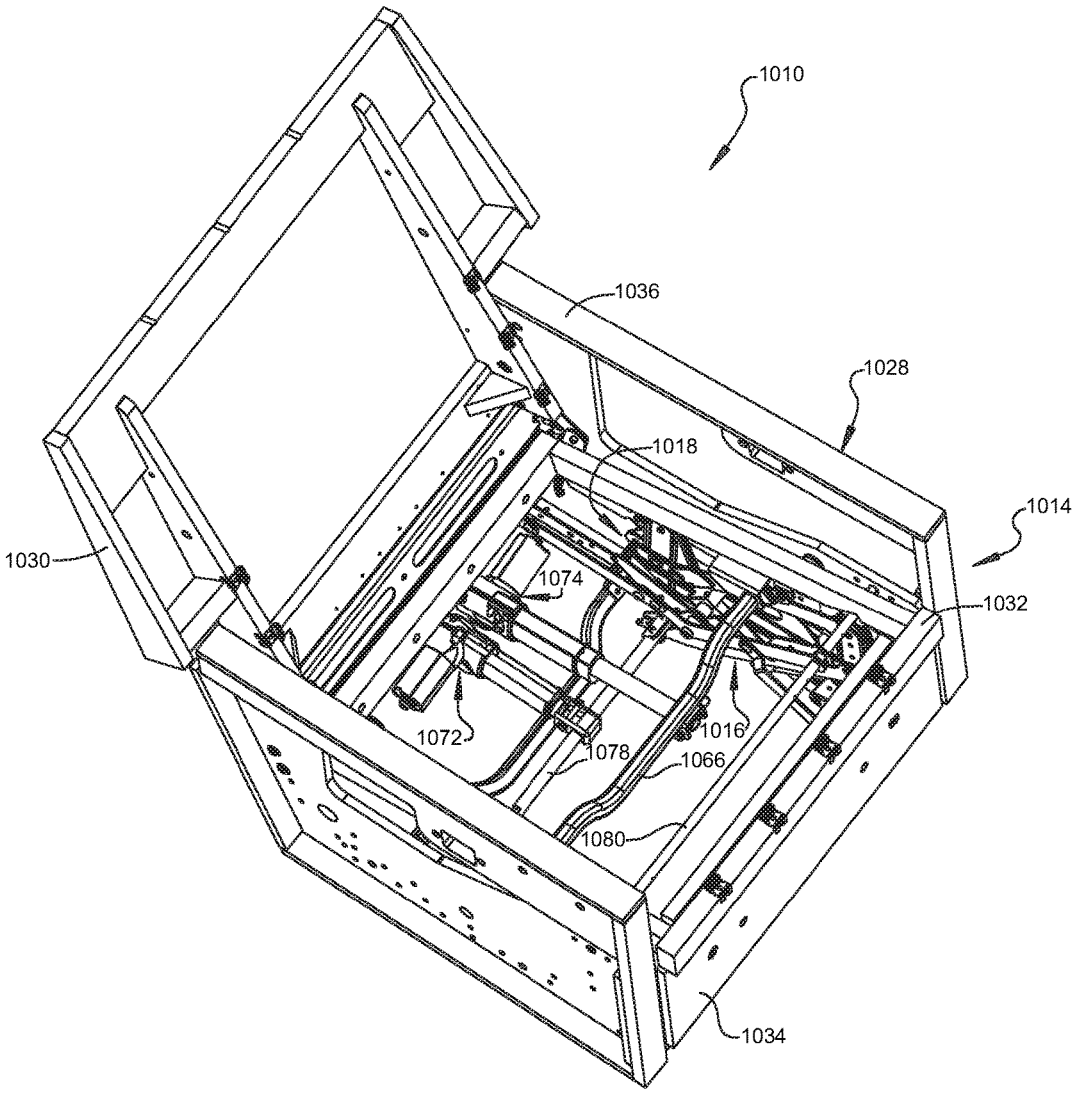
FIG. 21 is a top perspective view of the furniture member in the position of FIG. 19.
Figure 22:
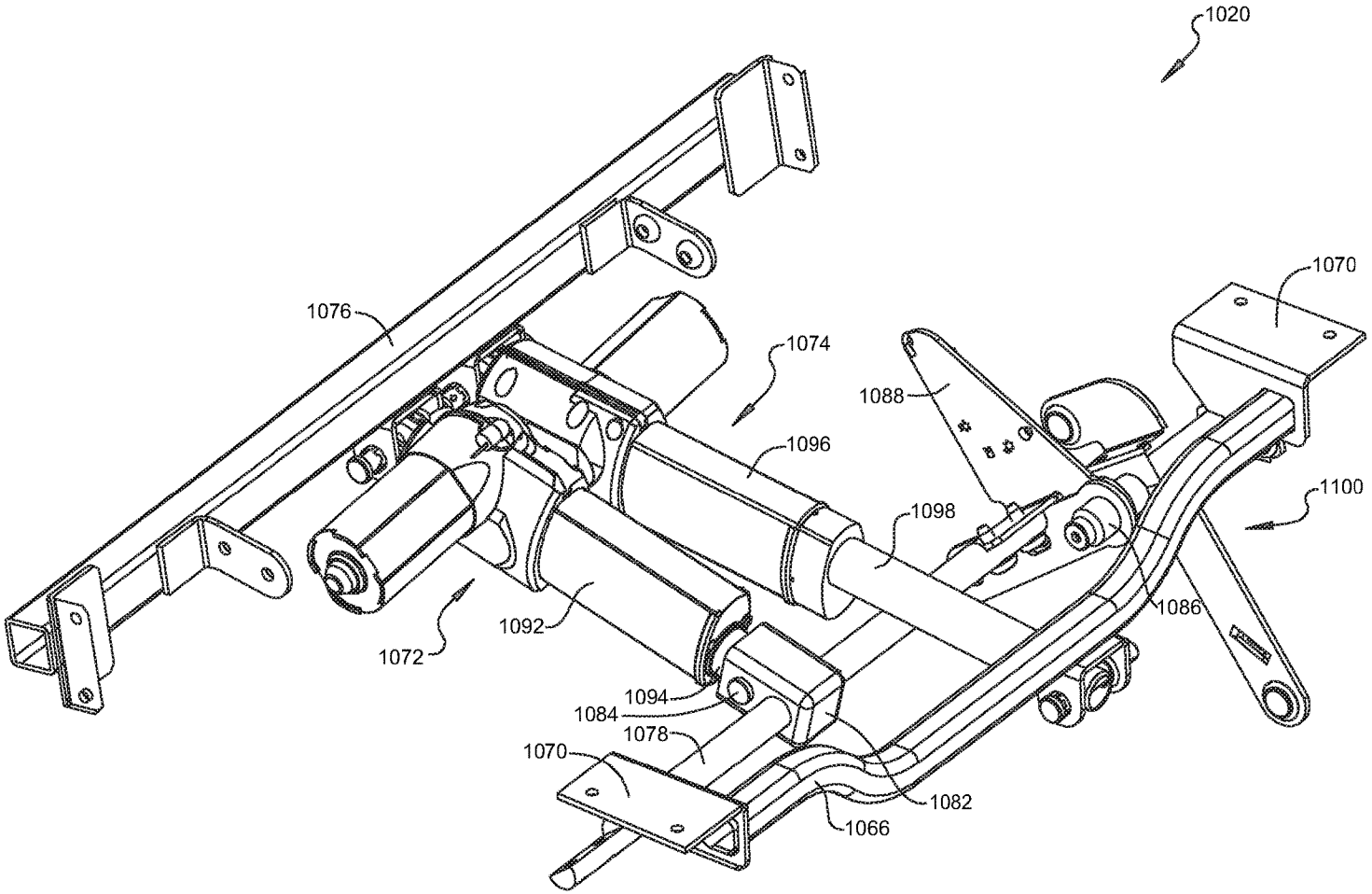
FIG. 22 is a perspective view of the motor assemblies of the furniture member in the position of FIG. 19.

Referring now to FIGS. 20-22, the drive mechanism 1020, in this example, includes a first motor assembly 1072, a second motor assembly 1074, a rear bar 1076, a draw bar 1078 and a front bar 1066. The first motor assembly 1072 and the second motor assembly 1074 are, in this example, electrically-powered linear actuators. In other examples, the first motor assembly 1072 and the second motor assembly 1074 can be other types of powered extension mechanisms that can be used to cause linear displacement such as, for example, hydraulic or pneumatic cylinders or the like.

Both the first motor assembly 1072 and the second motor assembly 1074, in the example shown, are pivotably connected to the rear bar 1076. In this example, the rear bar 1076 is a square tube but, in other examples, the rear bar 1076 can have other shapes or configurations. The rear bar 1076 is connected at its ends to the seat base 1038 and spans across the seat base 1038 beneath the seat bottom 1032.

The first motor assembly 1072, in the example shown, includes a first motor cylinder 1092 and a first motion rod 1094. The first motion rod 1094 is rotatably connected to the draw bar 1078. The first motion rod 1094 extends or retracts relative to the first motor cylinder 1092 to cause the legrest platform 1034 to move from the retracted to the extended position as will be further described.

The second motor assembly 1074, in the example shown, includes a second motor cylinder 1096 and a second motion rod 1098. The second motion rod 1098 is rotatably connected to the front bar 1066. The front bar 1066 can have any suitable cross-section. In this example, the front bar 1066 has a square-shaped hollow cross section. The front bar 1066 extends across the seat bottom 1032 and is connected to opposite sides of the seat bottom 1032 at a pair of bottom brackets 1070. The second motion rod 1098 extends or retracts relative to the second motor cylinder 1096 to cause the seat bottom 1032 to move forward relative to the seat base 1038 and the seat assembly 1014 to translate forward relative to the base frame 1012 as will be further described.

The first motor assembly 1072 and the second motor assembly 1074 are electrically coupled to a power source and to a control system (not shown). The control system can include one or more switches and/or control logic to cause movement of the first motion rod 1094 and/or the second motion rod 1098. Such a control system and/or switches can be mounted to the furniture member 1010 in the armrest 1036, the seat base 1038 or in an alternate location. A user can extend (or retract) the legrest mechanism 1016 and/or recline the seatback 1030 using the control system and/or switches.

As shown in FIG. 22, the ends of the draw bar 1078 are connected to a drive plate 1088 (only one is shown in the FIGS.). The drive plate 1088 is rotatably connected to a torque tube 1086 (only one is shown in the FIGS.). The torque tube 1086 is supported by a shoulder bolt pin 1090. The shoulder bolt pin 1090 is rigidly connected to the seat base 1038 to provide a rigid pivot about which the drive plate 1088 can rotate to move the legrest platform 1034. As will be further explained, the drive plate 1088 interfaces with the legrest mechanism 1016 to the cause the movement of the legrest platform 1034 from the retracted position to the extended position. The draw bar 1078 is also rotatably connected to the first motion rod 1094 of the first motor assembly 1072. When the first motion rod 1094 moves relative to the first motor cylinder 1092, the first motion rod 1094 moves the draw bar 1078 that, in turn, causes the drive plate 1088 to rotate around the torque tube 1086. This rotation causes the legrest platform 1034 to move from the retracted position to the extended position.

As shown in FIG. 22, the first motion rod 1094 can be connected to the draw bar 1078 by a rod coupling 1082. The rod coupling 1082 can include one or more openings to rotatably attach the draw bar 1078 to the first motion rod 1094. In the example shown, the rod coupling is received over the draw bar 1078 such that the rod coupling 1082 is free to rotate about the draw bar 1078. As can be appreciated, the rod coupling 1082 is received over the draw bar 1078 prior to connecting the drive plate(s) 1088 to the draw bar 1078. The rod coupling can also be connected to an end of the first motion rod 1094 by inserting a pin 1084 though the rod coupling and through the first motion rod 1094. In this configuration, the first motion rod 1094 is centered with (and positioned perpendicular to) a center axis of the draw bar 1078. In this example, the rod coupling 1082 has a rectangular profile and can be formed of a suitable plastic material. In other examples, other suitable materials and other shapes can be used.

Independently of the movement of the draw bar 1078 and/or the drive plate 1088, the second motor assembly 1074 can cause the seat bottom 1032 to move forward, the seatback 1030 to recline and the seat assembly 1014 to translate forward relative to the base frame 1012. As described, the second motion rod 1098 is connected to seat bottom 1032 via the front bar 1066 and the bottom brackets 1070. The extension of the second motion rod 1098 relative to the second motor cylinder 1096 causes the seat bottom 1032 to move forward relative to the seat base 1038. The seat bottom 1032 is also connected to the wall-proximity mechanism 1018. The wall-proximity mechanism 1018 causes the relative movement of the seat bottom 1032 to the seat base 1038 and the relative movement of the seat assembly 1014 to the base frame 1012.

Figure 26:
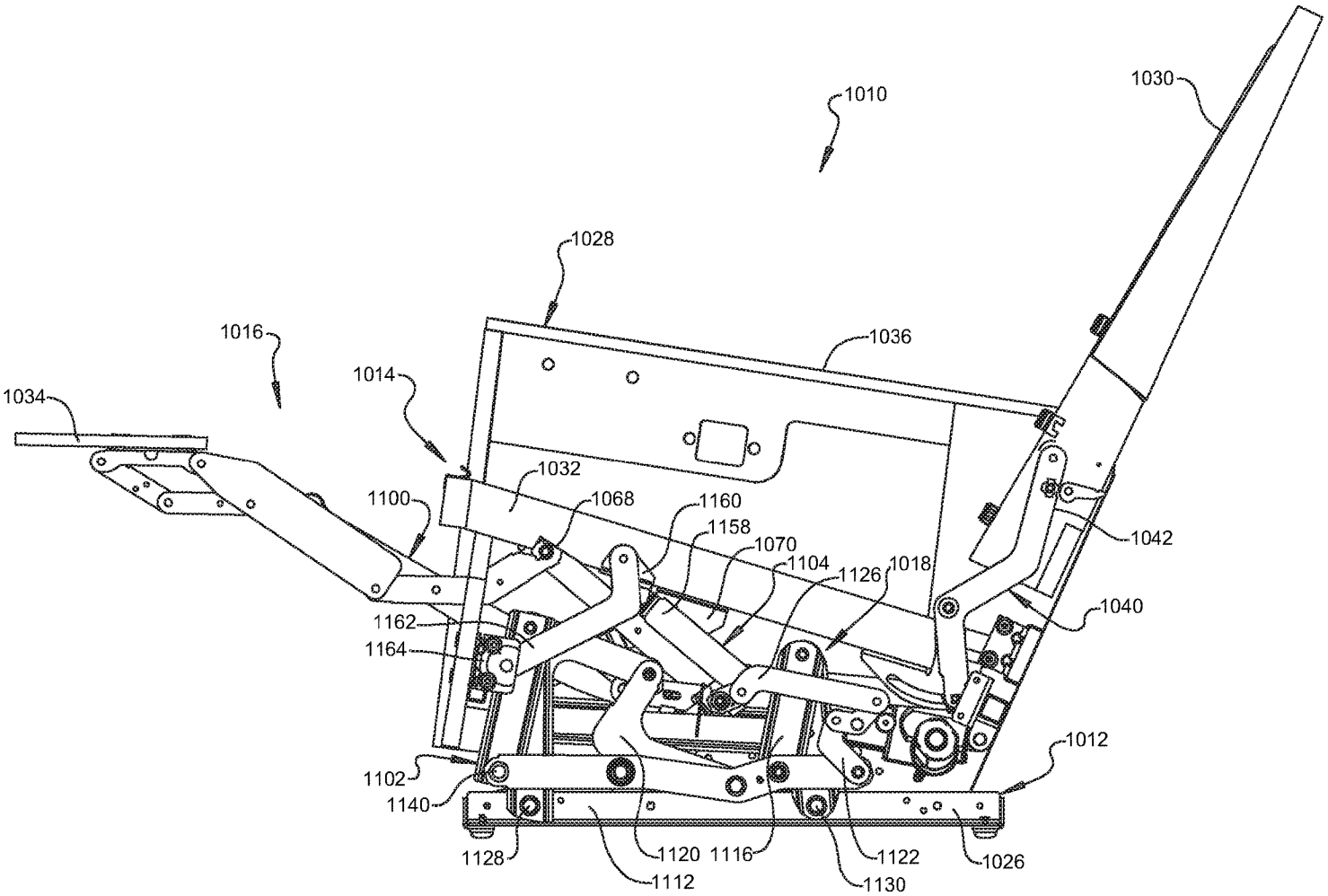
FIG. 26 is a side view of the furniture member with the seatback in the upright position and the legrest in an extended position.
Figure 27:
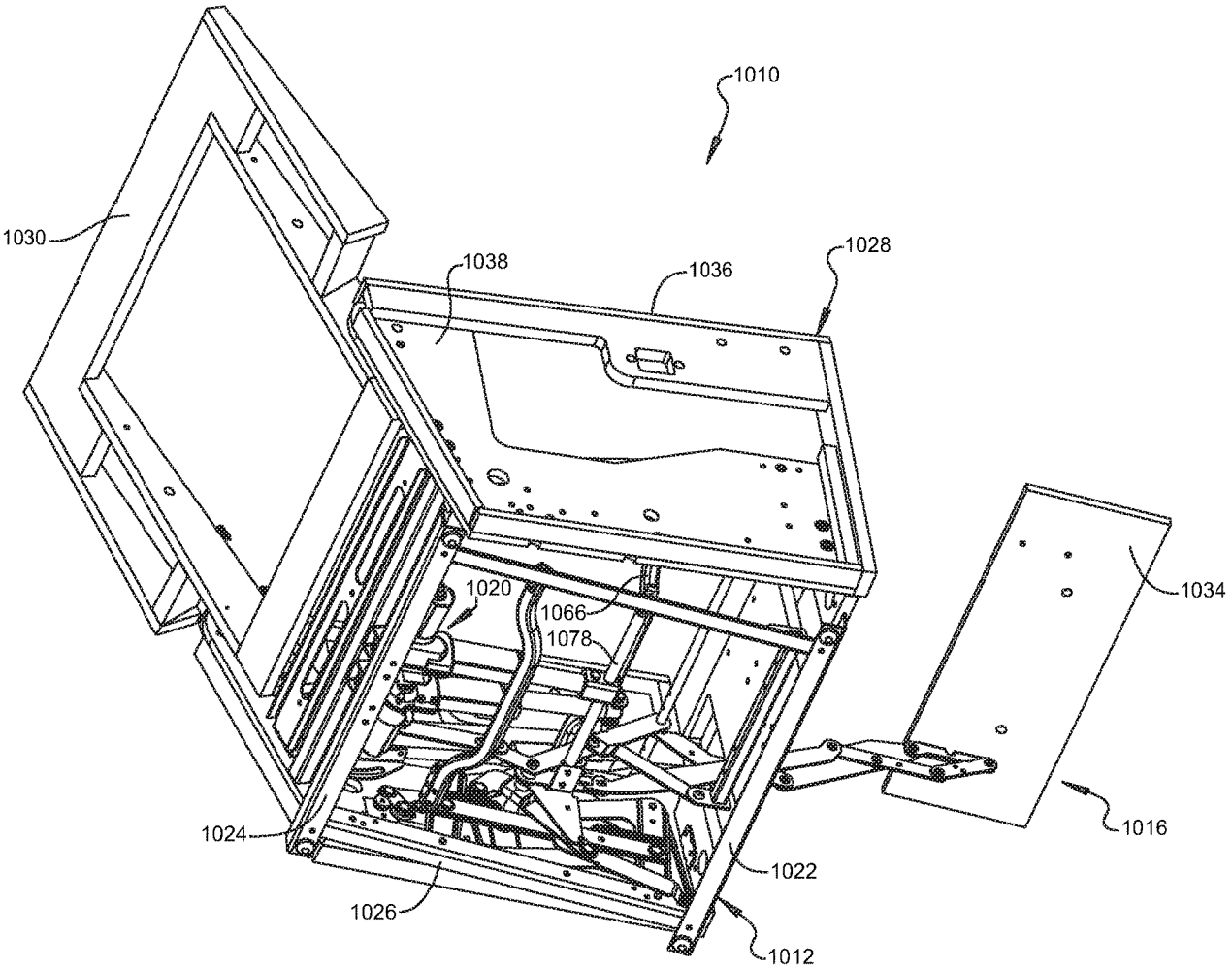
FIG. 27 is a bottom perspective view of the furniture member in the position of FIG. 26.

As shown in FIGS. 20, 26 and 33, the legrest mechanism 1016 may include a pair of pantograph linkages 1100 (only one of which is shown in the FIGS.). The pantograph linkages 1100 may be coupled to the front rod 1080, the legrest platform 1034, and the draw bar 1078. When the draw bar 1078 moves forward, the drive plate 1088, a drive clamp 1166 and the torque tube 1086 rotate about the shoulder bolt pin 1090 and drive the pantograph linkages 1100 and the legrest platform 1034 to move between the retracted position (FIGS. 19-21) and the extended position (FIGS. 26-28).

Figure 23:
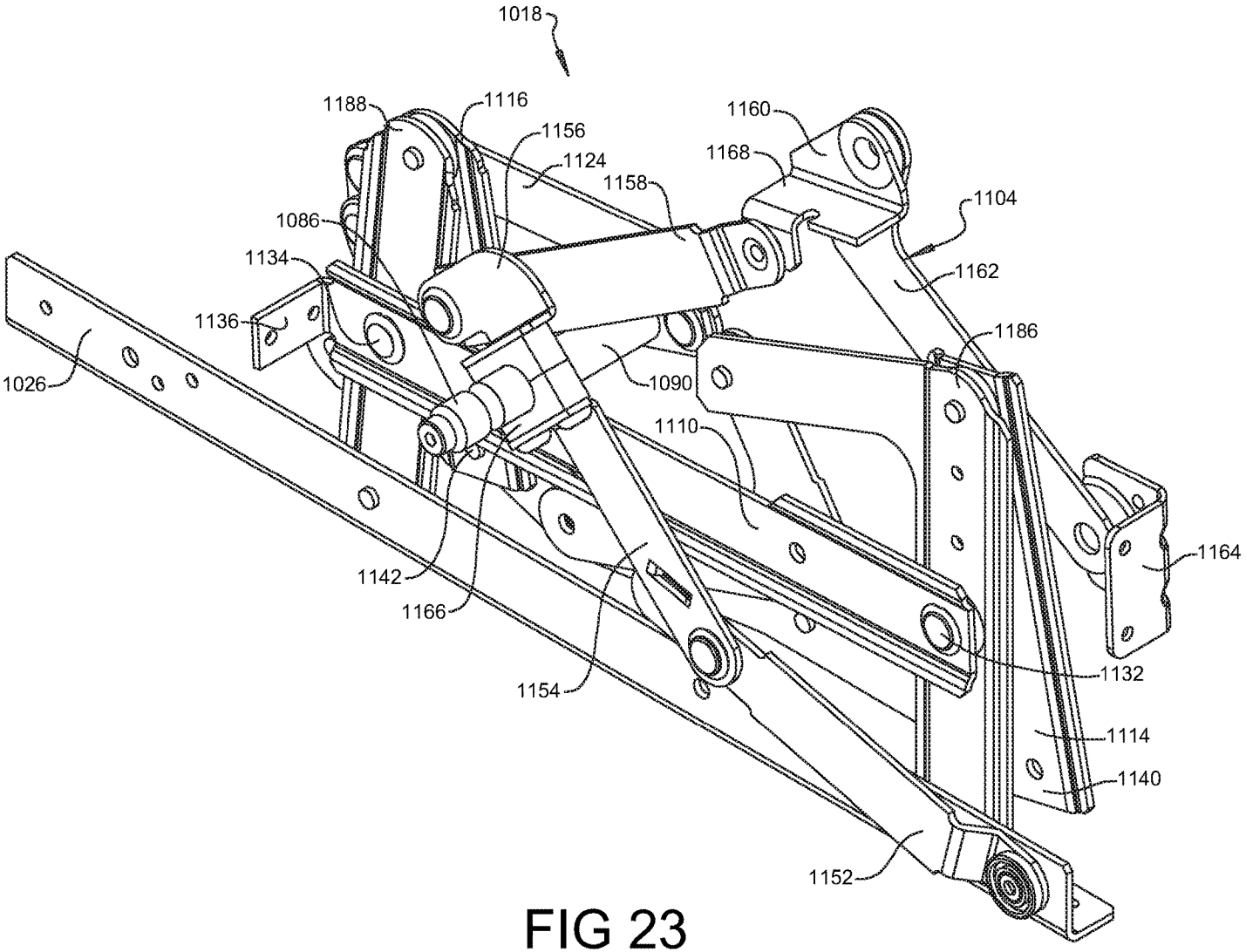
FIG. 23 is a perspective view of a wall-proximity mechanism of the furniture member when the furniture member is in the position of FIG. 19.
Figure 24:
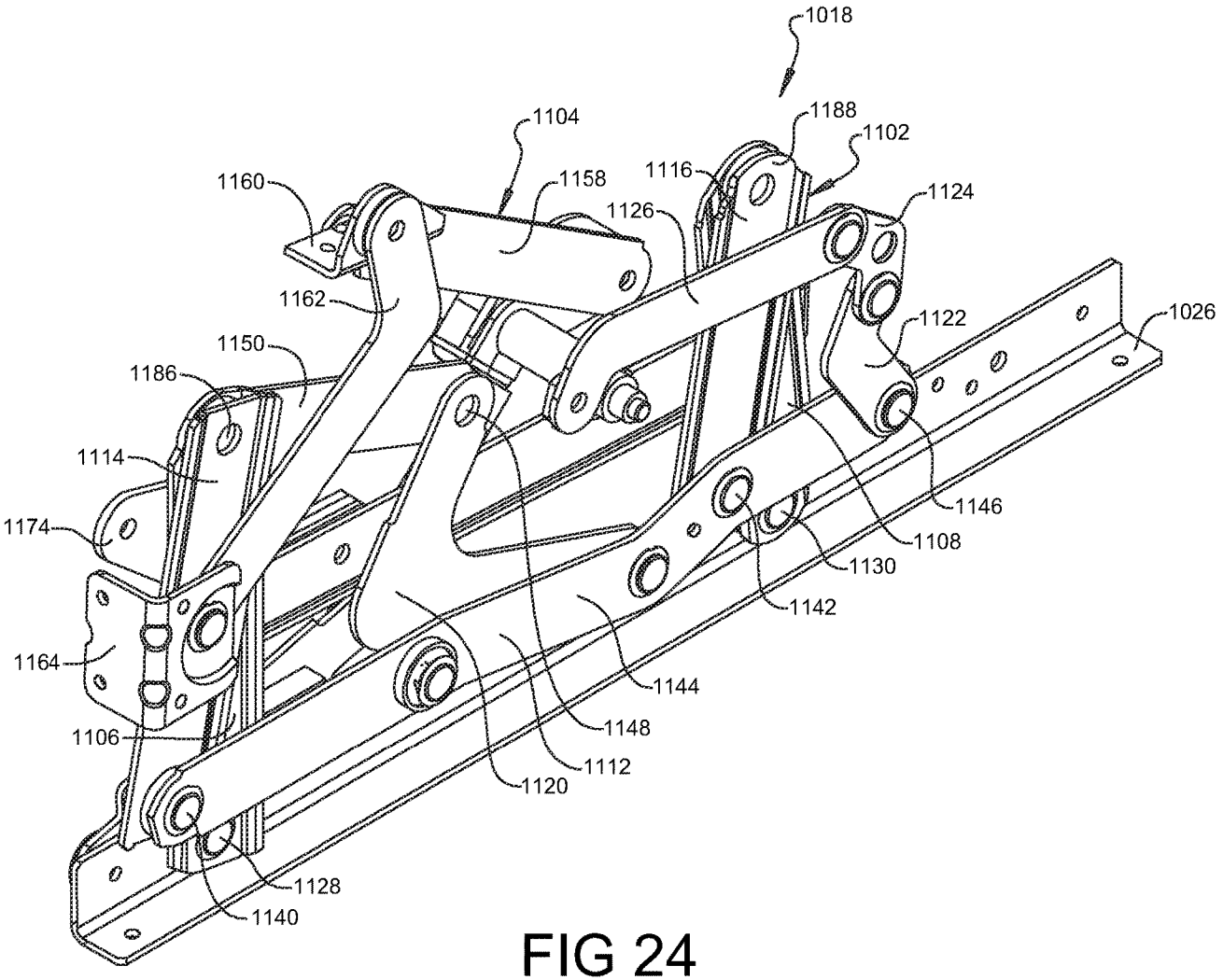
FIG. 24 is a perspective view of an opposite side of the wall-proximity mechanism of the furniture member when the furniture member is in the position of FIG. 19.

The wall-proximity mechanism 1018 may include a pair of first linkages 1102 (only one of which is shown in the FIGS.) and a pair of second linkages 1104 (only one of which is shown in the FIGS.). As shown in FIGS. 23 and 24, each of the first linkages 1102 may include a first motion link 1106, a second motion link 1108, a first cross-member 1110, a second cross-member 1112, a first control link 1114, a second control link 1116, a first connecting link 1118, a second connecting link 1120, a third connecting link 1122, a fourth connecting link 1124, and a drive link 1126.

In the example shown, first ends 1128, 1130 of the first motion link 1106 and the second motion link 1108, respectively, are pivotably mounted to the side support member 1026. As such, the first motion link 1106 and the second motion link 1108 can rotate relative to the base frame 1012. The first cross-member 1110 is pivotably connected to an intermediate portion 1132 of the first motion link 1106 and to an intermediate portion 1134 of the second motion link 1108. An aft end 1136 of the first cross-member 1110 is connected to a transverse support bar 1138. As shown in FIG. 20, the transverse support bar 1138 spans across the furniture member 1010 and connects the aft end 1136 of the first cross-member 1110 to an aft end of the first cross-member (not shown in the FIGS.) located on the opposite side of the furniture member 1010.

The first control link 1114 is rotatably connected to the first motion link 1106 at a top end 1186. The second control link 1116 is rotatably connected to the second motion link 1108 at a top end 1188. The first control link 1114 projects forward and downward from the top end 1186 toward a second end 1140. The second control link 1116 projects forward and downward from the top end 1188 toward a second end 1142. The second end 1140 of the first control link 1114 and the second end 1142 of the second control link 1116 are connected to the second cross-member 1112.

The second cross-member 1112, in this example, is positioned laterally outboard of the first motion link 1106, the second motion link 1108, the first control link 1114 and the second control link 1116. The second connecting link 1120 can also be connected to the second cross-member 1112. In this example, the second connecting link 1120 is rotatably connected to an intermediate portion 1144 of the second cross-member 1112 that is located between the second ends 1140, 1142 of the first control link 1114 and the second control link 1116. The second connecting link 1120, in this example, has an L-shape. The second connecting link 1120 projects away from the intermediate portion 1144 of the second cross-member. The opposite end 1148 of the second connecting link is connected to an extension arm 1150 of the first motion link 1106.

The third connecting link 1122 can also be connected to the second cross-member 1112. As shown in FIG. 24, the third connecting link 1122 is rotatably connected to the aft end 1146 of the second cross-member 1112. The fourth connecting link 1124 is rotatably connected to the third connecting link 1122. The drive link 1126 is connected to the fourth connecting link 1124 and at or near the shoulder bolt pin 1090.

While not shown, one or more mounting brackets can be connected to the pair of first linkages 1102 to secure one or more elements of the seat assembly 1014. In one example, one or more mounting brackets are secured to the second cross-member 1112, the third connecting link 1122 and/or the shoulder bolt pin 1090. The one or more mounting brackets can connect the first linkages 1102 to the side panels of the seat assembly 1014.

The pair of second linkages 1104 (only one of which is shown in the FIGS.) can include, in one example, a first swing link 1152, a second swing link 1154, a drive bracket 1156, a first pull link 1158, a second pull link 1162, a pull brace 1164, a drive clamp 1166 and a pivot bracket 1160. As shown in the example of FIGS. 23 and 24, the first swing link 1152 can be rotatably connected to the side support member 1026. The second swing link 1154 can be rotatably connected to an opposite end of the first swing link 1152. The second swing link 1154 can extend between the first swing link 1152 and the drive clamp 1166. In this example, the second swing link is fixedly connected to the drive clamp 1166.

The drive clamp 1166 connects the second linkages 1104 to the shoulder bolt pin 1090 and/or the torque tube 1086. As will be explained further, the shoulder bolt pin 1090 translates forward after the legrest mechanism moves the legrest platform 1034 from the retracted to the extended position. The drive clamp 1166, in this example, is a two-piece clamp that is rotatably secured around the shoulder bolt pin 1090. The second swing link 1154 and the drive bracket 1156 are fixedly secured to the drive clamp 1166. The drive clamp 1166, however, is secured around the shoulder bolt pin 1090 and/or the torque tube 1086 to permit the rotation of the drive clamp 1166 relative to a center axis of shoulder bolt pin 1090.

The first pull link 1158 can extend between the drive bracket 1156 and the pivot bracket 1160. The first pull link 1158, in this example, is rotatably connected to the drive bracket 1156 and the pivot bracket 1160. The second pull link 1162 can extend between the pivot bracket 1160 and the pull brace 1164. In this example, the second pull link 1162 is rotatably connected to the pivot bracket 1160 and the pull brace 1164.

The pivot bracket 1160 can include a seat flange 1168. The seat flange 1168, in this example, is a planar surface on the pivot bracket 1160 that can include one or more attachment points to which the seat bottom 1032 can be attached. The pull brace 1164, in the example shown, is an L-shaped bracket that can include one or more attachment surfaces that can be fixed to the seat frame 1028. In the example shown, the pull brace 1164 is connected to a front panel of the seat frame 1028.

The links, brackets and/or braces of the first linkages 1102 and the second linkages 1104 can have any suitable cross-sectional profile. In some examples, the links, brackets and/or braces have continuous cross-sectional profiles. In other examples, the links, bracket and/or braces can have cross-sectional profiles that vary along their lengths. Some of the links, such as the first motion link 1106, the second motion link 1108, the first control link 1114 and/or the second control link 1116, have profiles with support ribs or support flanges that run down the edges of the links. Such ribs or support flanges can increase the bending strength of the link over that of a link having a flat or straight cross-sectional profile. In addition, a cross-sectional profile with a support rib and/or a support flange along one or both edges of the link can create a cup-shaped profile to provide clearance for a bushing or other friction-reducing element to be positioned in the profile between the link and an adjacent link that is rotatably connected thereto.

The links, brackets and/or braces of the first linkages 1102 and the second linkages 1104 can be connected to one another using any suitable connection method. In some examples, the links, brackets and/or braces that are described as fixedly connected to one another are joined using fasteners such as rivets, screws, bolts. The links, brackets and/or braces that are fixedly connected to one another can also be joined using other connection methods such as welding, staking or the like. In instances in which the links, brackets and/or braces are described as being rotatably connected to one another, the links, brackets and/or braces can be joined using any suitable connecting structure that permits the joined components to rotate relative to one another about the point of connection.

In one example, the rotatably connected links, brackets and/or braces can be joined using a rotatable joint assembly. Such a joint assembly can include a bushing, a grommet and a rivet or other fastener. The grommet is inserted into an opening on the link, bracket and/or brace and the bushing is placed between the adjacent links, brackets and/or braces. The rivet (or other fastener) is then inserted through the adjacent links, brackets and/or braces and through the grommet and the bushing to create a low-friction rotatable joint. In other examples, other rotatably joint assemblies can be used.

With reference to FIGS. 19-38, the operation of the furniture member 1010 will be described. As explained above, the pantograph linkages 1100 move the legrest platform 1034 from the retracted position (FIGS. 19-21) to the extended position (FIGS. 26-28). The first motor assembly 1072 causes the draw bar 1078 to move from a first position to a second position. In doing so, the drive plate 1088 rotates and translates forward driving the pantograph linkages 1100 to extend the legrest platform 1034. As this action occurs, the wall-proximity mechanism 1018 stays largely unchanged.

The furniture member 1010, after the legrest platform 1034 has moved from the retracted position to the extended position, can move further such that the seatback 1030 moves from the upright position to the reclined position and the seat frame can tilt rearward and translate forward. This positioning of the furniture member 1010 is depicted in FIGS. 32-34. To cause the further movement of the furniture member 1010, the second motor assembly 1074 causes the front bar 1066 to move forward from a first position to a second position. The movement of the front bar 1066 causes the seat bottom 1032 to move forward. The pivot bracket 1160 of the second linkage 1104 is also connected to the seat bottom 1032. The second linkage 1104 is also connected to the shoulder bolt pin 1090 via the drive bracket 1156 and the drive clamp 1166. As the front bar 1066 translates forward, the shoulder bolt pin 1090 and the drive link 1126 translate forward. The drive link 1126 pulls the fourth connecting link 1124 and the third connecting link 1122. This movement pulls the second cross-member 1112 forward. As the second cross-member 1112 moves forward, the first control link 1114 and the second control link 1116 (and the first motion link 1106 and the second motion link 1108) rotate to cause the seat assembly 1014 to translate forward and tilt rearward as shown in FIG. 32.

As the wall-proximity mechanism 1018 causes the seat assembly 1014 to translate forward and tilt rearward, the seatback 1030 can move from the upright position to the reclined position. As shown in FIGS. 25 and 38, the lever 1042 can rotate relative to the slide member 1044 to permit the seatback 1030 to tilt rearward and move to the reclined position.

As can be appreciated, the furniture member 1010 can operate in the in a reverse manner to that previously described to return the furniture member 1010 to its original positioning. The first motor assembly 1072 can move the draw bar 1078 rearward. This movement causes the legrest platform 1034 to return from the extended position to the retracted position. The second motor assembly 1074 can move the front bar 1066 rearward. This movement causes the seat bottom 1032 to move rearward and the seat assembly 1014 to move rearward as well.

While the furniture members 10, 1010 are shown in the FIGS. as a chair, it will be appreciated that the furniture members 10, 1010 could be any other motion-furniture item, such as a sofa or loveseat, for example, and the principles of the present disclosure can be applied to such furniture items.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame for supporting the furniture member on a support surface;

a seat assembly supported by the base frame and including a seat base, a seat bottom, and a seatback, wherein the seat base supports the seat bottom and the seatback;

a wall-proximity mechanism connected to the base frame and the seat assembly, the wall-proximity mechanism configured to translate the seat assembly forward relative to the base frame from a first position to a second position; and a stability linkage connected to the wall-proximity mechanism, the stability linkage including a leg, the leg moving forward of the base frame and toward the support surface when the wall-proximity mechanism translates the seat assembly forward to the second position to prevent the furniture member from tipping forward, wherein when the seat assembly is in the second position, at least a portion of the leg is disposed forward of the base frame and between the support surface and a front, lower edge of the seat base so that the leg restricts the base frame from tipping forward relative to the support surface, and wherein the leg of the stability linkage moves toward the support surface but remains spaced apart from the support surface when the wall-proximity mechanism translates the seat assembly forward.

2. The furniture member of claim 1, further comprising a motor assembly mounted to the base frame, the motor assembly including a draw bar that moves along a motor extrusion housing to cause the wall-proximity mechanism to translate the seat assembly forward relative to the base frame and cause the leg to move forward relative to the base frame.

3. The furniture member of claim 2, wherein the seat assembly includes a legrest, the legrest coupled to the seat base by a legrest mechanism that is configured to move the legrest relative to the seat base from a retracted position to an extended position, the legrest mechanism coupled to the draw bar such that movement of the draw bar along the motor extrusion housing causes the legrest mechanism to move the legrest from the retracted position to the extended position.

4. The furniture member of claim 3, wherein the motor assembly moves the draw bar along the motor extrusion housing from an initial position to a first position and to a second position, the movement of the draw bar from the initial position to the first position causing the legrest mechanism to move the legrest from the retracted position to the extended position, and the movement of the draw bar from the first position to the second position causing the wall-proximity mechanism to translate the seat assembly forward relative to the base frame and causing the leg to move forward relative to the base frame.

5. The furniture member of claim 4, wherein:

the motor assembly further includes a sequencing mechanism, the sequencing mechanism comprising a front rod and a spring, the spring connected between the front rod and the draw bar, the front rod connected to the seat base; and the sequencing mechanism is configured to apply a force to the draw bar toward the front rod to cause the movement of the draw bar to result in the legrest mechanism moving the legrest from the retracted position to the extended position before movement of the draw bar results in the wall-proximity mechanism translating the seat assembly forward relative to the base frame.

6. A furniture member comprising:

a base frame for supporting the furniture member on a support surface;

a seat assembly supported by the base frame, the seat assembly including a legrest and a seat frame;

a motor assembly mounted to the base frame, the motor assembly including a draw bar that moves along a motor extrusion housing from an initial position to a first position and to a second position;

a legrest mechanism connected to the legrest and the draw bar, the legrest mechanism configured to move the legrest relative to the seat frame from a retracted position to an extended position when the draw bar moves from the initial position to the second position;

a wall-proximity mechanism connected to the base frame, the seat assembly and the draw bar, the wall-proximity mechanism configured to translate the seat assembly forward relative to the base frame when the draw bar moves from the first position to the second position; and a sequencing mechanism comprising a front rod and a spring, the spring connected between the front rod and the draw bar, the front rod connected to the seat frame, wherein the sequencing mechanism is configured to apply a force to the draw bar toward the front rod to cause movement of the draw bar to result in the legrest mechanism moving the legrest from the retracted position to the extended position before movement of the draw bar results in the wall-proximity mechanism translating the seat assembly forward relative to the base frame.

7. The furniture member of claim 6, wherein the motor assembly includes a single motor that moves the draw bar along the motor extrusion housing, the motor extrusion housing having a linear shape that is rotatably connected to the base frame.

8. The furniture assembly of claim 7, wherein the motor assembly includes a lead screw and a lead screw nut positioned inside the motor extrusion housing, the draw bar connected to the lead screw nut.

9. The furniture member of claim 7, wherein the draw bar translates forward relative to the base frame when the draw bar moves from the initial position to the first position.

10. The furniture member of claim 9, wherein the draw bar translates forward relative to the base frame when the draw bar moves from the first position to the second position.

11. The furniture member of claim 10, wherein the draw bar is connected to and axially offset from a pin by a drive plate, the pin connected to the legrest mechanism and to the wall-proximity mechanism, wherein the pin is rigidly connected to the seat frame and extends from the seat frame to the legrest mechanism.

12. A furniture member comprising:

a base frame;

a seat assembly supported by the base frame and including a seat frame, a seat bottom, a seat back and a legrest, the legrest movable relative to the base frame and seat frame between a retracted position and an extended position, the seat back movable relative to the base frame and seat frame between an upright position and a reclined position;

a motor assembly mounted to the base frame, the motor assembly including a draw bar that moves along a motor extrusion housing from an initial position to a first position and to a second position;

a legrest mechanism attached to the legrest and the seat frame and driven by the draw bar configured to move the legrest between the retracted and extended positions in response to movement of the draw bar from the initial position to the first position; and a wall-proximity mechanism connected to the base frame, the seat assembly and the draw bar configured to translate the seat frame forward relative to the base frame in response to movement of the draw bar from the first position to the second position, wherein:

the draw bar is connected to a pin by a drive plate, the drive plate positioned adjacent the legrest mechanism and the pin connected to the wall-proximity mechanism;

movement of the draw bar from the initial position to the first position causes the drive plate to rotate relative to the pin; and movement of the draw bar from the first position to the second position causes the pin to translate forward relative to base frame.

13. The furniture member of claim 12, wherein the motor assembly includes a single motor that moves the draw bar along the motor extrusion housing relative to the base frame.

14. The furniture member of claim 12, wherein the wall-proximity mechanism includes a first linkage connected to the draw bar, the first linkage including a first motion link and a second motion link, the first motion link and the second motion link rotatably connected to a first cross-member and to the base frame, the first motion link rotatably connected to a first control link on an end opposite to the base frame and the second motion link rotatably connected to a second control link on an end opposite to the base frame, the first control link and the second control link rotatably connected to a second cross-member, the first cross-member and the second cross-member configured to move substantially parallel to one another to translate the seat frame forward relative to the base frame in response to movement of the draw bar from the first position to the second position.

15. The furniture member of claim 12, wherein the wall-proximity mechanism includes a second linkage connected to the draw bar, the second linkage including a first swing link, a second swing link, a drive clamp, a first pull link, a second pull link and a pivot bracket, the first swing link rotatably connected to the base frame at one end and to the second swing link at the opposite end, the second swing link rotatably connected to the drive clamp, the drive clamp connected to the draw bar and to the first pull link, the pivot bracket connected to the seat bottom and to the first pull link and to the second pull link, the second pull link connected to the seat frame, the second linkage configured to translate the seat bottom forward relative to the seat frame in response to movement of the draw bar from the first position to the second position.

16. The furniture member of claim 15, wherein the wall-proximity mechanism includes a stability linkage, the stability linkage including a tilt link and a leg, the leg rotatably connected to the tilt link and to the first motion link such that the leg moves outward from the first motion link when the first linkage translates the seat frame forward.

17. The furniture member of claim 16, wherein the base frame is positioned on a support surface, and wherein the leg of the stability linkage moves toward the support surface but remains spaced apart from the support surface when the first linkage translates the seat frame forward.

18. The furniture member of claim 12, wherein:

the motor assembly further includes a sequencing mechanism, the sequencing mechanism comprising a front rod and a spring, the spring connected between the front rod and the draw bar, the front rod connected to the seat frame, wherein the sequencing mechanism is configured to apply a force to the draw bar toward the front rod to assist the motor assembly to cause the legrest mechanism to move the legrest from the retracted position to the extended position, the draw bar translates forward relative to the base frame when the draw bar moves from the initial position to the first position, and the draw bar translates forward relative to the base frame when the draw bar moves from the first position to the second position.

19. The furniture member of claim 12, wherein the base frame is positioned on a support surface, and wherein the furniture member further comprises a stability linkage connected to the wall-proximity mechanism, the stability linkage including a leg, the leg moving forward of the base frame and toward the support surface when the wall-proximity mechanism translates the seat assembly forward such that at least a portion of the leg is disposed forward of the base frame and between the support surface and a front, lower edge of the seat frame so that the leg restricts the base frame from tipping forward relative to the support surface.

20. The furniture member of claim 6, further comprising a stability linkage connected to the wall-proximity mechanism, the stability linkage including a leg, the leg moving forward of the base frame and toward the support surface when the wall-proximity mechanism translates the seat assembly forward such that at least a portion of the leg is disposed forward of the base frame and between the support surface and a front, lower edge of the seat frame so that the leg restricts the base frame from tipping forward relative to the support surface.

* * * * *